US009441351B2

(12) United States Patent
Kunz

(10) Patent No.: US 9,441,351 B2
(45) **Date of Patent: *Sep. 13, 2016**

(54) GROUND ENGAGING TOOL ASSEMBLY

(71) Applicant: Caterpillar Inc., Peoria, IL (US)

(72) Inventor: Phillip J. Kunz, Morton, IL (US)

(73) Assignee: Caterpillar Inc., Peoria, IL (US)

( * ) Notice: Subject to any disclaimer, the term of this patent is extended or adjusted under 35 U.S.C. 154(b) by 56 days.

This patent is subject to a terminal disclaimer.

(21) Appl. No.: 13/956,565

(22) Filed: Aug. 1, 2013

(65) Prior Publication Data

US 2015/0033600 A1 Feb. 5, 2015

(51) Int. Cl.
*E02F 9/28* (2006.01)

(52) U.S. Cl.
CPC ..... *E02F 9/2833* (2013.01); *E02F 9/2883* (2013.01)

(58) Field of Classification Search
CPC ... E02F 9/2808; E02F 9/2816; E02F 9/2825; E02F 9/2833; E02F 9/2858; E02F 9/2883
See application file for complete search history.

(56) References Cited

U.S. PATENT DOCUMENTS 3,079,710 A * 3/1963 Larsen et al. ..... 37/455
3,967,399 A 7/1976 Heinold et al.
4,052,802 A 10/1977 Moen et al.
4,086,966 A 5/1978 Lanz et al.
4,128,132 A 12/1978 Moen et al.
4,335,532 A * 6/1982 Hahn et al. ..... 37/459
4,918,843 A 4/1990 Kiesewetter et al.
5,205,057 A 4/1993 Garman
5,386,653 A 2/1995 Cornelius
5,634,285 A 6/1997 Renski
5,743,033 A 4/1998 Gegel
5,896,911 A 4/1999 Gegel
5,966,849 A 10/1999 Moehnke et al.
5,992,063 A 11/1999 Mack
6,085,448 A 7/2000 Gale et al.
6,092,958 A 7/2000 Gale
6,145,224 A 11/2000 Stickling
D458,614 S 6/2002 Esterhuyse et al.
6,457,269 B1 10/2002 Esterhuyse et al.

(Continued)

FOREIGN PATENT DOCUMENTS

WO 2007016719 2/2007

OTHER PUBLICATIONS

ESCO, "ESCO Nemisys Mining Lip System," 2013, 5 pp. Portland, OR.

(Continued)

*Primary Examiner* — Jamie L McGowan
(74) *Attorney, Agent, or Firm* — Leydig, Voit & Mayer, Ltd.

(57) ABSTRACT

A ground engaging tip comprising a ground engaging portion and a coupling portion. The coupling portion includes an interior surface, a side wall, and an interlock tab. The interior surface defines a coupler pocket and has a base wall. The side wall and the base wall define the coupler pocket. The interlock tab has a base end and a proximal end. The base end of the interlock tab is contiguous with the side wall, and the interlock tab extends from the base end to the proximal end. The sidewall defines a retention orifice. A ratio of a first distance, measured from the center of the retention orifice to the base wall and a second longitudinal distance, measured from the center of the retention orifice to the proximal end is about 3:2 or less.

12 Claims, 32 Drawing Sheets

(56) References Cited

U.S. PATENT DOCUMENTS

| | | | | |
|---|---|---|---|---|
| 6,477,796 | B1 | 11/2002 | Cornelius | |
| 6,491,469 | B1 * | 12/2002 | Pasqualini et al. | 403/318 |
| 7,762,015 | B2 | 7/2010 | Smith et al. | |
| 8,117,772 | B2 | 2/2012 | Harder et al. | |
| 8,122,622 | B2 | 2/2012 | Smith et al. | |
| 8,127,475 | B2 | 3/2012 | Harder et al. | |
| 8,170,756 | B2 | 5/2012 | Morey et al. | |
| 8,229,631 | B2 | 7/2012 | Morey et al. | |
| 8,393,097 | B2 | 3/2013 | Harder et al. | |
| 2002/0195259 | A1 | 12/2002 | Satzler | |
| 2004/0010949 | A1 | 1/2004 | Laguarda et al. | |
| 2004/0060207 | A1 * | 4/2004 | Livesay et al. | 37/451 |
| 2004/0221491 | A1 * | 11/2004 | Briscoe | 37/452 |
| 2007/0256335 | A1 * | 11/2007 | De Martiis | 37/444 |
| 2008/0148608 | A1 | 6/2008 | Harder et al. | |
| 2011/0035970 | A1 | 2/2011 | Smith et al. | |
| 2011/0035971 | A1 | 2/2011 | Smith et al. | |
| 2011/0035972 | A1 | 2/2011 | Harder et al. | |
| 2011/0058894 | A1 * | 3/2011 | Heaphy et al. | 403/157 |
| 2012/0186113 | A1 | 7/2012 | Harder et al. | |
| 2012/0210612 | A1 | 8/2012 | Harder et al. | |
| 2012/0260540 | A1 * | 10/2012 | Guimaraes et al. | 37/453 |
| 2012/0297649 | A1 | 11/2012 | Gomar | |
| 2012/0304506 | A1 | 12/2012 | Guimaraes et al. | |
| 2013/0174453 | A1 * | 7/2013 | Cheyne et al. | 37/453 |
| 2015/0007464 | A1 * | 1/2015 | Simpson et al. | 37/456 |
| 2015/0013198 | A1 * | 1/2015 | Tanaka et al. | 37/456 |

OTHER PUBLICATIONS

ESCO, "ESCO Posilok Plus Mining Tooth System," 2009, 4 pp. Portland, OR.

Hensley Indus., Inc., "XS Extreme Service: Specification Guide," Mar. 2011, 31 pp., Dallas, TX.

* cited by examiner

GROUND ENGAGING TOOL ASSEMBLY

TECHNICAL FIELD

This patent disclosure relates generally to ground engaging tools and, more particularly, to ground engaging tools on buckets, blades, and other work tools used with mining and construction machinery.

BACKGROUND

Different types of mining and construction machines, such as excavators, wheel loaders, hydraulic mining shovels, cable shovels, bucket wheels, and draglines commonly employ buckets to dig and remove the earth being worked or materials being excavated or loaded. The buckets frequently experience extreme wear from the loading forces and highly abrasive materials encountered during operation. Replacement of the large buckets and other implements used in mining and construction machinery can be very costly and labor intensive.

The bucket can be equipped with a ground engaging tool (GET) or a set of GETs to help protect the bucket and other earth working tools from wear. Typically, a GET can be in the form of teeth, edge protectors, tips, or other removable components that can be attached to the areas of the bucket or other tool where most damaging and repeated abrasions and impacts occur. For example, a GET in the form of edge protectors can wrap around a bucket's cutting edge to help protect it from excessive wear.

In such applications, the removable GET can be subjected to wear from abrasion and repeated impact, while helping to protect the bucket or other implement to which it can be mounted. When the GET becomes worn through use, it can be removed and replaced with a new GET at a reasonable cost to permit the continued use of the same bucket. By protecting the implement with a GET and replacing the worn GET at appropriate intervals, significant cost and time savings are possible.

A GET can have a variety of forms. For example, U.S. Pat. No. 7,762,015 for a "Ground Engaging Tool System," issued Jul. 27, 2010, to Smith et al. is directed to a ground engaging tool system with a ground engaging tool such as a tip, an adapter mounted to or part of a work tool, and a rotating lock member. The ground engaging tool can be attached to the adapter, and a post portion of the adapter slides into a slot provided on the lock member. The lock member can be rotated so that the entrance to the slot can be blocked and the post cannot slide out of the slot. The lock member in this position can be in a locking position, and the retention of the post in the slot of the lock member retains the ground engaging tool to the adapter.

The cost and time savings available from using a GET to protect large machine implements can be further enhanced by increasing the lifespan of the GET. Thus, a more durable GET system can result in fewer work stoppages for part replacements, thereby resulting in higher work efficiency. There is an ongoing need in the art for an improved GET system that increases the useful life of GET tools resulting in fewer replacements and increased productivity.

It will be appreciated that this background description has been created by the inventors to aid the reader, and is not to be taken as an indication that any of the indicated problems were themselves appreciated in the art. While the described principles can, in some respects and embodiments, alleviate the problems inherent in other systems, it will be appreciated that the scope of the protected innovation is defined by the attached claims, and not by the ability of any disclosed feature to solve any specific problem noted herein.

SUMMARY

In an embodiment, the present disclosure describes a ground engaging tip comprising a ground engaging portion and a coupling portion in opposing relationship to the ground engaging portion along a longitudinal axis thereof. The coupling portion includes an interior surface, a side wall, and an interlock tab. The interior surface defines a coupler pocket and has a base wall. The side wall and the base wall at least partially define the coupler pocket. The interlock tab has a base end and a proximal end. The base end of the interlock tab is contiguous with the side wall, and the interlock tab extends from the base end to the proximal end in a direction substantially away from the ground engaging portion. The sidewall defines a retention orifice having a center. A ratio of a first longitudinal distance, measured along the longitudinal axis, from the center of the retention orifice to the base wall of the interior surface and a second longitudinal distance, measured along the longitudinal axis, from the center of the retention orifice to the proximal end of the interlock tab is about 3:2 or less.

In other embodiments, the present disclosure describes a ground engaging tool system comprising a ground engaging tip that includes a ground engaging portion and a coupling portion in opposing relationship to the ground engaging portion along a longitudinal axis thereof. The coupling portion includes an interior surface, a side wall, and an interlock tab. The interior surface defines a coupler pocket that has an opening in communication with an interior cavity. The interior surface has a base wall. The side wall and the base wall at least partially define the coupler pocket, and the interlock tab has a base end and a proximal end. The base end of the interlock tab is contiguous with the side wall, the interlock tab extending from the base end to the proximal end in a direction substantially away from the ground engaging portion. The sidewall defines a retention orifice having a center. A ratio of a first longitudinal distance, that is measured along the longitudinal axis, from the center of the retention orifice to the base wall and a second longitudinal distance, that is measured along the longitudinal axis, from the center of the retention orifice to the proximal end of the interlock tab is about 3:2 or less. The ground engaging tool system has a coupler that has a mounting nose and an interlock collar defining an interlock recess. The coupler is mounted to the ground engaging tip such that the mounting nose of the coupler is disposed within the coupler pocket and the interlock tab of the ground engaging tip is disposed within the interlock recess. A retention mechanism is disposed within the retention orifice and is adapted to secure the ground engaging tip to the coupler.

In yet another embodiment, the present disclosure describes a ground engaging tip comprising a base wall and a side wall that at least partially defining a coupler pocket. An interlock tab extends from the side wall to a proximal end in a direction substantially away from the base wall. The side wall defines a retention orifice disposed substantially longitudinally midway between the proximal end of the interlock tab and the base wall.

Further and alternative aspects and features of the disclosed principles will be appreciated from the following detailed description and the accompanying drawings. As will be appreciated, the principles related to GET assemblies disclosed herein are capable of being carried out in other and different embodiments, and capable of being modified in various respects. Accordingly, it is to be understood that both the foregoing general description and the following detailed description are exemplary and explanatory only and do not restrict the scope of the appended claims.

DETAILED DESCRIPTION

Figure 1:
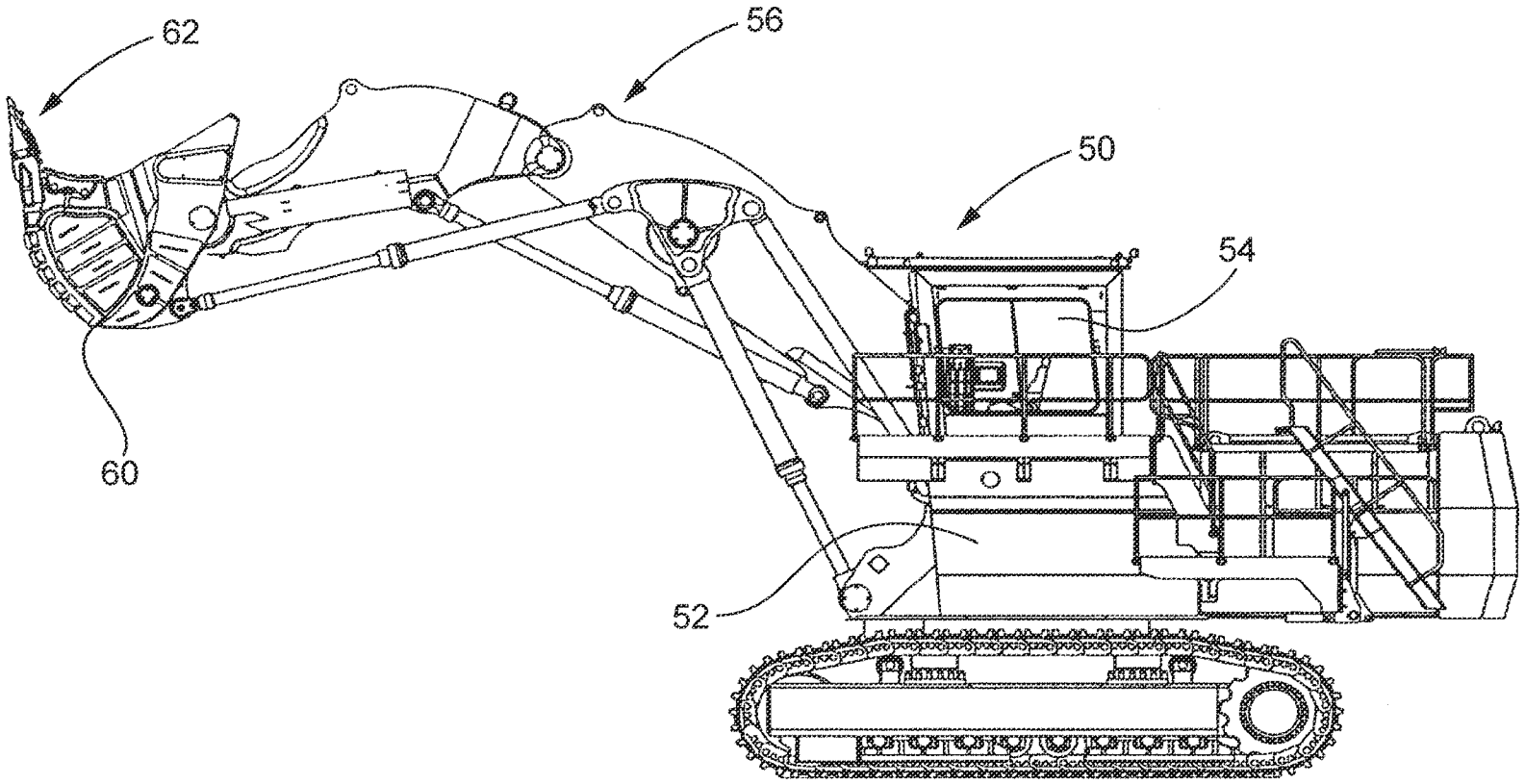
FIG. 1 is a diagrammatic side elevational view of an embodiment of a machine including an embodiment of an implement having an embodiment of a GET assembly constructed in accordance with principles of the present disclosure.

This disclosure relates to GET assemblies and systems utilized in various types of mining and construction machinery. FIG. 1 shows an embodiment of a machine 50 in the form of a hydraulic shovel that can include an embodiment of a GET assembly 70 constructed in accordance with principles of the present disclosure. Among other uses, a hydraulic shovel can be used to load overburden and ore into haul trucks during the mining process in various surface mine applications.

As shown in FIG. 1, the machine 50 can include a body 52 with a cab 54 to house a machine operator. The machine can also include a boom system 56 pivotally connected at one end to the body 52 and supporting an implement 60 at an opposing, distal end. In embodiments, the implement 60 can be any suitable implement, such as a bucket, a clamshell, a blade, or any other type of suitable device usable with GETs. A control system can be housed in the cab 54 that can be adapted to allow a machine operator to manipulate and articulate the implement 60 for digging, excavating, or any other suitable application.

Figure 2:
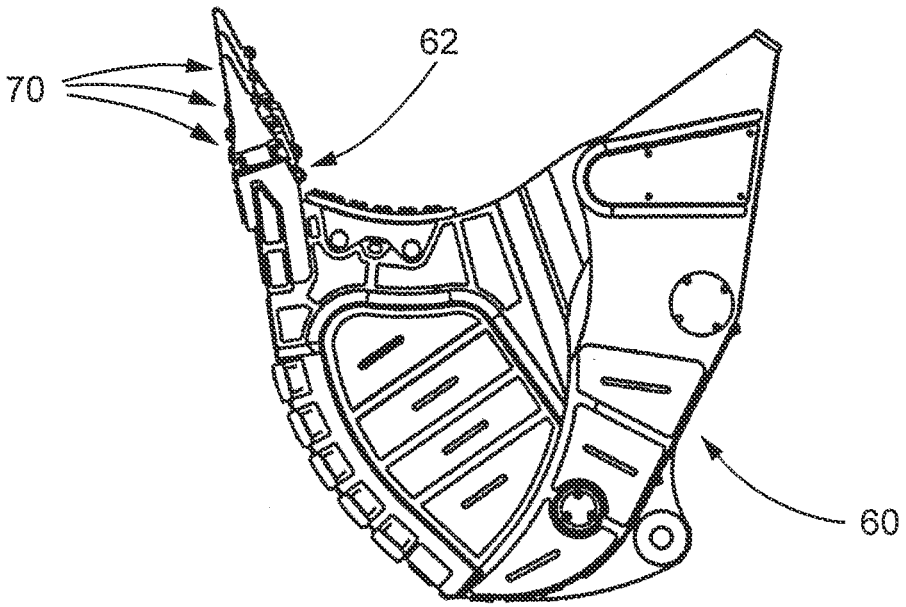
FIG. 2 is an enlarged, side elevational view of the implement of FIG. 1.
Figure 3:
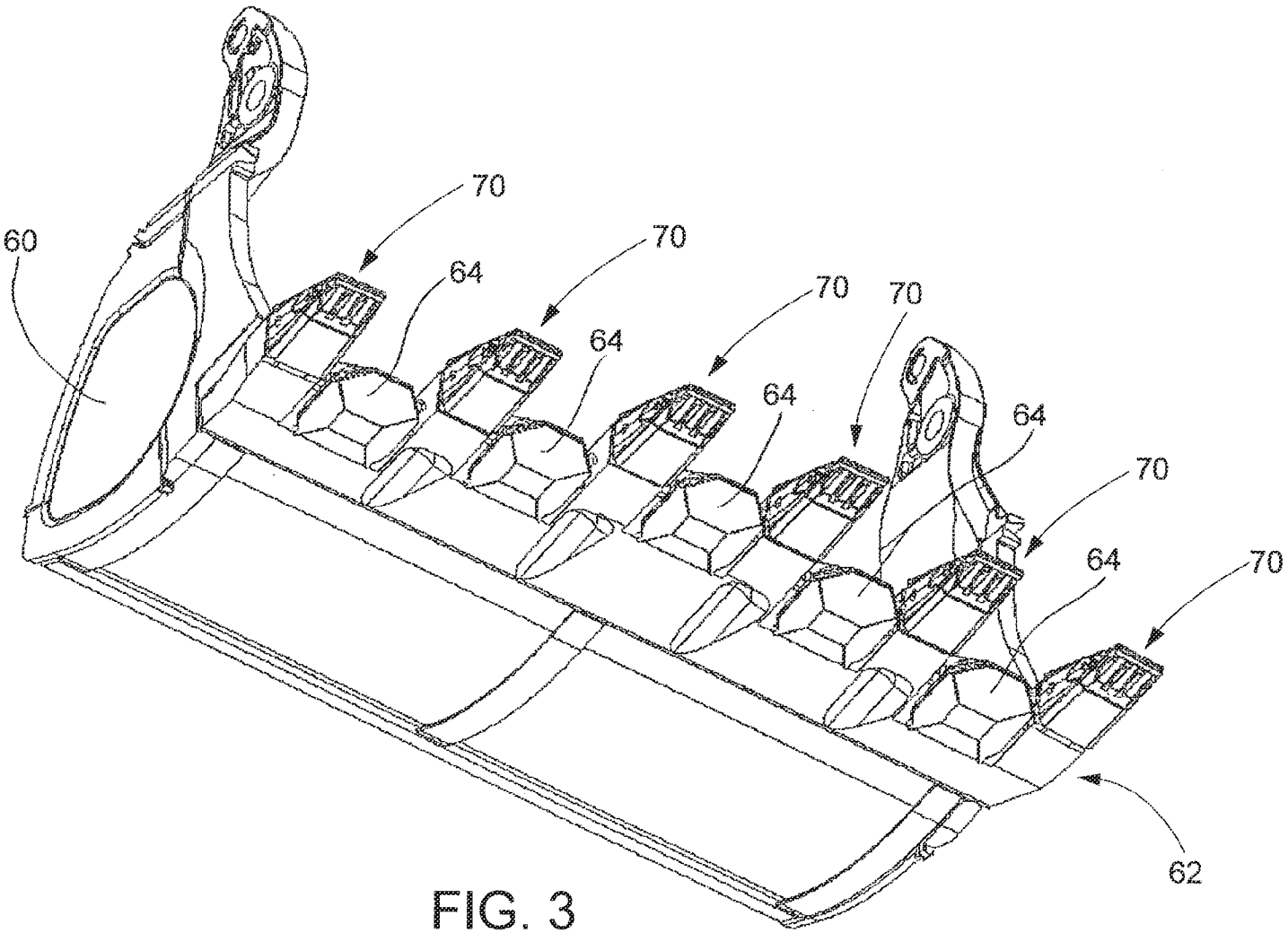
FIG. 3 is a perspective view of a face shovel bucket component of the implement of FIG. 1.
Figure 4:
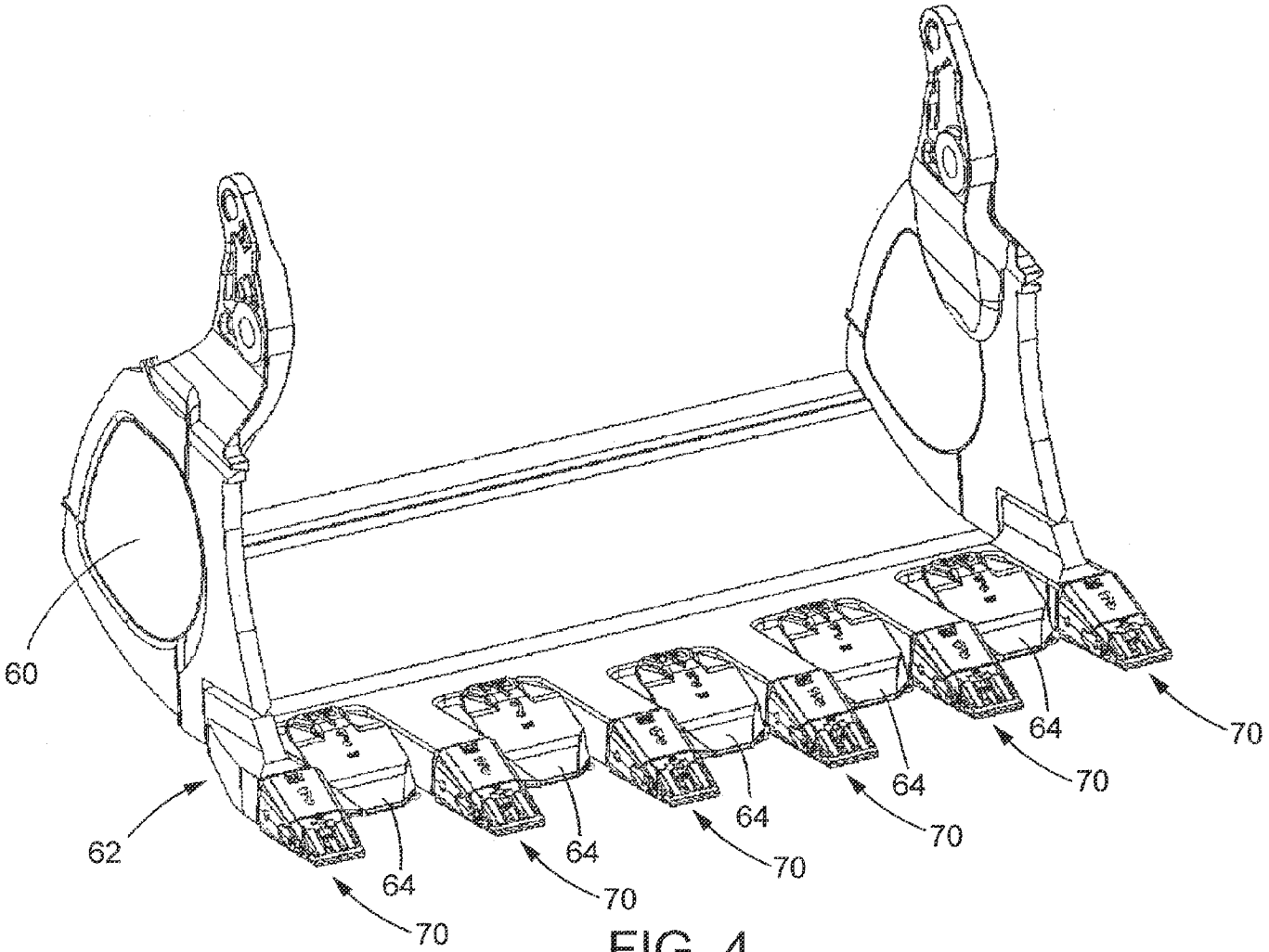
FIG. 4 is another perspective view of the face shovel bucket component of FIG. 3.

FIGS. 2-4 show embodiments of the implement 60. Referring to FIG. 2, the implement 60 can include a cutting edge 62 that can be adapted to engage the ground or other excavating surface. The cutting edge 62 can have a plurality of the GET assemblies 70. The GET assemblies 70 can be arranged on the cutting edge 62 such that the GET assemblies 70 contact the working material with the cutting edge 62 in offset relationship to the tips of the GET assemblies 70. As shown in FIGS. 3-4, shrouds 64 can be alternately arranged with the GET assemblies 70 to further protect the portions of the cutting edge 62 not covered by the GET assemblies 70. Through repeated use, the GET assemblies 70 can be subjected to wear and eventually can be replaced to allow the further use of the implement 60.

Although FIGS. 1-4 illustrate the use of a GET assembly constructed in accordance with principles of the present disclosure with a bucket of a hydraulic shovel, many other types of implements and mining and construction machinery can benefit from using a GET assembly as described herein. It should be understood that, in other embodiments, a GET assembly constructed in accordance with principles of the present disclosure can be used in a variety of other implements and/or machines.

Figure 5:
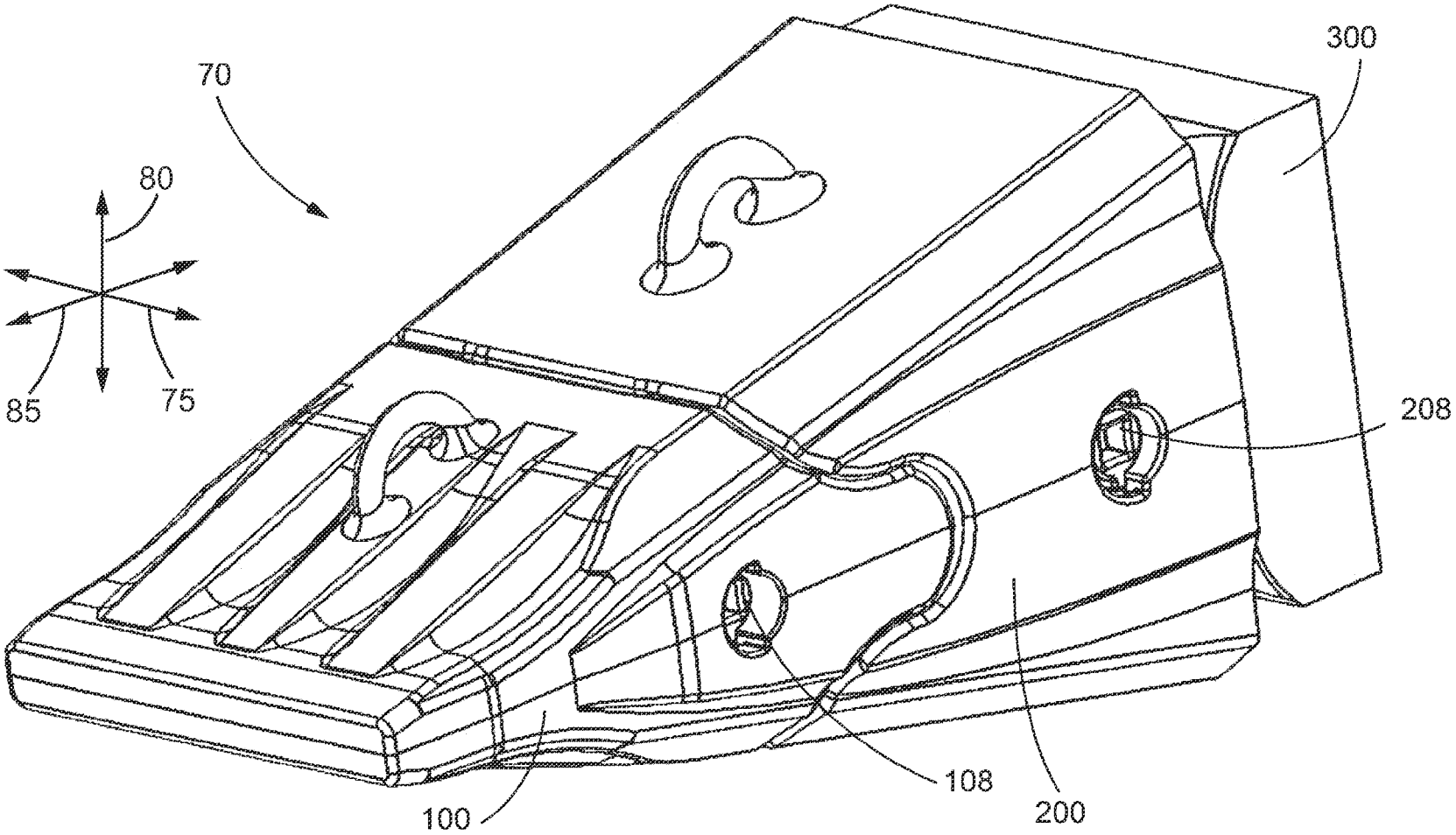
FIG. 5 is a perspective view of an embodiment of a GET assembly constructed in accordance with principles of the present disclosure.

Referring to FIG. 5, the illustrated GET assembly 70 can include a ground engaging tip 100, a coupler 200, and an implement mounting nose 300. The implement mounting nose 300 can be welded or otherwise connected to a bucket or other machine implement to which the GET assembly 70 can be attached. The coupler 200 can be pivotally connected or otherwise mounted to the implement mounting nose 300 using a first pair of retention mechanisms 208 or other suitable attachment device. The first pair of retention mechanisms 208 can be respectively disposed on opposing sides of the GET assembly 70. The ground engaging tip 100 can be pivotally connected or otherwise mounted to the coupler 200 using a similar retention mechanism, such as a second pair of retention mechanisms 108, or another suitable attachment device. The second pair of retention mechanisms 108 can be respectively disposed on opposing sides of the GET assembly 70.

Figure 31:
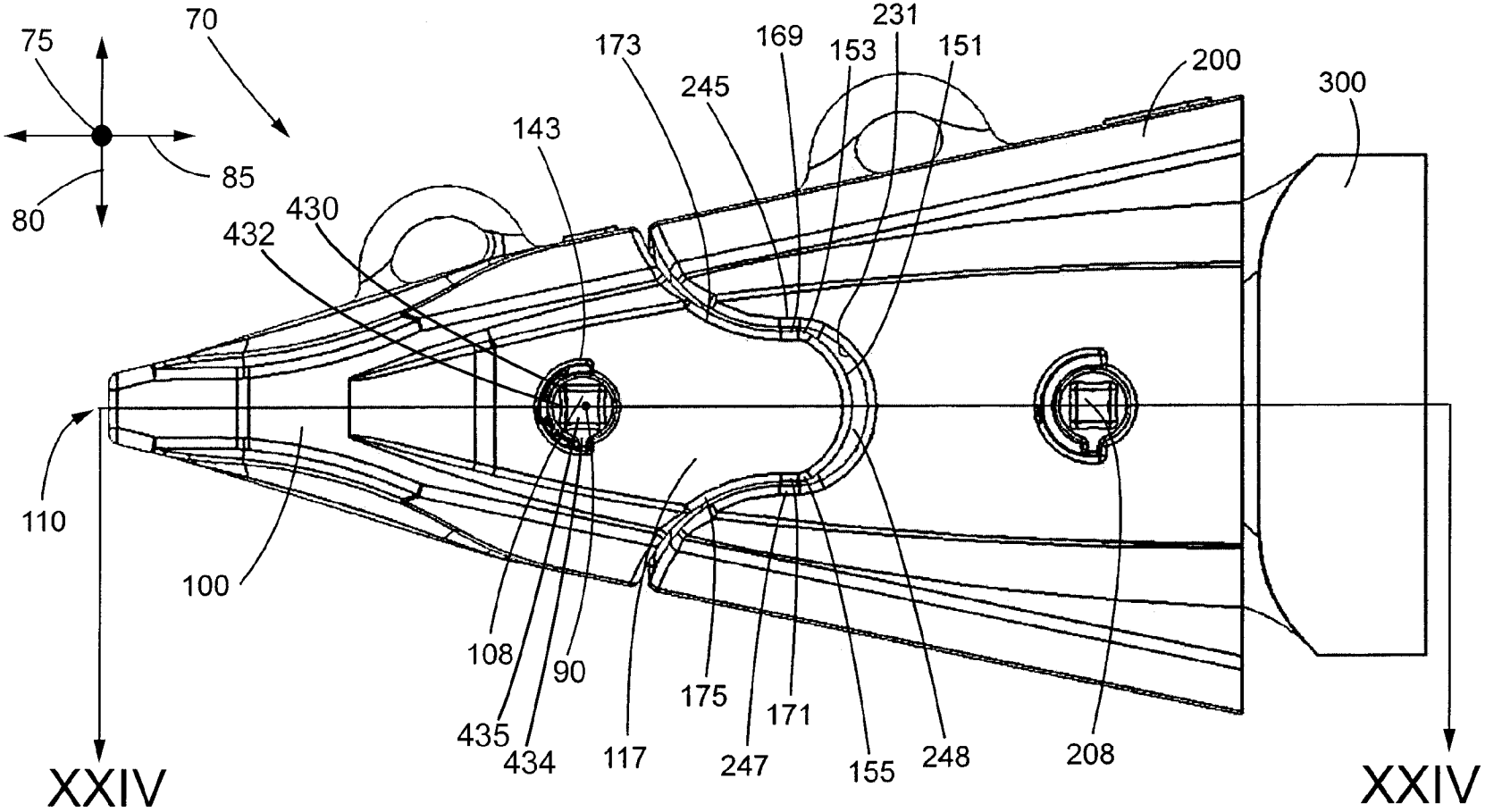
FIG. 31 is a side elevational view of the GET assembly of FIG. 5.
Figure 34:
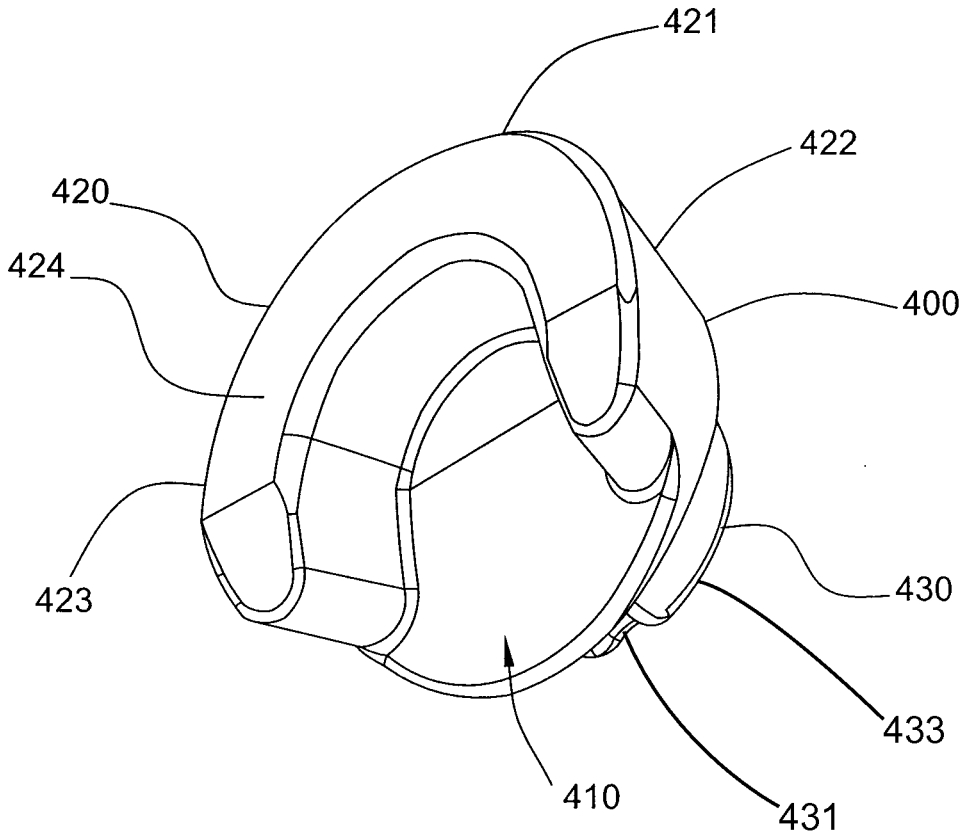
FIG. 34 is a front perspective view of a lock constructed in accordance with the present disclosure.

In some embodiments, the first and second pairs of retention mechanisms 108, 208 can be similar to the embodiment of a lock 400 illustrated in FIG. 34. The lock 400 can include a slot 410. The slot 410 can be formed in a C-shaped portion 420 of the lock 400. The C-shaped portion 420 can include a rear leg 421, a top leg 422, and a bottom leg 423. The slot 410 can be interposed between the top leg 422 and the bottom leg 423. On top of the C-shaped portion 420 can be a head portion 430. Referring to FIGS. 31 and 34, the head portion 430 can include two detents 431, 432, formed therein, and an annular surface 433 positioned between the detents 431, 432. A stopping tab 434 can also be formed in the head portion 430. The head portion 430 can also include a tool interface 435.

The first and second pairs of retention mechanisms 108, 208 can secure the components of the GET assembly 70 to one another and substantially limit the relative movement of the components with respect to one another such that the GET assembly 70 can be in a nominal position when the GET assembly 70 is not in use. When the components of the GET assembly 70 are subjected to forces, either along a lateral axis 75 or a normal axis 80—which can be perpendicular to the lateral axis 75, the first and second pairs of retention mechanisms 108, 208 can continue to secure the components to one another, but can allow the parts to rotate with respect to one another about the lateral axis 75 and/or the normal axis 80 in response to the forces to which they can be subjected. The respective component parts of the GET assembly 70 can rotate relative to one another into a maximum rotated position in which the parts can contact one another at various points, thereby restraining further relative rotational movement. The points of contact in the maximum rotated positions are discussed in further detail below.

Figure 6:
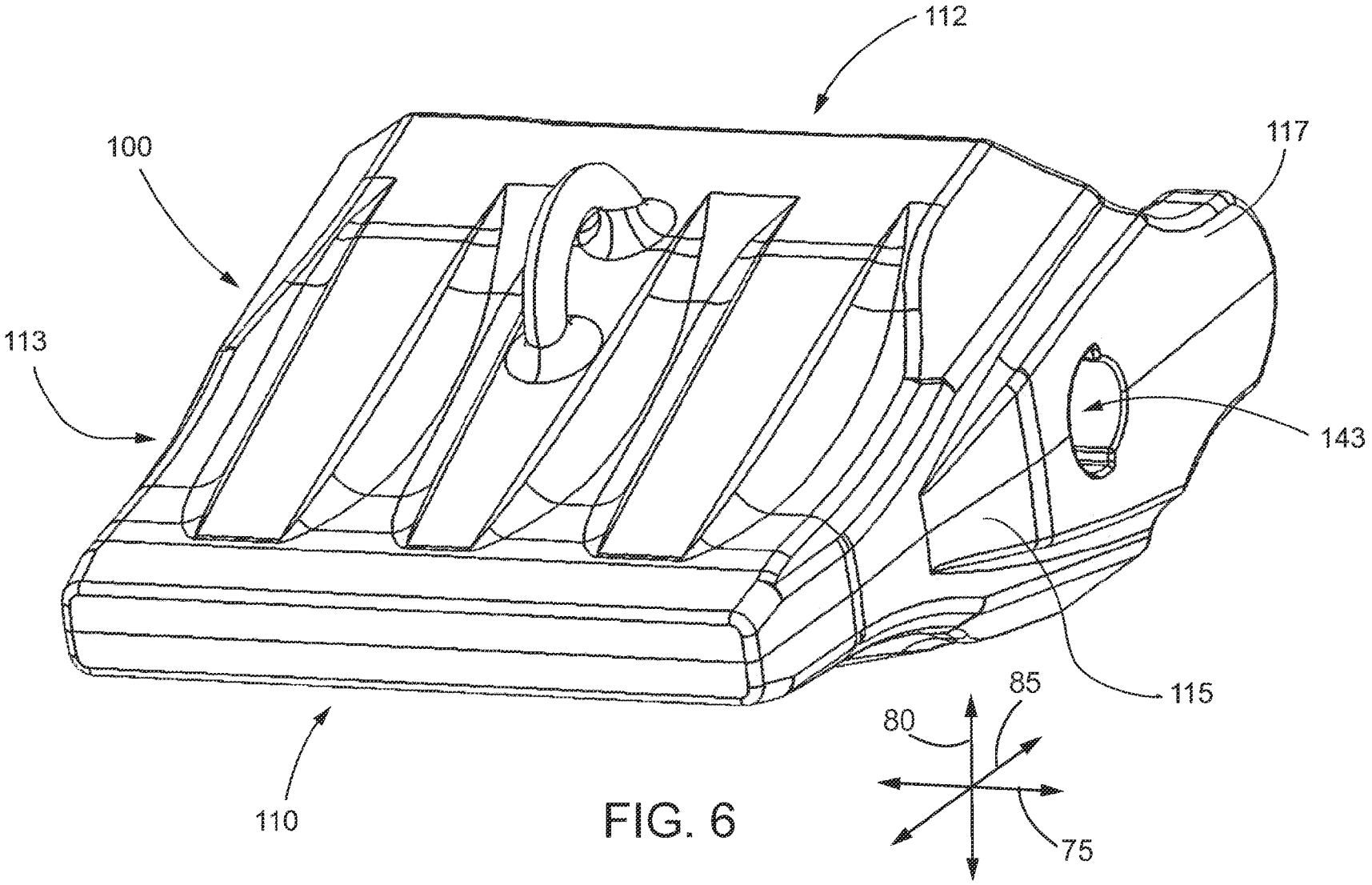
FIG. 6 is a front perspective view of a ground engaging tip of the GET assembly of FIG. 5.

FIGS. 6-12 show an embodiment of the ground engaging tip 100. Referring to FIG. 6, the illustrated ground engaging tip 100 can include a ground engaging portion 110 and a coupling portion 112. The coupling portion 112 can be in opposing relationship to the ground engaging portion 110 along a longitudinal axis 85 thereof. The longitudinal axis 85 can be perpendicular to both the normal axis 80 and the lateral axis 75, running the length of the ground engaging tip 100. Tip side walls 113, 115 can extend along the longitudinal axis 80 from the ground engaging portion 110 to the coupling portion 112. The illustrated ground engaging tip 100 can be generally wedge-shaped, the ground engaging portion 110 can be the narrowest point and can flare along the normal axis 80 in both directions moving along the longitudinal axis 85 toward the coupling portion 112.

Generally, the ground engaging portion 110 can be the part of the GET assembly 70 that first contacts the ground or other work material and can be subjected to the greatest wear. Over the course of time and repeated use, the ground engaging portion 110 can wear away. When the ground engaging portion 110 has been worn away to a certain degree, the ground engaging tip 100 can be replaced.

Figure 7:
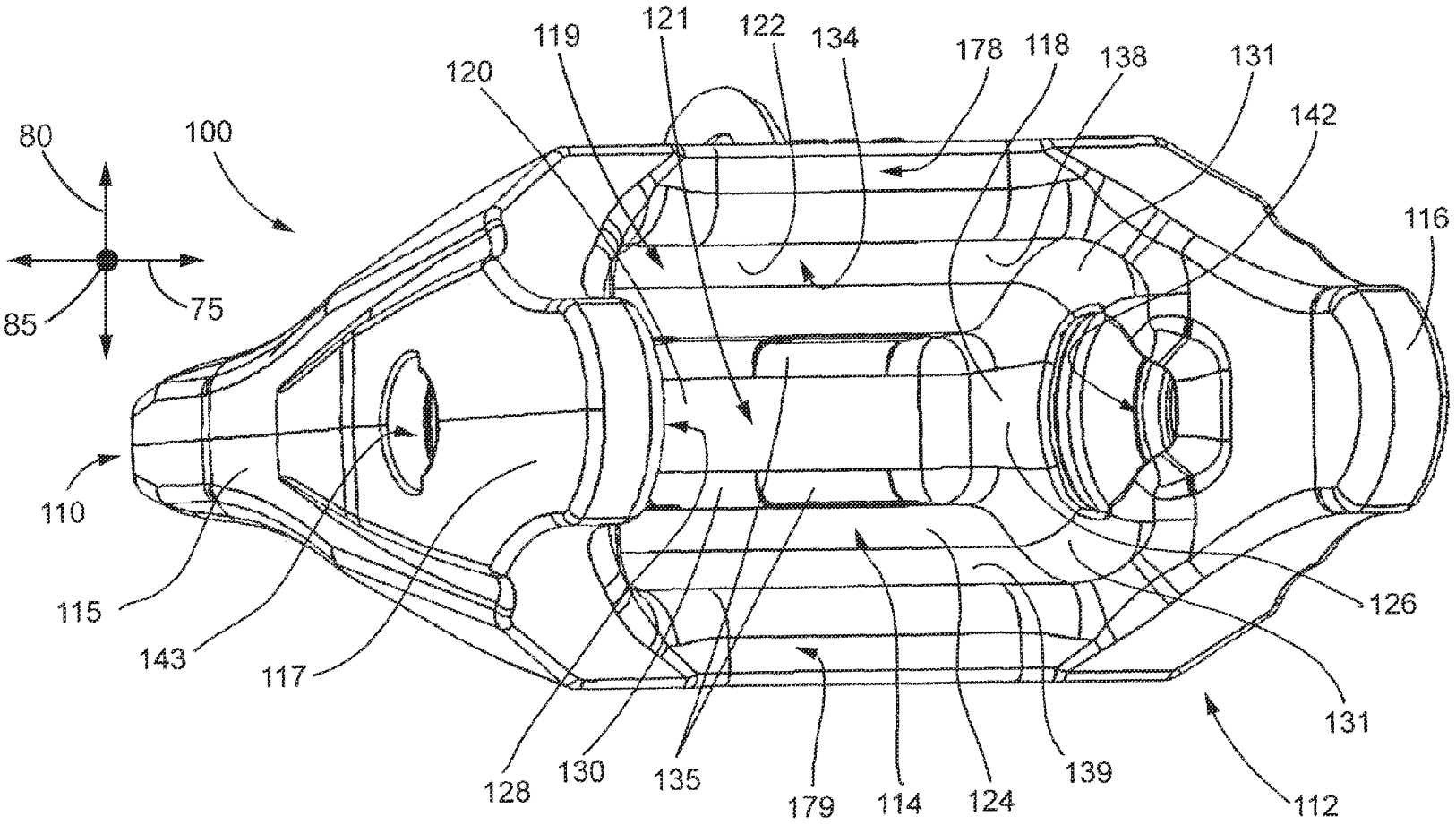
FIG. 7 is a rear perspective view of the ground engaging tip of FIG. 6.

Referring to FIG. 7, the coupling portion 112 of the ground engaging tip 100 can include a pair of interlock tabs 116, 117 and an interior surface 118. The interior surface 118 can define a coupler pocket 114 recessed within the interior of the coupler portion 112. The coupler pocket 114 can have an opening 119 in communication with an interior cavity 121. The interior surface 118 defining the coupler pocket 114 such that the coupler pocket faces a direction substantially away from the ground engaging portion 110. The interior surface 118 of the coupler pocket 114 can include a base wall 120, a first coupler face wall 122, a second coupler face wall 124, and a pair of side walls 126, 128. The base wall 120 can be generally planar and generally parallel to the opening 119 of the coupler pocket 114. The base wall 120 can face generally away from the ground engaging portion 110. The first and second coupler face walls 122, 124 and the pair of side walls 126, 128 can be all adjacent to and abut the base wall 120. The first and second coupler face walls 122, 124 each can have an interlock end 178, 179 disposed in opposing relationship to the base wall 120 along the longitudinal axis 85. The first coupler face wall 122 can be in a spaced relationship with the second coupler face wall 124 and be substantially symmetrical to the second coupler face wall. The interior surface 118 can transition from the base wall 120 to the first and second coupler face walls 122, 124, and to both side walls 126, 128 with a smooth rear fillet 130 that circumscribes a perimeter of the base wall 120.

Figure 10:
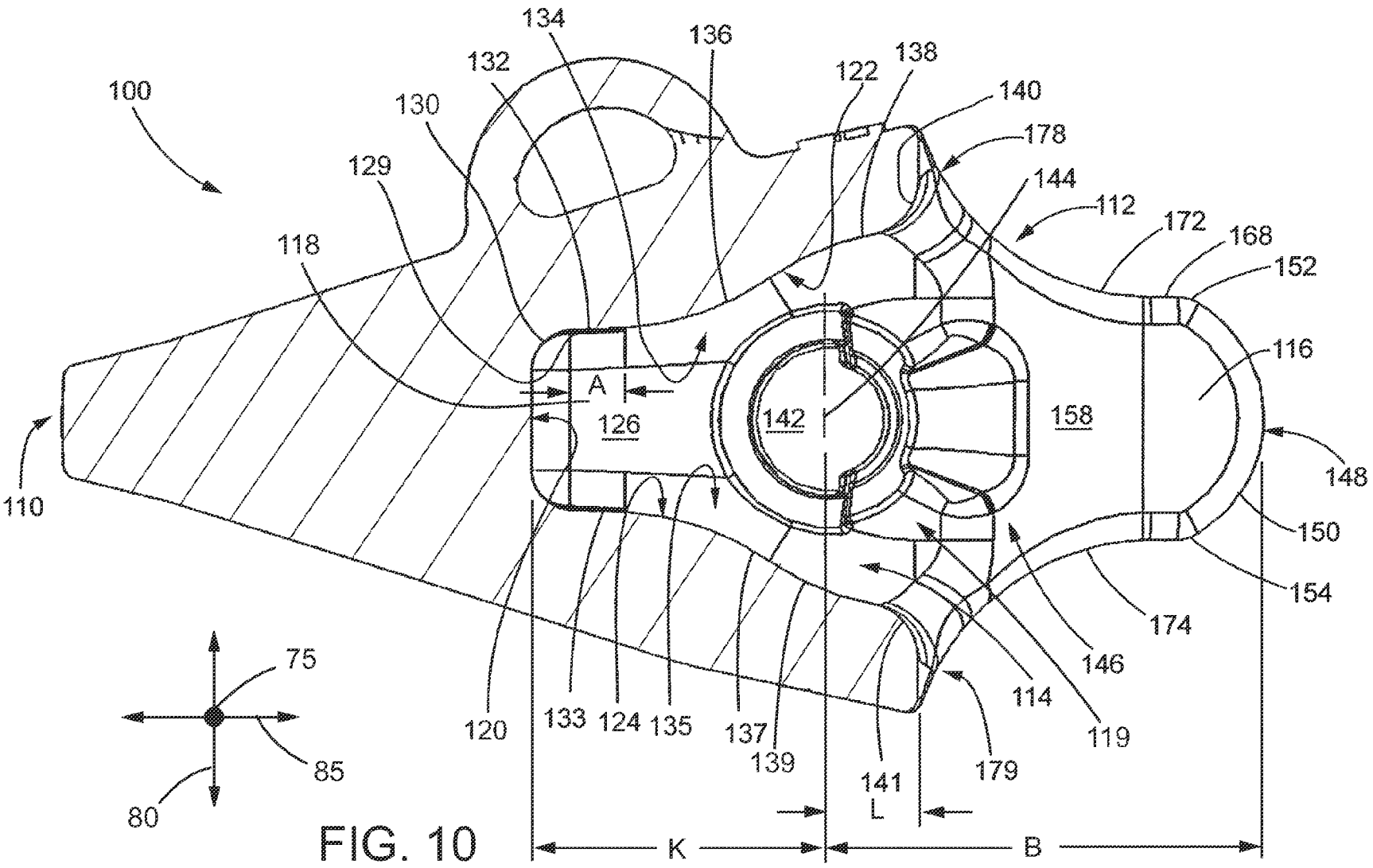
FIG. 10 is a cross-sectional view taken along line X-X in FIG. 9 of the ground engaging tip of FIG. 6.

Referring to FIG. 10, the first coupler face wall 122 and the second coupler face wall 124 extend from the base wall 120 to the opening 119 of the coupler pocket 114. The first and second coupler face walls 122, 124 can be in space relationship to one another and be substantial with respect to a plane defined by the longitudinal axis 85 and the lateral axis 75. The first and second coupler face walls 122, 124 can extend between the side walls 126, 128 from the base wall 120 away from the ground engaging portion 110 along the longitudinal axis 85 toward the opening 119. The first and second coupler face walls 122, 124 can flare away from each other in opposite directions along the normal axis 80 moving along the longitudinal axis 85 from the base wall 120 of the coupler pocket 114 to the opening 119. The first and second coupler face walls 122, 124 can each have a distal planar portion 132, 133 adjacent the base wall 120 and a curved portion 134, 135 adjacent the distal planar portion such that the distal planar portion can be disposed between the base wall and the curved portion. In some embodiments, the distal planar portions 132, 133 can include fit pads 129. Fit pads 129 can provide additional structural support to the ground engaging tip 100 and can help provide a secure fit between the ground engaging tip and the coupler 200. As shown in FIG. 7 and FIG. 10, the fit pads 129 can also cover a portion of the base wall 120.

Referring to FIG. 10, each of the curved portions 134, 135 of the first and second coupler face walls 126, 128 can be substantially S-shaped and define an ogee curve with a first convex portion 136, 137 adjacent the distal planar portion 132, 133, a concave portion 138, 139 adjacent the first convex portion, and a second convex portion 140, 141 adjacent the opening 119 of the coupler pocket 114 such that the concave portion 138, 139 can be disposed between the first convex portions 136, 137 and second convex portions 140, 141. The distal planar portion 132 and the curved portion 134 of the first coupler face wall 122 define a first coupler face wall contour profile and the distal planar portion 133 and the curved portion 135 of the second coupler face wall 124 define a second coupler face wall contour profile as viewed in section along the lateral axis 75, such as in FIG. 10.

The first convex portion 136, 137 can have a first radius of convex curvature, the second convex portion 140, 141 can have a second radius of convex curvature, and the concave portion 138, 139 can have a radius of concave curvature. The length A of the distal planar portion 132, 133 can be measured along the longitudinal axis 85 as the longitudinal distance between the rear fillets 130 adjacent the base wall 120 and the first convex portion 136, 137. In some embodiments, the first radius of convex curvature can be greater than the second radius of convex curvature. In some embodiments, a ratio of the first radius of convex curvature to the second radius of convex curvature can be at least about 2:1, and in particular embodiments can be at least about 3:1 or at least about 5:1. In some embodiments, the first radius of convex curvature can be substantially equal to the radius of concave curvature of the respective concave portion 138, 139.

In some embodiments, a ratio of the radius of concave curvature of the respective concave portions 138, 139 to the second radius of convex curvature of the respective second convex portions 140, 141 can be about 4:1 or less. In some embodiments, a ratio of the radius of concave curvature to the second radius of convex curvature can be in a range between about 3:1 and about 4:1. In a particular embodiment, the ratio of the radius of concave curvature of the concave portion 138, 139 to the second radius of convex curvature of the second convex portion 140, 141 can be about 19:4. In some embodiments, the length A of the distal planar portion 132, 133 is greater than the first radius of convex curvature of the first convex portion 136, 137. In some embodiments, a ratio of the first radius of curvature to the length A of the distal planar portion 132, 133 can be at least about 3:1. In some embodiments, a ratio of the first radius of convex curvature of the first convex portion 136, 137 to the length A of the distal planar portion 132, 133 can be in a range between about 3:1 and about 6:1, and be about 5:1 in a particular embodiment. It should be understood that the specific dimensions and ratios listed herein are merely examples of possible embodiments, and it is contemplated that any other suitable dimensions or ratios can be used.

Figure 11:
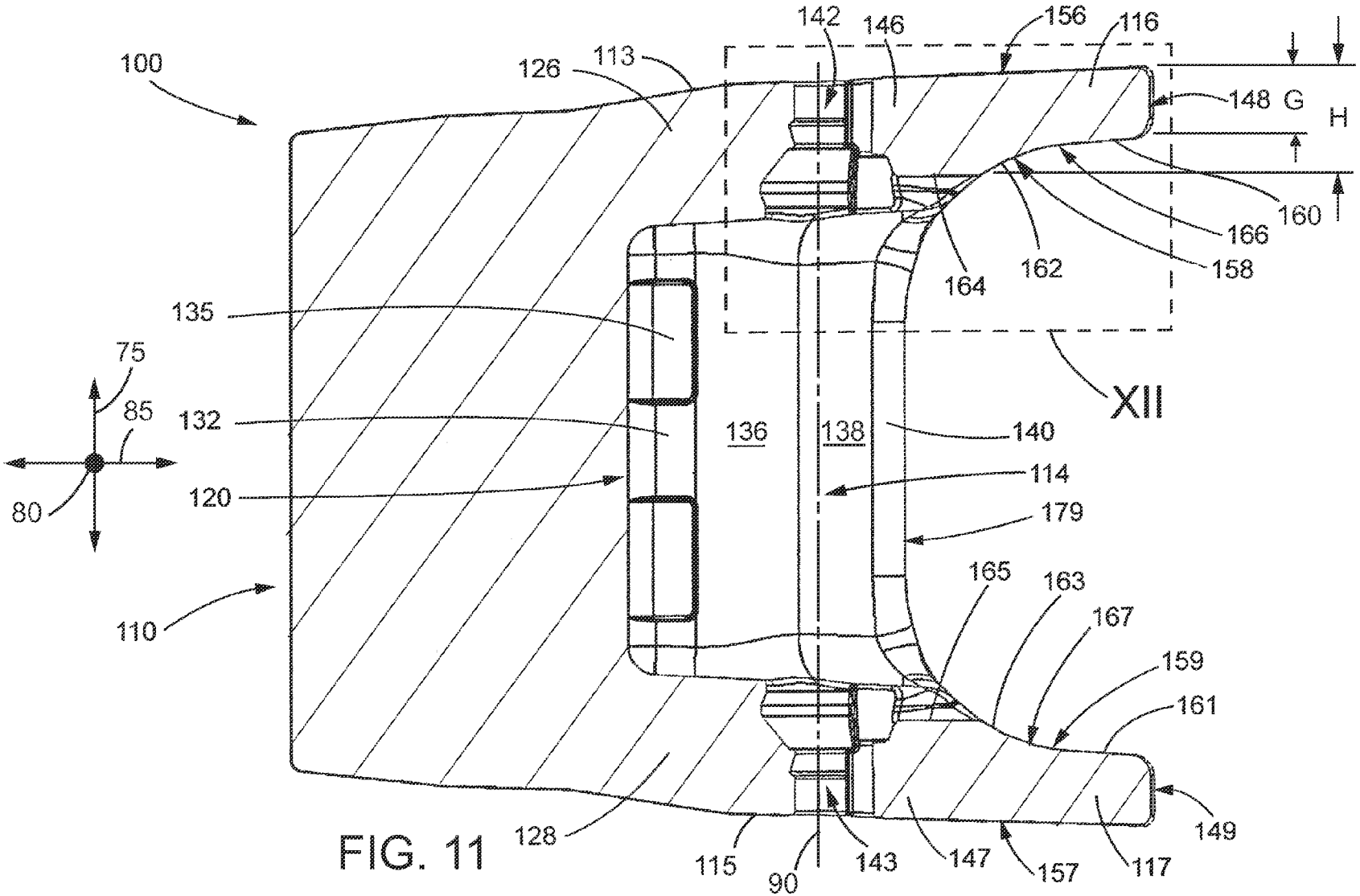
FIG. 11 is a cross-sectional view taken along line XI-XI in FIG. 8 of the ground engaging tip of FIG. 6.

Referring to FIGS. 7 and 11, the pair of side walls 126, 128 define two sides of the interior surface 118 of the coupler pocket 114. The two side walls 126, 128 can each be adjacent to the base wall 120, the first couple face wall 122, and the second coupler face wall 124, and can be in a spaced relationship and substantially parallel to each other on opposite sides of the coupler pocket 114. The side walls 126, 128 can extend from the base wall 120 to the opening 119 of the coupler pocket 114 along the longitudinal axis 85, and can have a side wall thickness measured along the lateral axis 75. The interior surface 118 can transition from the first and second coupler face walls 122, 124 to each side wall 126, 128 with a smooth wall fillet 131. The wall fillet 131 can have a shape and configuration adapted to help distribute and smooth out stresses in the walls of the ground engaging tip 100 by reducing stress concentrations.

In embodiments, the radius of the wall fillet 131 can vary throughout the coupler pocket 114. In some embodiments, the radii of the wall fillets 131 can be smallest adjacent the distal planar portions 132, 133 of the first and second coupler face walls 122, 124 and largest adjacent the concave portions 138, 139 of the first and second coupler face walls 122, 124.

In embodiments, the size of the radius of the wall fillet 131 adjacent the concave portions 138, 139 of the first and second coupler face walls 122, 124 can be dependent upon the radii of the concave portions 138, 139. In other words, as the radii of the concave portions 138, 139 of the first and second coupler face walls 122, 124 increase, the radii of the wall fillets 131 adjacent the concave portions can increase as well, thereby resulting in lower stress concentrations in those areas and maintain desired side wall 126, 128 thickness near retention orifices 142, 143. As such, the contour profiles of the first coupler face wall 122 and the second coupler face wall 124 can be adapted to maintain a desired side wall 126, 128 in an area circumscribing the retention orifices 142, 143. In embodiments, to help reduce stress concentrations in the ground engaging tip 100, the radii of the concave portions 138, 139 can each be adjusted to strike a balance between having a radius sufficiently large to help reduce stress concentrations without decreasing the overall thickness in that area to such an extent that would itself create further stress concentrations in the concave portion 138, 139 themselves.

In the area circumscribing the retention orifices 142, 143, the wall fillets 131 can have a radius of fillet curvature at a longitudinal location between the retention orifice and the concave portion 136, 137. In some embodiments, a ratio of the radius of fillet curvature of the wall fillets 131 to the radius of concave curvature of the concave portions 138, 139 can be at least about 1:8, at least about 1:6 in other embodiments, and can be at least about 1:4 in yet other embodiments. In some embodiments, a ratio of the radius of fillet curvature of the wall fillets 131 to the radius of concave curvature of the concave portions 138, 139 can be in a range between about 1:8 and about 1:3. In some embodiments, a ratio of the radius of fillet curvature of the wall fillets 131 to the radius of concave curvature of the concave portions 138, 139 can be in a range between about 1:3 to about 1:5. In some embodiments, a ratio of the radius of fillet curvature of the wall fillets 131 to the radius of concave curvature of the concave portions 138, 139 can be about 1:4.

Figure 8:
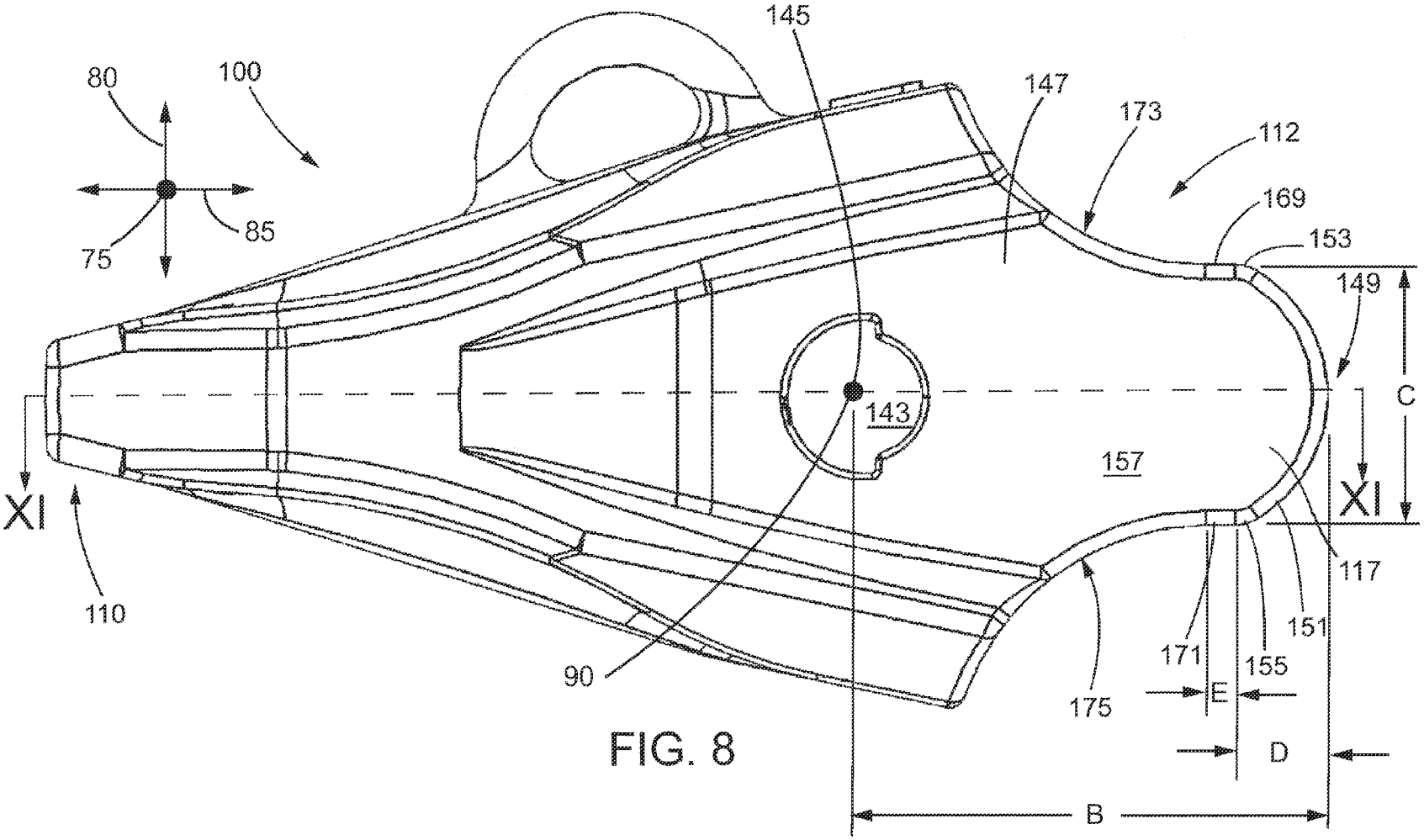
FIG. 8 is a side elevational view of the ground engaging tip of FIG. 6.
Figure 9:
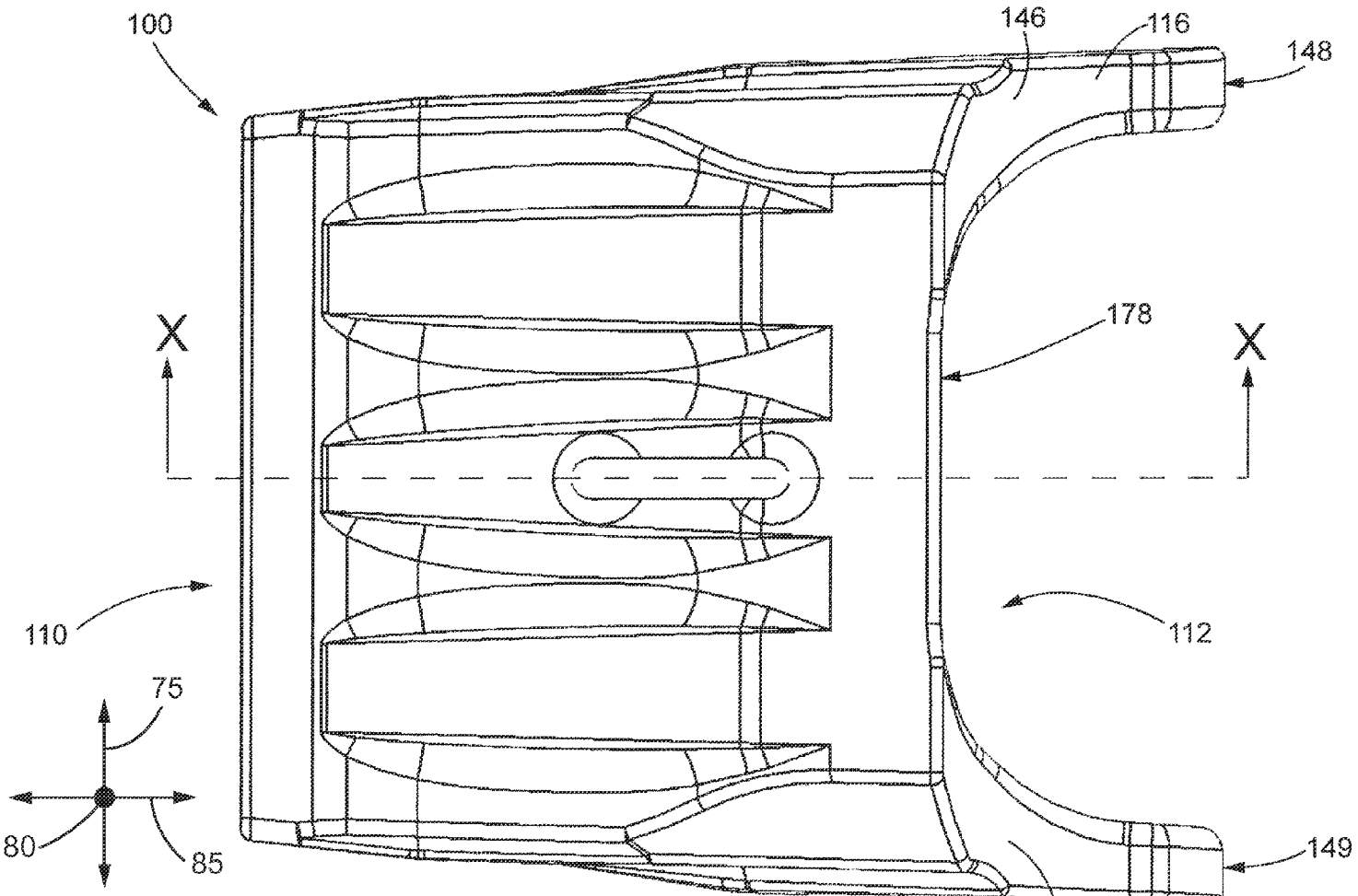
FIG. 9 is a top plan view of the ground engaging tip of FIG. 6.

Referring to FIGS. 8-9, the interlock tabs 116, 117 on the coupling portion 112 of the ground engaging tip 100 can each have a base end 146, 147 and a proximal end 148, 149. The base ends 146, 147 of the interlock tabs 116, 117 can be contiguous with the side walls 126, 128. The interlock tabs 116, 117 can extend from the base ends 146, 147 along the longitudinal axis 85 substantially parallel to one another in a direction substantially away from the ground engaging portion 110 and can terminate at the proximal ends 148, 149. The base ends 146, 147 can be in opposing relationship to the proximal ends 148, 149 along the longitudinal axis 85.

In some embodiments, the proximal ends 148, 149 of the interlock tabs 116, 117 can include a perimeter with a curved terminal edge 150, 151. Using a curved terminal edge 150, 151 on the end of the interlock tabs 116, 117, as opposed to flat edges that can have sharp corners, can help distribute stresses encountered by the ground engaging tip 100 and reduce stress concentration points. In the illustrated embodiments, the curved terminal edge 150, 151 can have a constant radius of curvature between a first transition surface 152, 153 and a second transition surface 154, 155. In some embodiments, the first transition surface 152, 153 and the second transition surface 154, 155 can be convex surfaces with a radius of curvature that is larger than the radius of curvature of the curved terminal edge 150, 151. The radius of curvature of the curved terminal edge 150, 151 can vary while still providing the stress distribution advantages referenced above. In some embodiments, the coupling portion 112 can include a single interlock tab 116, 117 extending in a direction substantially away from the ground engaging portion 110 to the proximal end 148, 149, wherein the proximal end includes a perimeter with a curved terminal edge 150, 151.

The interlock tabs 116, 117 can each have a first tab contact surface 168, 169 and a second tab contact surface 170, 171 in spaced relationship to each other. In some embodiments, the first tab contact surface 168, 169 and the second tab contact surface 170, 171 can be adjacent the curved terminal edge 150, 151. In other embodiments, the first tab contact surface 168, 169 and the second tab contact surface 170, 171 can be adjacent the first transition surfaces 152, 153 and second transition surfaces 154, 155, respectively. The interlock tabs 116, 117 can also each have an first concave surface 172, 173 and a second concave surface 174, 175 adjacent the first tab contact surface 168, 169 and the second tab contact surface 170, 171, respectively.

In embodiments, each sidewall 126, 128 can further define a retention orifice 142, 143 that can respectively house the second pair of retention mechanisms 108. The retention orifices 142, 143 can be generally cylindrical and define a orifice center 144, 145, as shown in FIG. 8 and FIG. 10. A retention axis 90 can be defined along the lateral axis 75, the retention axis defined on an axis between the centers 144, 145 of the retention orifices 142, 143. In some embodiments, the retention orifices 142, 143 can be defined in each sidewall 126, 128 of the ground engaging tip 100 substantially longitudinally midway between the proximal ends 148, 149 of each interlock tab 116, 117 and the base wall 120 of the interior surface 118 of the coupler pocket 114.

In some embodiments, the base wall 120 and at least one side wall 126, 128 can at least partially define the coupler pocket 114. At least one interlock tab 116, 117 can extend from the side wall 126, 128 to a proximal end 148, 149 in a direction substantially away from the base wall 120. In such embodiments, the side wall 126, 128 can define the retention orifice 142, 143 disposed substantially longitudinally midway between the proximal end 148, 149 of the interlock tab 116, 117 and the base wall 120.

As shown in FIG. 8, a longitudinal distance B can be measured along the longitudinal axis 85 between each orifice center 144, 145 and the proximal ends 148, 149 of each respective interlock tab 116, 117. The curved terminal edge 150, 151 of each proximal end 148, 149 of the interlock tabs 116, 117 can have a radius of terminal edge curvature. In some embodiments, a ratio of the longitudinal distance B, measured along the longitudinal axis 85, between each orifice center 144, 145 and the proximal ends 148, 149 of each respective interlock tab 116, 117 to the radius of terminal curvature of the curved terminal edges 150, 151 of each respective interlock tab can be about 2:1 or more. In some embodiments, a ratio of the longitudinal distance B to the radius of terminal curvature of the curved terminal edges 150, 151 of each respective interlock tab can range from about 2:1 to about 4:1. In some embodiments, a ratio of the longitudinal distance B between each orifice center 144, 145 and the proximal ends 148, 149 of each respective interlock tab 116, 117 to the radius of terminal curvature of the curved terminal edges 150, 151 of each respective interlock tab can range from about 3:1 to about 4:1. In a particular embodiment, the ratio of the longitudinal distance B between each orifice center 144, 145 and the proximal ends 148, 149 of each respective interlock tab 116, 117 to the radius of terminal curvature of the curved terminal edges 150, 151 of each respective interlock tab can be about 17:5.

A normal distance C can be measured along the normal axis 80 between each first tab contact surface 168, 169 and each second tab contact surface 170, 171. In some embodiments, a ratio of the radius of terminal curvature of each curved terminal edge 150, 151 and the normal distance C, measured along the normal axis 80, between each first tab contact surface 168, 169 and each second tab contact surface 170, 171, can be in a range from about 1:2 to about 1:1, and in a range from about 1:2 to about 3:4 in still other embodiments. In a particular embodiment, the ratio of the radius of terminal curvature of each curved terminal edge 150, 151 and the normal distance C between each first tab contact surface 168, 169 and each second tab contact surface 170, 171 can be about 5:8. In some embodiments, a ratio of the radius of curvature of both the first concave surface 172, 173 and the second concave surface 174, 175 of each interlock tab 116, 117 to the radius of terminal curvature of each curved terminal edge 150, 151 can be about 7:5.

Figure 12:
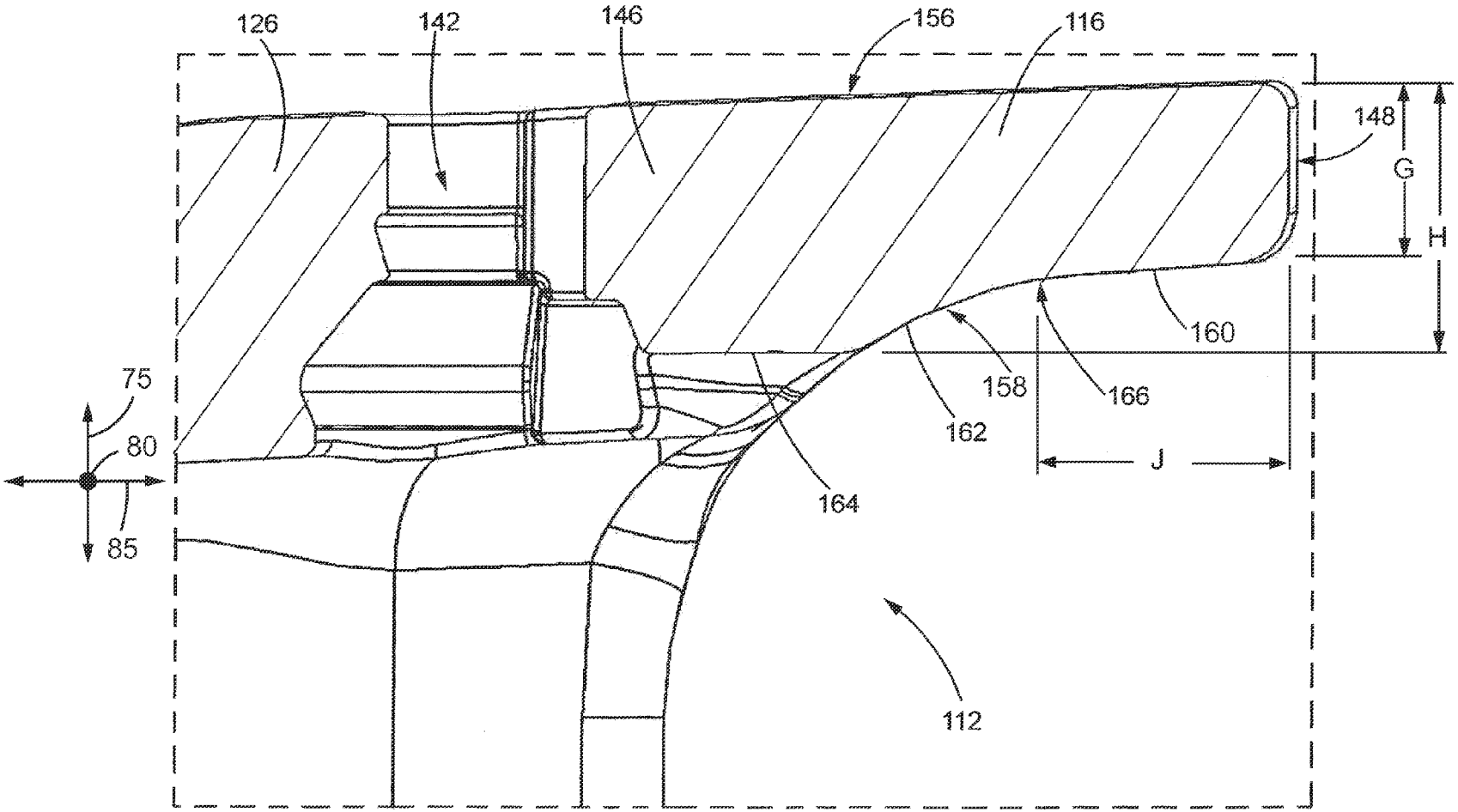
FIG. 12 is an enlarged, detail view taken from FIG. 11 as indicated by rectangle XII.

Referring to FIG. 8, a longitudinal distance D can be measured along the longitudinal axis 85 between the proximal end 148, 149 of each interlock tab 116, 117 and a point where each first tab contact surface 168, 169 meets each respective first and second transition surfaces 152, 153, 154, 155. Referring to FIGS. 11 and 12, each interlock tab 116, 117 can have an outer lateral surface 156, 157 and an inner lateral surface 158, 159. The inner lateral surface 158, 159 of each interlock tab 116, 117 can have a proximal planar portion 160, 161, a concave portion 162, 163, and a planar base portion 164, 165. The proximal planar portion 160, 161 and the outer lateral surface 156, 157 can both be adjacent to the proximal end 148, 149 of each interlock tab 116, 117. A width G of each proximal end 148, 149 can be measured along the lateral axis 75 between each respective proximal planar portion 160, 161 and each respective outer lateral surface 156, 157. Each planar base portion 164, 165 can be defined by the base end 146, 147 of each interlock tab 116, 117. The width H of the base end 146, 147 of each interlock tab 116, 117 can be measured along the lateral axis 75 between the planar base portion 164, 165 of each respective inner lateral surface 158, 159 and each respective outer lateral surface 156, 167 of each interlock tab. The concave portion 162, 163 of each inner lateral surface 158, 159 can be interposed between and adjacent each respective planar base portion 164, 165 and proximal planar portion 160, 161 to provide a smooth, contoured transition between the planar base portion 164, 165 and the proximal planar portion 160, 161. A tab transition point 166, 167 can be defined at the point of tangency on each inner lateral surface 158, 159 where the concave portion 162, 163 meets the proximal planar portion 160, 161. The length J, shown in FIG. 12, of the proximal planar portion 160, 161 can be measured between the proximal end 148, 149 of each interlock tab 116, 117 to the tab transition point 166, 167 where the proximal planar portion meets the concave portion 162, 163.

In some embodiments, the radius of curvature of the concave portion 162, 163 of the inner lateral surface 158, 159 can be greater than the width G of the proximal end 148, 149. In other embodiments, the ratio of the radius of curvature of the concave portion 162, 163 to the width G of the proximal end 148, 149 can be at least about 3:2. In other embodiments, the ratio of the radius of curvature of the concave portion 162, 163 to the width H of the base end 146, 147 can be at least about 1:1. In other embodiments, the ratio of the radius of curvature of the concave portion 162, 163 to the width H of the base end 146, 147 can be in a range between about 1:1 and about 3:1. In a particular embodiment, the ratio of the radius of curvature of the concave portion 162, 163 and the width G of the base end 146, 147 can be about 6:5.

In embodiments, a ratio between the radius of curvature of the concave portion to the length J of the proximal planar portion 160, 161, measured between the proximal end 148, 149 and the tab transition point 166, 167 can be at least about 1:2. In another embodiment, the ratio between the radius of curvature of the concave portion 162, 163 to the length J of the proximal planar portion 160, 161 can be about 3:4.

In some embodiments, the width H of the base end 146, 147 can be greater than the width G of the proximal end 148, 149 of the interlock tab 116, 117, and the radius of curvature of the concave portion 162, 163 can be greater than the width H of the base end. In some embodiments, a ratio between the width H of the base end 146, 147 and the width G of the proximal end 148, 149 can be in a range between about 1:1 and about 2:1, and at least about 4:3 in a particular embodiment. It is contemplated, however, that other suitable dimensions and ratios may be used in other embodiments.

Referring to FIG. 10, a longitudinal distance K can be measured along the longitudinal axis 85 from the center 144, 145 of the retention orifice 142, 143 to the base wall 120 of the interior surface 118. A longitudinal distance B can be measured along the longitudinal axis 85 from the center 144, 145 of the retention orifice 142, 143 to the proximal end 148, 149 of the interlock tab 116, 117. In some embodiments, a ratio of the longitudinal distance K from the center of each retention orifice 142, 143 to the base wall 120 and the longitudinal distance B from the center of each retention orifice to the proximal end of each respective interlock tab can be about 3:2 or less. In some embodiments, a ratio of the longitudinal distance K and the longitudinal distance B can be in a range between about 1:2 and about 3:2. In other embodiments, a ratio of the longitudinal distance K from and the longitudinal distance B can be in a range between about 1:1 to about 1:3, and can be in a range between about 1:1 to about 1:2 in other embodiments.

In other embodiments, a ratio of the longitudinal distance between the orifice center 144, 145 of each retention orifice 142, 143 to the interlock ends 178, 179 of the first and second coupler face walls 122, 124 to the longitudinal distance between the orifice center of each retention orifice to the base wall 120 can be about 1:2. In some embodiments, the ratio of the longitudinal distance from the center of each retention orifice 142, 143 to the base wall 120 and the longitudinal distance from the center of each retention orifice to the proximal end 148, 149 of the interlock tab 116, 117 can be at most about 3:4.

In some embodiments, the longitudinal distance B can be greater than the radius of terminal edge curvature of the curved terminal edge 150, 151 of the proximal end 148, 149. In some embodiments, a ratio of the longitudinal distance B and the radius of terminal edge curvature of the curved terminal edge 150, 151 of the proximal 148, 149 end can be at least about 5:2. In some embodiments, a ratio of the longitudinal distance B and the radius of terminal edge curvature of the curved terminal edge 150, 151 of the proximal end 148, 149 can be in a range between about 2:1 and about 4:1. In a particular embodiment, a ratio of the longitudinal distance B and the radius of terminal edge curvature of the curved terminal edge 150, 151 of the proximal end 148, 149 can be about 14:5.

The longitudinal distance L can be measured along the longitudinal axis 85 between the center 144, 145 of each retention orifice 143, 143 and the interlock ends 178, 179 of the first coupler face wall and the second coupler face wall. In embodiments, a ratio of the longitudinal distance B, measured along the longitudinal axis 85 between the center 144, 145 of each retention orifice 142, 143 and the respective proximal ends 148, 149 of each interlock tab 116, 117, and the longitudinal distance L, measured along the longitudinal axis 85 between the center of each retention orifice 142, 143 and the respective interlock ends 178, 179 of the first and second coupler face walls 122, 124, can be in a range from about 3:1 to about 5:1. In other embodiments, a ratio of the longitudinal distance B, measured along the longitudinal axis 85 between the center of each retention orifice 142, 143 and the respective proximal ends 148, 149 of each interlock tab 116, 117, to the longitudinal distance L, measured along a longitudinal axis 85 between the center 144, 145 of each retention orifice 142, 143 and the respective interlock ends 178, 179 of the first and second coupler face walls 122, 124, can be in a range from about 4:1 to about 5:1. In a particular embodiment, the ratio of the longitudinal distance B to the longitudinal distance L can be about 14:3.

Positioning the retention orifices 142, 143 as described herein may provide advantages to the overall design of the GET assembly 70. As shown in FIG. 11, the second pair of retention mechanisms 108 can occupy a substantial amount of space between the tip side walls 113, 115 and the interior surface 118 of the coupler pocket 114. If, instead, the retention orifices 142, 143 were positioned nearer the proximal ends 148, 149 of the interlock tabs 116, 117, the overall width of the ground engaging tip 100 would likely need to be increased to accommodate retention mechanisms. Increasing the width of the ground engaging tip can be undesirable because a wider ground engaging tip may increase the weight of both the ground engaging tip and the GET assembly as a whole. Additionally, as the ground engaging tip becomes wider it can be less effective for digging into dirt, gravel, or any other work material for which the GET assembly can be used. Conversely, positioning the retention orifices 142, 143 nearer to the ground engaging portion 110 of the ground engaging tip 100 could potentially expose the second pair of retention mechanisms 108 to damage. As the ground engaging tip 100 can be used for a given application, it can eventually wear away to a condition in which very little, if any, part material remains between the ground engaging portion and the coupler pocket 114. If that occurs before an operator or other user notices in time to replace the ground engaging tip, the second pair of retention mechanisms 108 can be exposed to the work material and sustain unwanted damage. Therefore, positioning the retention orifices 142, 143 substantially as disclosed herein can help provide multiple advantages.

Figure 13:
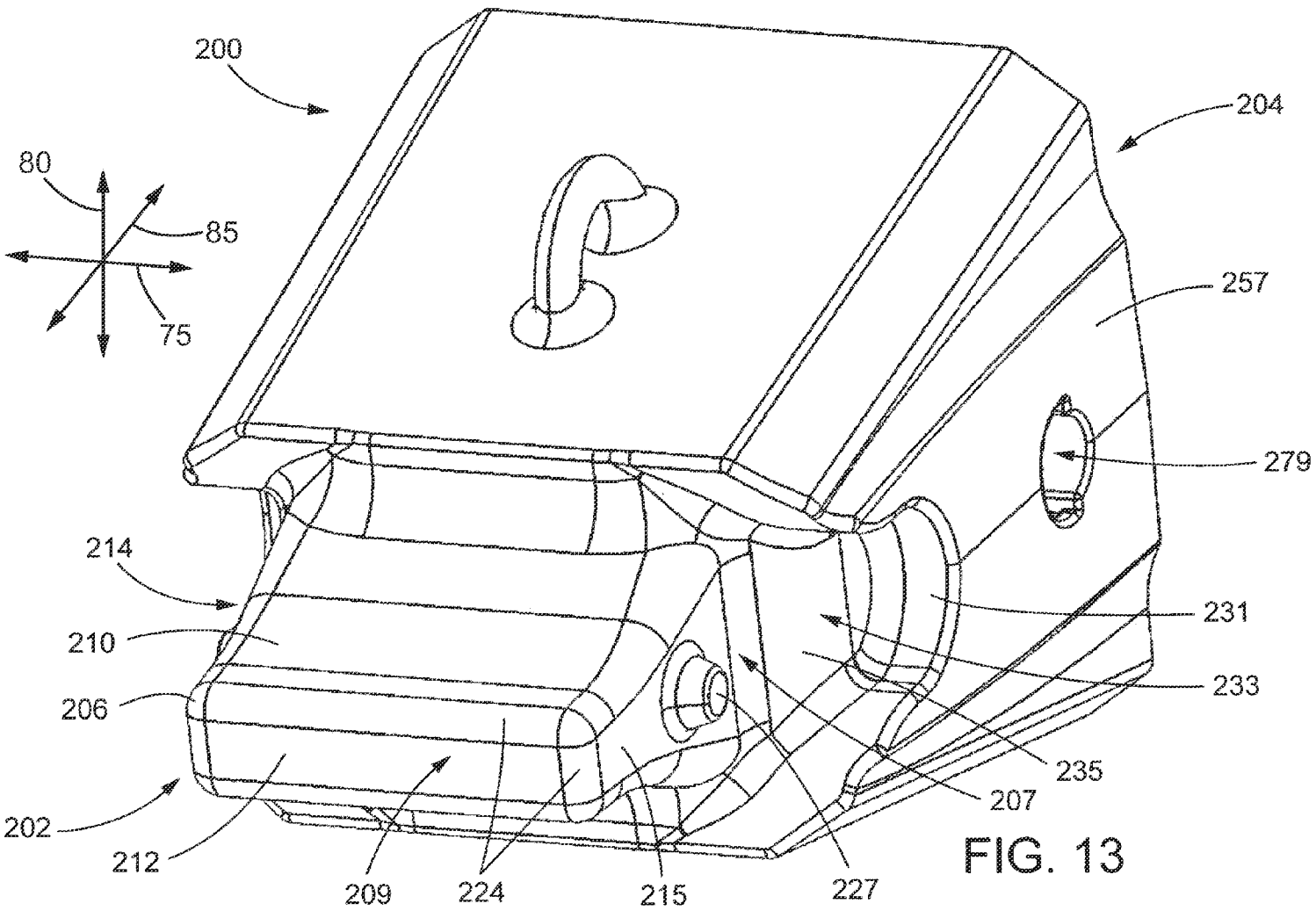
FIG. 13 is a front perspective view of a coupler of the GET assembly of FIG. 5.

FIGS. 13-20 show an embodiment of the coupler 200. Referring to FIGS. 13, the coupler 200 can include a tip mounting portion 202 and an implement mounting portion 204. The implement mounting portion 204 can be in opposing relationship to the tip mounting portion 202 along a longitudinal axis 85. The tip mounting portion 202 can be adapted to engage with the ground engaging tip 100, and the implement mounting portion 204 can be adapted to engage with the implement mounting nose 300. The illustrated coupler 200 can be generally wedge-shaped, tapering from the implement mounting portion 204 down to the tip mounting portion 202. The tip mounting portion 202 can have a mounting nose 206. The mounting nose 206 can also be generally wedge-shaped, flaring outwardly along the normal axis 80 from a blunt end 209 moving along the longitudinal axis 85 toward a base end 207. The mounting nose 206 can include a first exterior face surface 210, a second exterior face surface 211, a distal exterior surface 212, and two side surfaces 214, 215. The side surfaces 214, 215 can each include a retention boss 226, 227. In some embodiments, the second pair of retention mechanisms 108 can fit into the retention orifices 142, 143 of the ground engaging tip 100 and engage with the retention bosses 226, 227 to pivotally secure the ground engaging tip to the coupler 200.

Figure 16:
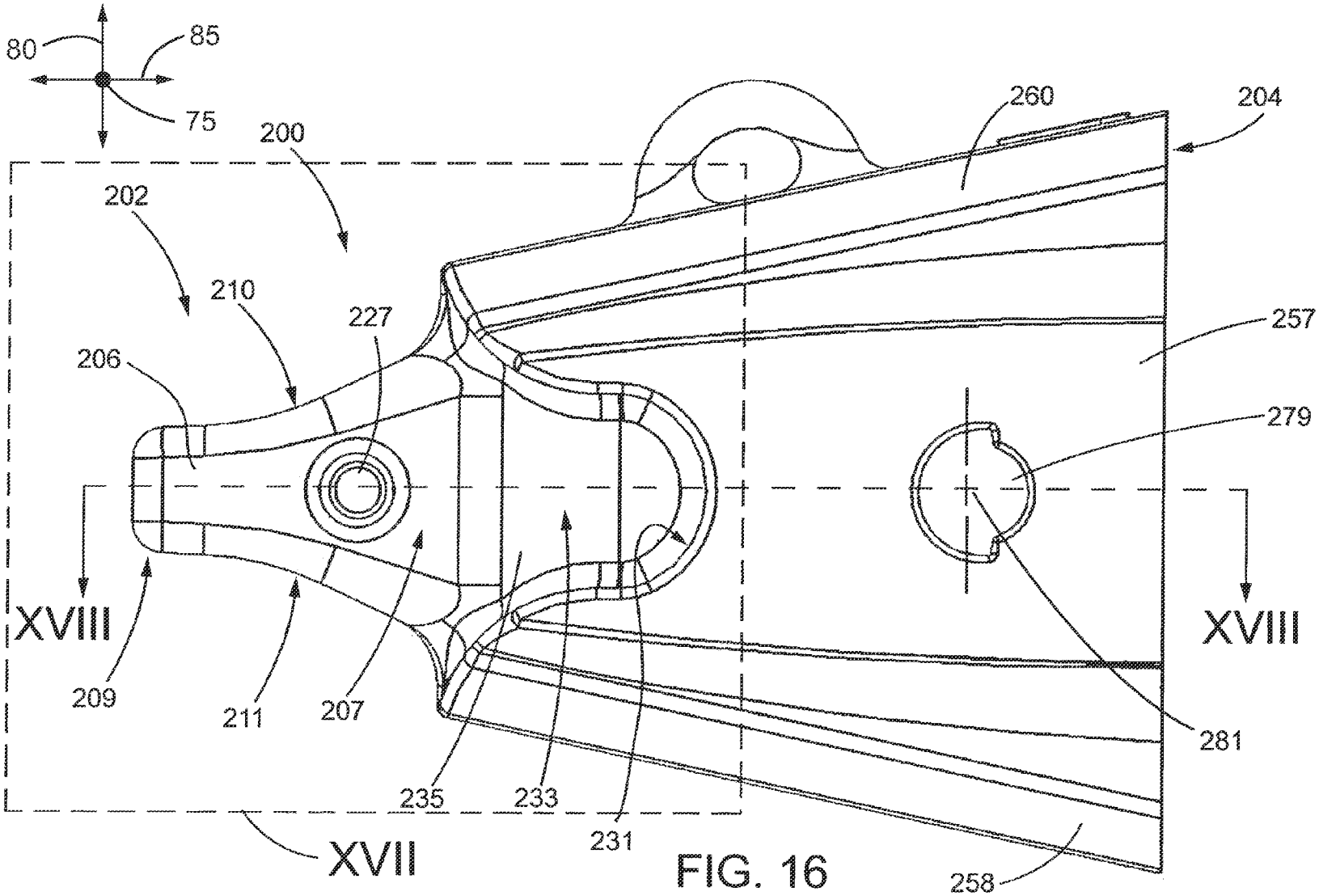
FIG. 16 is a side elevational view of the coupler of FIG. 13.
Figure 17:
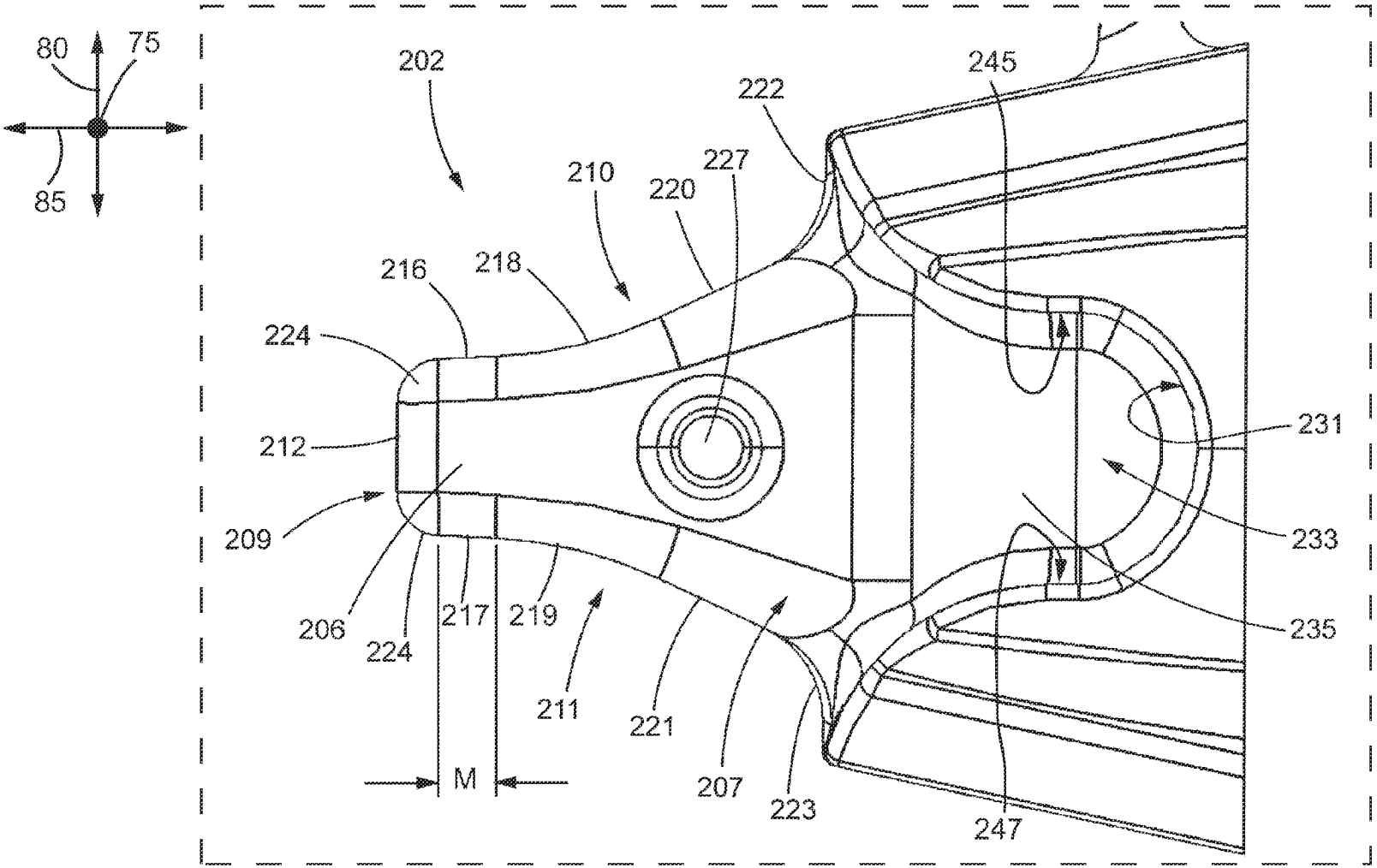
FIG. 17 is an enlarged, fragmentary side view of the coupler of FIG. 13, illustrating a tip mounting portion thereof

As shown in FIGS. 16, the second exterior face surface 211 can be in opposing relationship to the first exterior face surface 210. The first and second exterior face surfaces 210, 211 can be substantially symmetrical to one another about the plane defined by the longitudinal axis 85 and the lateral axis 75. The first and second exterior face surfaces 210, 211 can each define a contour profile as viewed along the lateral axis 75, such as in FIG. 16. The first exterior face surface 210 can define a first face contour profile, and the second exterior face surface 211 can define a second face contour profile. Referring to FIG. 17, the contour profiles of the first and second exterior face surfaces 210, 211 can each include a first planar nose portion 216, 217, a first concave nose portion 218, 219 respectively adjacent to the first planar nose portion, a second planar nose portion 220, 221 respectively adjacent to the first concave nose portion, and a second concave nose portion 222, 223 respectively adjacent to the second planar nose portion. The distal exterior surface 212 can extend between the first exterior face surface 210 and the second exterior face surface 211. The distal exterior surface 212 can provide a wall substantially perpendicular to both the first planar nose portions 216, 217 of each of the first and second exterior face surfaces 210, 211 and the side surfaces 214, 215 of the mounting nose 206. In some embodiments, curved edges 224 can surround the distal exterior surface 212 and can form smooth transitions between the distal exterior surface, the first and second exterior face surfaces 210, 211, and the side surfaces 214, 215.

The first and second face contour profiles of the first and second exterior face surfaces 210, 211 can have specific dimensions, though it is contemplated that any other suitable dimensions can be used. The first concave nose portion 218, 219 can have a first radius of concave nose curvature, and the second concave nose portion 222, 223 can have a second radius of concave nose curvature. In some embodiments, the first radius of concave nose curvature of the first concave nose portion 218, 219 can be greater than the first radius of concave nose curvature of the second concave nose portion 222, 223. In some embodiments, a ratio of the first radius of concave nose curvature to the second radius of concave nose curvature can be at least about 2:1, and at least about 3:1 in other embodiments. In a particular embodiment, the ratio of the first radius of concave nose curvature to the second radius of concave nose curvature can be about 30:7.

As shown in FIG. 17, the first planar nose portion 216, 217 can have a length M measured along the longitudinal axis 85 from the curved edges 224 of the mounting nose 206 to the first concave nose portion 218, 219. In some embodiments, a ratio of the length M of the first planar nose portion 216, 217 to the first radius of concave nose curvature of the first concave nose portion 218, 219 can be in a range between about 1:8 and about 1:4, and between about 1:7 and about 1:5 in other embodiments. In a particular embodiment, the ratio of the length M of the first planar nose portion 216, 217 to the first radius of concave nose curvature of the first concave nose portion 218, 219 can be about 2:15.

Referring to FIG. 17, the coupler 200 can include a pair of curved interlock collars 230, 231 respectively disposed on each side of the coupler 200. The interlock collars 230, 231 define a pair of interlock recesses 232, 233 adjacent the mounting nose 206. The coupler 200 also can include contact surfaces adjacent either end of each interlock collar 230, 231. A first interlock contact surface 244, 245 can be adjacent the top of each interlock collar 230, 231, and a second interlock contact surface 246, 247 can be adjacent the bottom of each interlock collar. The first interlock contact surface 244, 245 can be in spaced relationship to the second interlock contact surface 246, 247 along the normal axis 80 and substantially longitudinally aligned with respect to each other.

Figure 18:
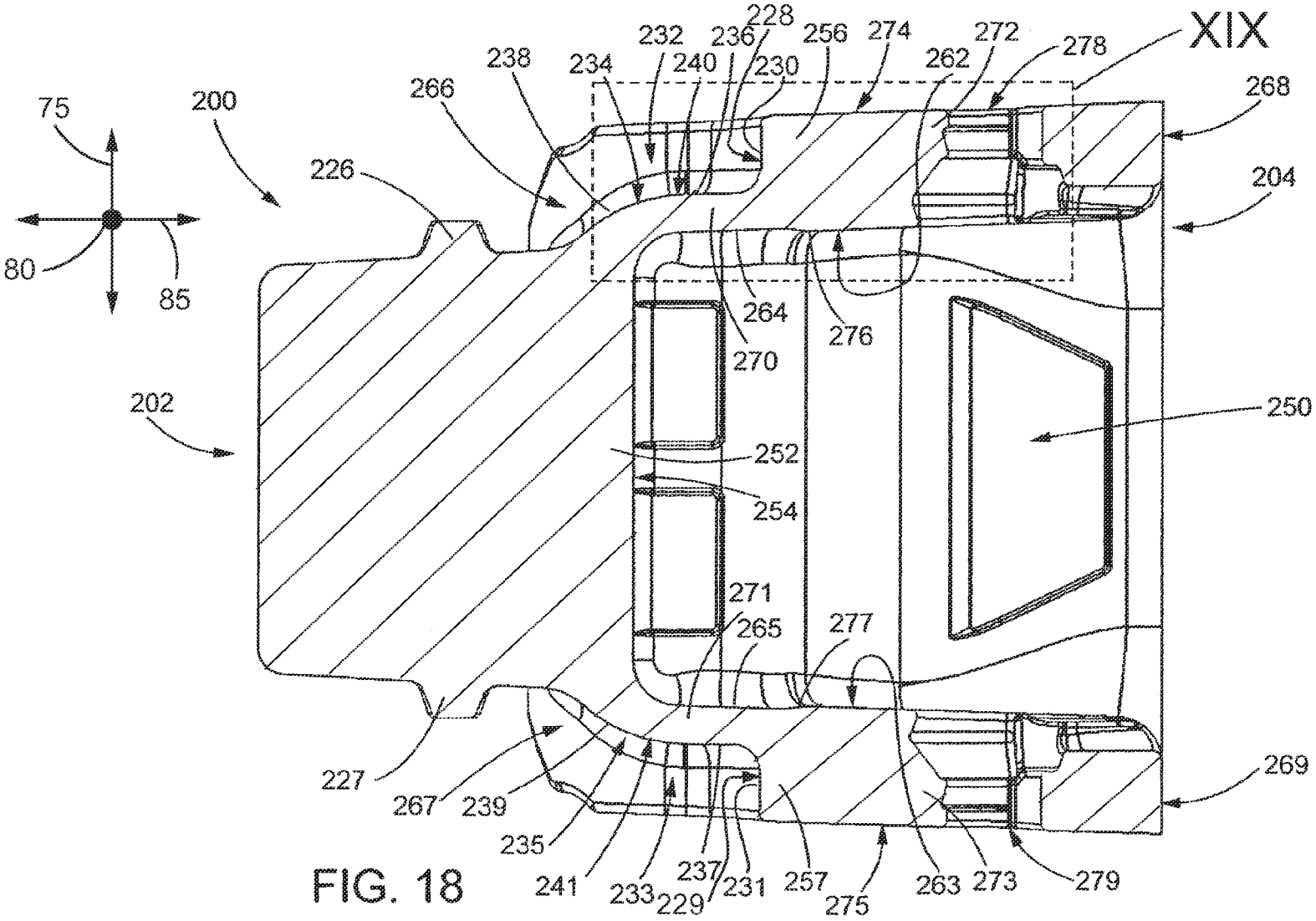
FIG. 18 is a cross-sectional view taken along line XVIII-XVIII in FIG. 16 of the coupler of FIG. 13.

Referring to FIG. 18, the interlock recesses 232, 233 can each be partially defined by an interlock exterior recess surface 234, 235 adjacent the side surfaces 214, 215 of the mounting nose 206 as well as the interlock collars 230, 231. The interlock exterior recess surfaces 234, 235 of each interlock recess 232, 233 can include a recess planar portion 236, 237 and a recess convex portion 238, 239. The recess planar portion 236, 237 can be adjacent the interlock collar 230, 231 and the recess convex portion 238, 239 can be interposed between the recess planar portion and the side wall surface 214, 215 of the mounting nose 206. A recess transition point 240, 241 can be defined as the point of tangency on each of the interlock exterior recess surfaces 234, 235 between the recess planar portion 236, 237 and the recess convex portion 238, 239.

Figure 14:
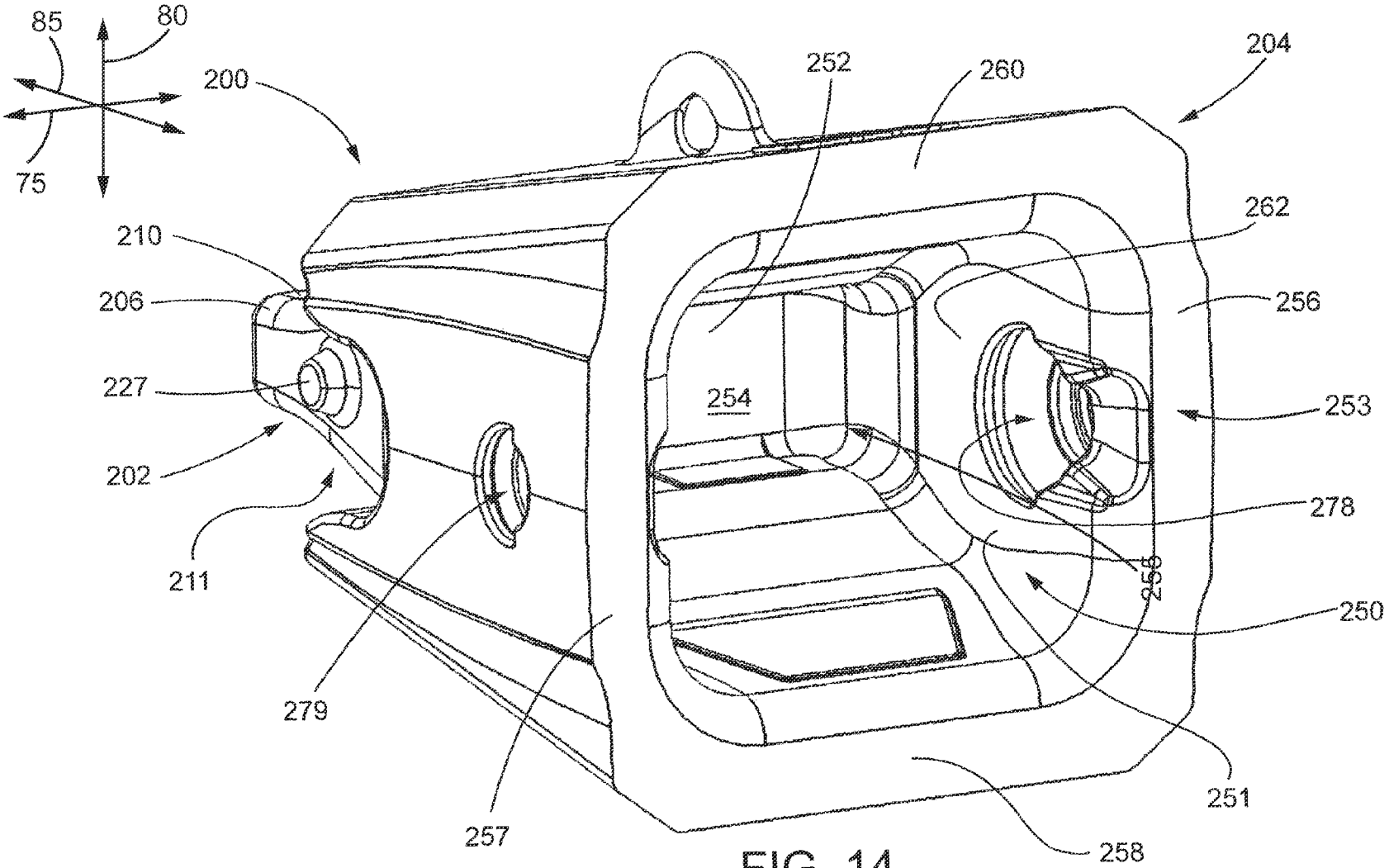
FIG. 14 is a rear perspective view of the coupler of FIG. 13.
Figure 15:
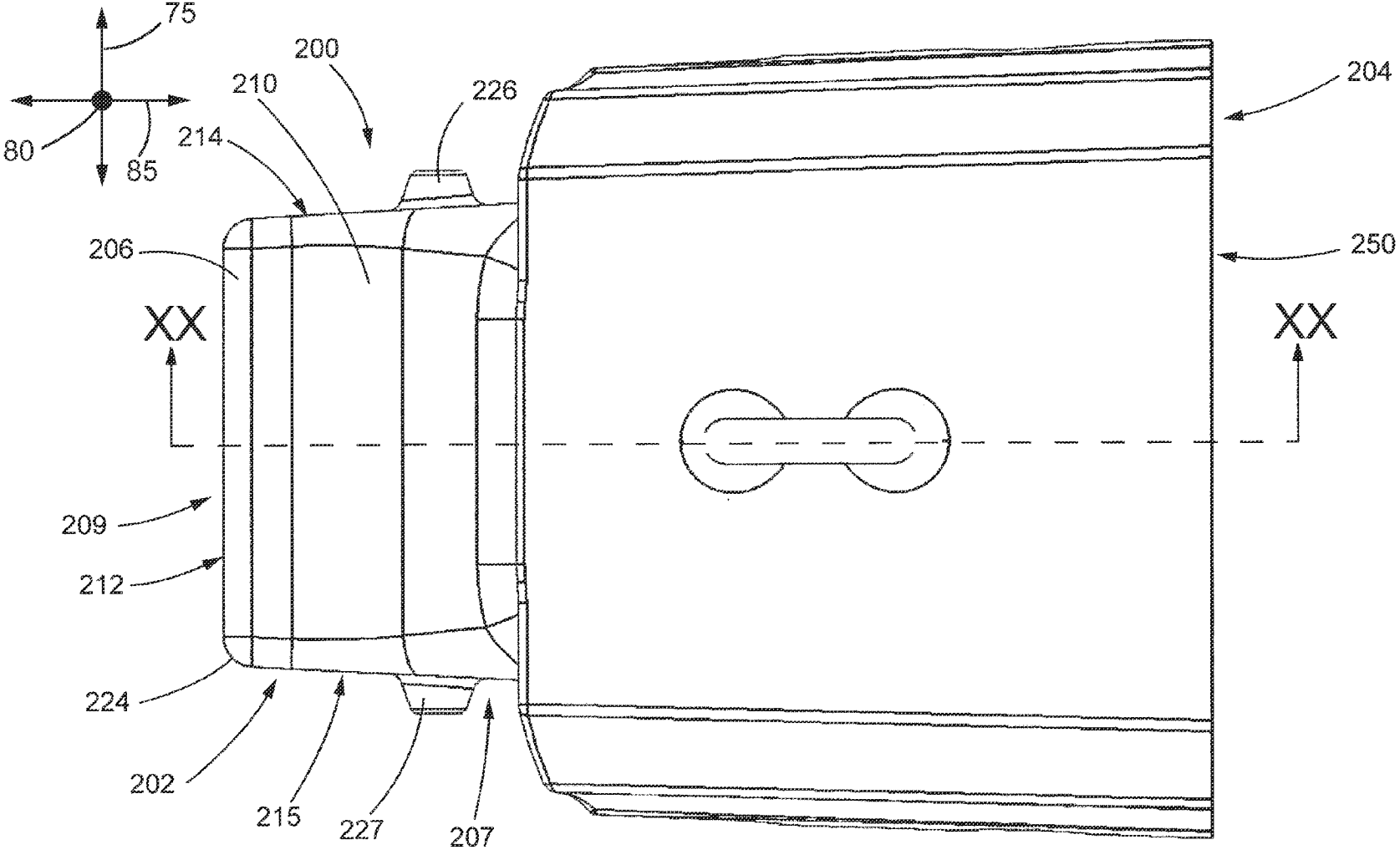
FIG. 15 is a top plan view of the coupler of FIG. 13.
Figure 20:
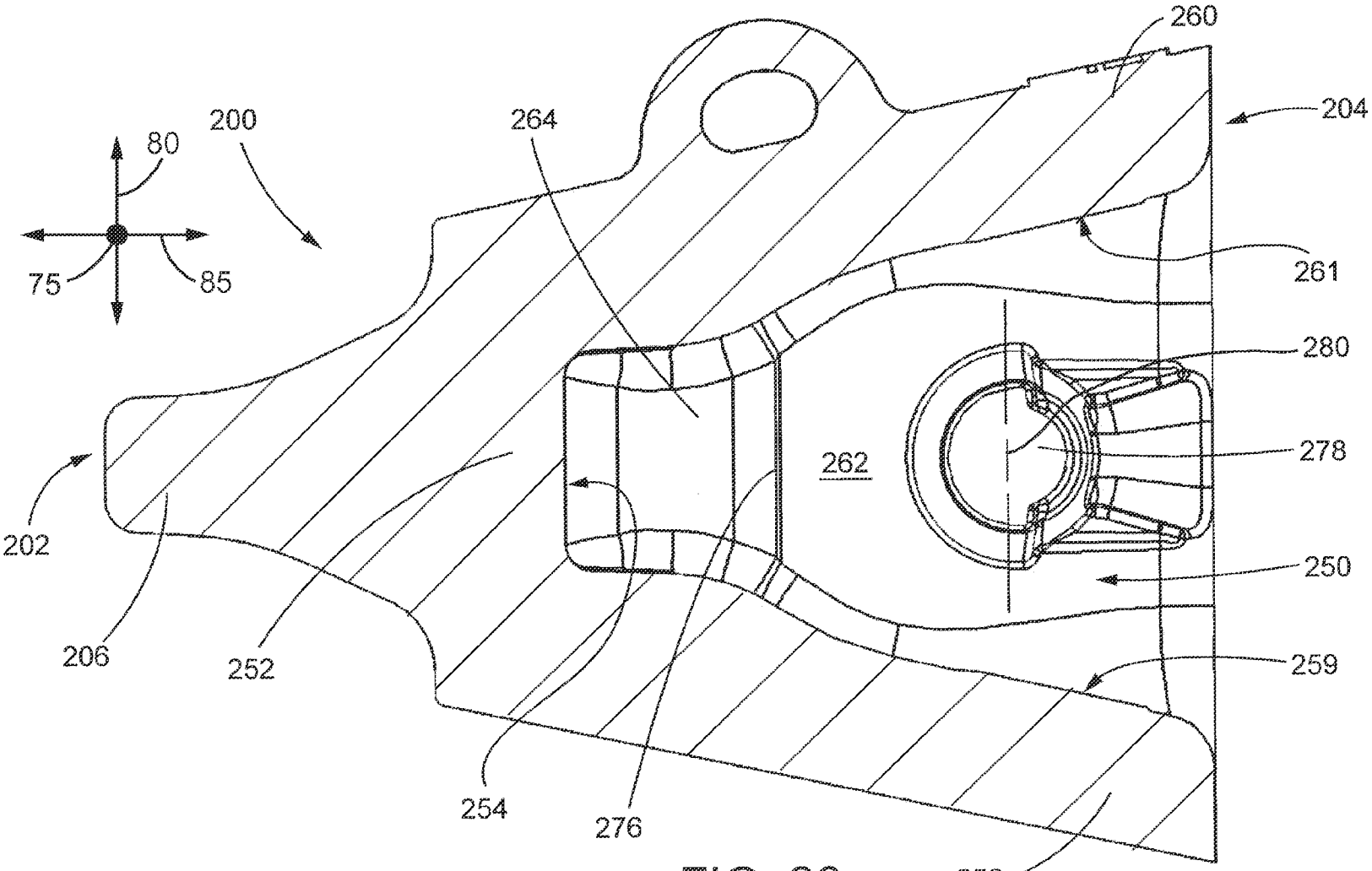
FIG. 20 is a cross-sectional view taken along line XX-XX in FIG. 15 of the coupler of FIG. 13.

Referring now to FIG. 14, the implement mounting portion 204 of the coupler 200 can define an implement pocket 250. The implement pocket can have an opening 253 in communication with an interior cavity 255. The implement mounting portion 204 of the coupler 200 can also have an interior coupler surface 251 facing the coupler pocket 250 and generally away from the tip mounting portion 202. The implement pocket 250 can be defined by a central wall 252, a pair of substantially parallel coupler side walls 256, 257, a first coupler wall 260, and an second coupler wall 258. The central wall 252 can have an abutment surface 254 facing the implement pocket 250 and generally away from the tip mounting portion 202. Each side wall 256, 257 can have a side interior surface 262, 263 substantially perpendicular to the abutment surface 254 and facing the implement pocket 250. Referring to FIG. 20, the first coupler wall 260 can have a first coupler interior surface 261 and the second coupler wall 258 can have a second coupler interior surface 259. The first and second interior coupler wall surfaces 259, 261 can both be adjacent the abutment surface 254 and substantially symmetrical to one another about the plane defined by the longitudinal axis 85 and the lateral axis 75 as viewed along the lateral axis.

Figure 19:
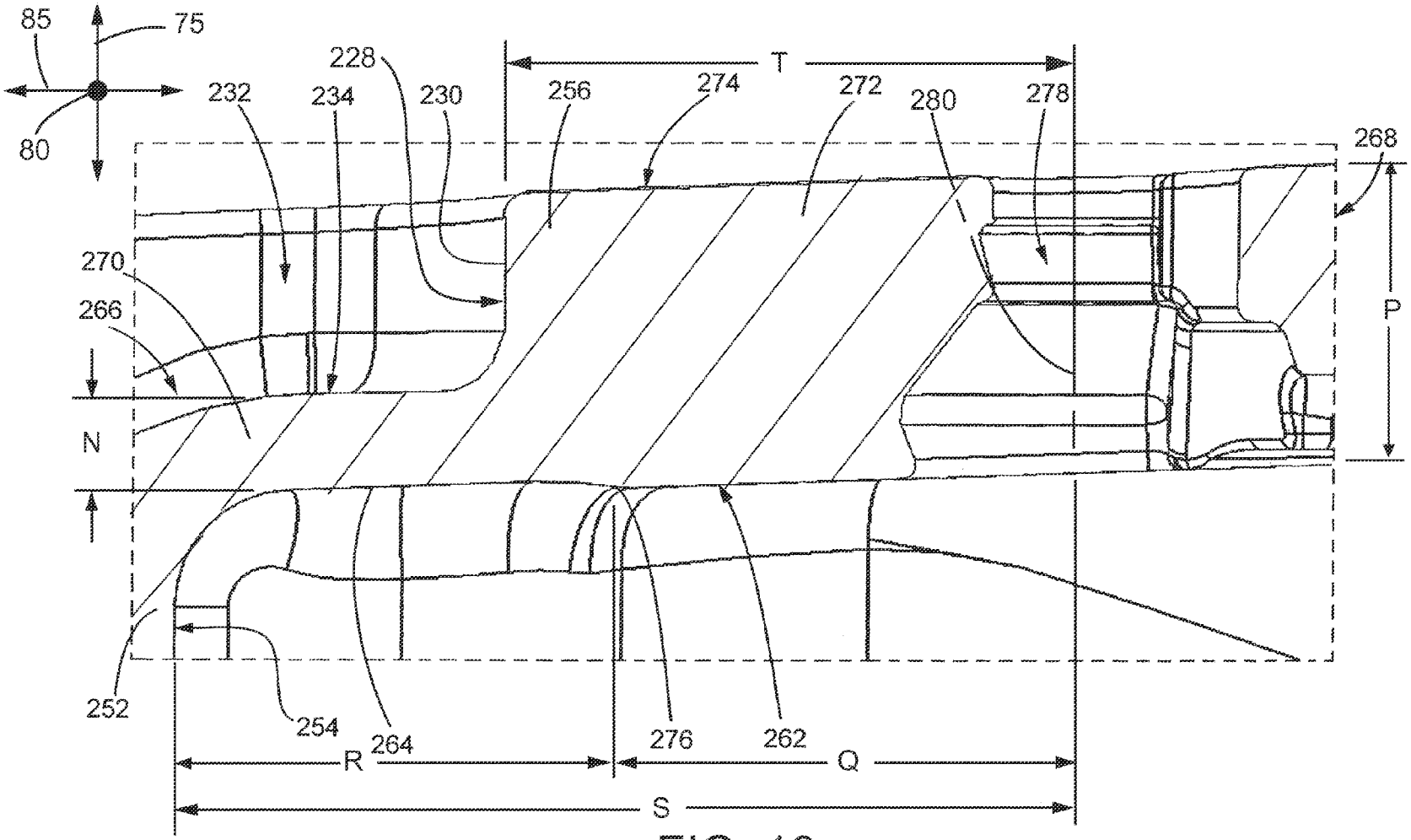
FIG. 19 is an enlarged, detail view taken from FIG. 18 as indicated by rectangle XIX.

Referring to FIG. 19, each coupler side wall 256, 257 can have a distal end 266, 267 and a proximal end 268, 269 in opposing relationship to one another along the longitudinal axis 85. The distal ends 266, 267 of the coupler side walls 256, 257 can be adjacent to the central wall 252 and include interlock portions 270, 271 of the coupler side walls. Each interlock portion 270, 271 can have a width N measured along the lateral axis 75 between the side interior surface 262, 263 at a recessed portion 264, 265 of the coupler side walls 256, 257 and the interlock exterior recess surface 234, 235.

The proximal ends 268, 269 of each coupler side wall 256, 257 can include a base portion 272, 273. Each base portion 272, 273 can have a width P measured along the lateral axis 75 between the side interior surface 262, 263 of the coupler side walls 256, 257 and a base exterior surface 274, 275. Implement retention orifices 278, 279 can also be defined in the base portions 272, 273 of each coupler side wall 256, 257. The implement retention orifices 278, 279 can be generally cylindrical and can have an implement retention orifice center 280, 281. The first pair of retention mechanisms 208 can respectively fit into the implement retention orifices 278, 279 and pivotally secure the coupler 200 to the implement mounting nose 300, as discussed in further detail below. In some embodiments, the width P of each coupler side wall 256, 257 at the base portion 272, 273 can be greater than the width N of the coupler side walls at the interlock portion 270, 271. Each coupler side wall 256, 257 can have an interface segment 228, 229 interposed between the interlock portion 270, 271 and the base portion 272, 273. The interface segment 228, 229 can be disposed on the interlock collar 230, 231, and extends laterally outward along the lateral axis 75 from the interlock exterior recess surface 234, 235 to the base exterior surface 274, 275.

Each side interior surface 262, 263 can flare laterally outward adjacent the abutment surface 254 to define a recessed portion 264, 265. The recessed portion 264, 265 can be offset laterally outward of the side interior surface 262, 263 along the lateral axis 75. The recessed portion 264, 265 can extend along the longitudinal axis 85 substantially between the abutment surface 254 along the interlock portion 270, 271 toward the proximal end 268, 269 of each coupler side wall 256, 257 to a transition surface 276, 277. The transition surface 276, 277 can be disposed along the base portion 272, 273 of each coupler side wall 256, 257. Thus, the recessed portion 264, 265 can substantially span the interlock portion 270, 271 of the coupler side wall 256, 257. The transition surface 276, 277 can be a convex curve that originates at the recessed portion 264, 265 and defines a smooth curve transitioning the recessed portion to the remainder of the side interior surface 262, 263.

The parts that can make up the implement mounting portion 204 of the coupler 200 can have various different shapes and dimensions in its various possible embodiments. Although dimensions of some possible embodiments are listed herein, it is contemplated that other suitable dimensions can be used. In some embodiments, for example, a ratio of the width P of each coupler side wall 256, 257 at the base portion 272, 273 to the width N of each coupler side wall at the interlock portion 270, 271 can be in a range between about 2:1 and about 3:1, and in a range from about 5:2 to about 3:1 in other embodiments. In other embodiments, a ratio of the width P and the width N can be at least about 5:2. In particular embodiments, a ratio of the width of each coupler side wall 256, 257 at the base portion 272, 273 to the width of each coupler side wall at the interlock portion 270, 271 can be at least about 13:5.

The recessed portion 264, 265 can have a depth measured from the side interior surface 262, 263 outwardly along the lateral axis 75. In some embodiments, a ratio between the width P of each coupler side wall 256, 257 at the base portion 272, 273 to the depth of the recessed portion 264, 265 can be about at least about 30:1. In a particular embodiment, a ratio between the width P of each coupler side wall 256, 257 at the base portion 272, 273 to the depth of the recessed portion 264, 265 can be about 32:1. In some embodiments, a ratio between the width N of each coupler side wall 256, 257 at the interlock portion 270, 271 to the depth of the recessed portion 264, 265 can be at least about 10:1, and can be at least about 12:1 in other embodiments. In a particular embodiment, the ratio between the width N of each coupler side wall 256, 257 at the interlock portion 270, 271 to the depth of the recessed portion 264, 265 can be about 25:2.

In some embodiments, a ratio of the distance between the implement retention orifice center 280, 281 and the abutment surface 254 to the distance between the implement retention orifice center and the transition surface 276, 277 can be about 2:1. In certain embodiments, the ratio of the distance between the implement retention orifice center 280, 281 and the abutment surface 254 to the distance between the implement retention orifice center and the transition surface 276, 277 can be about 105:55.

A longitudinal distance Q can be measured along the longitudinal axis 85 between the implement retention orifice center 280, 281 and the transition surface 276, 277, and a longitudinal distance R can be measured along the longitudinal axis 85 between the transition surface 276, 277 and the abutment surface 254. A longitudinal distance S can be measured along the longitudinal axis 85 between the implement retention orifice center 280, 281 and the abutment surface 254. In some embodiments, a ratio of the longitudinal distance Q between the implement retention orifice center 280, 281 and the transition surface 276, 277 to the depth of the recessed portion 264, 265 of the side interior surface 262, 263 can in a range between about 40:1 and about 70:1, and be about 55:1 in a particular embodiment. In some embodiments, a ratio of the distance R between the abutment surface 254 and the transition surface 276, 277 to the depth of the recessed portion 264, 265 can be in a range between about 30:1 and about 60:1. In other embodiments, a ratio of the distance R between the abutment surface 254 and the transition surface 276, 277 to the depth of the recessed portion 264, 265 can be in a range between about 40:1 and about 50:1, and can be about 43:1 in a particular embodiment. In some embodiments, a ratio of the distance S, measured along the longitudinal axis 85 between the implement retention orifice center 280 and the abutment surface 254, and the distance Q, measured along the longitudinal axis between the implement retention orifice center and the transition surface 276, 277 can be about 2:1 or less.

A longitudinal distance T can be measured along the longitudinal axis 85 between the implement orifice center 280, 281 and the interface segment 228, 229. In some embodiments, a ratio of the longitudinal distance T, measured between the implement retention orifice center 280, 281 and interface segment 228, 229 of each coupler side wall 256, 257, to the longitudinal distance Q, measured between the implement retention orifice center and the transition surface 276, 277, can be in a range from about 1:1 to about 3:2. In some embodiments, a ratio of the longitudinal distance T to the longitudinal distance Q can be greater than about 1:1. In certain embodiments, a ratio of the longitudinal distance T to the longitudinal distance Q can be about 27:22.

Figure 21:
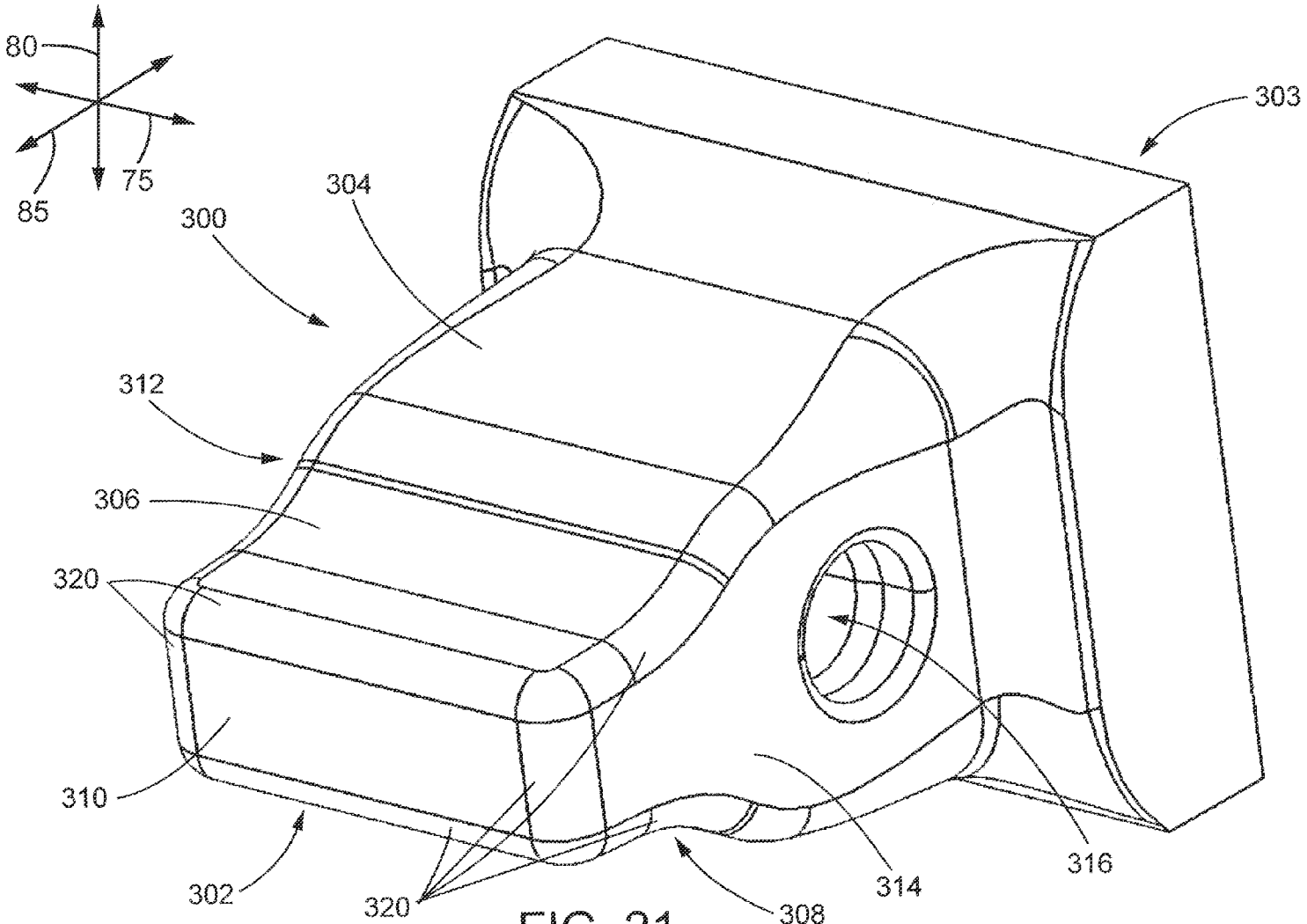
FIG. 21 is a front perspective view of an implement mounting nose of the GET assembly of FIG. 5.
Figure 22:
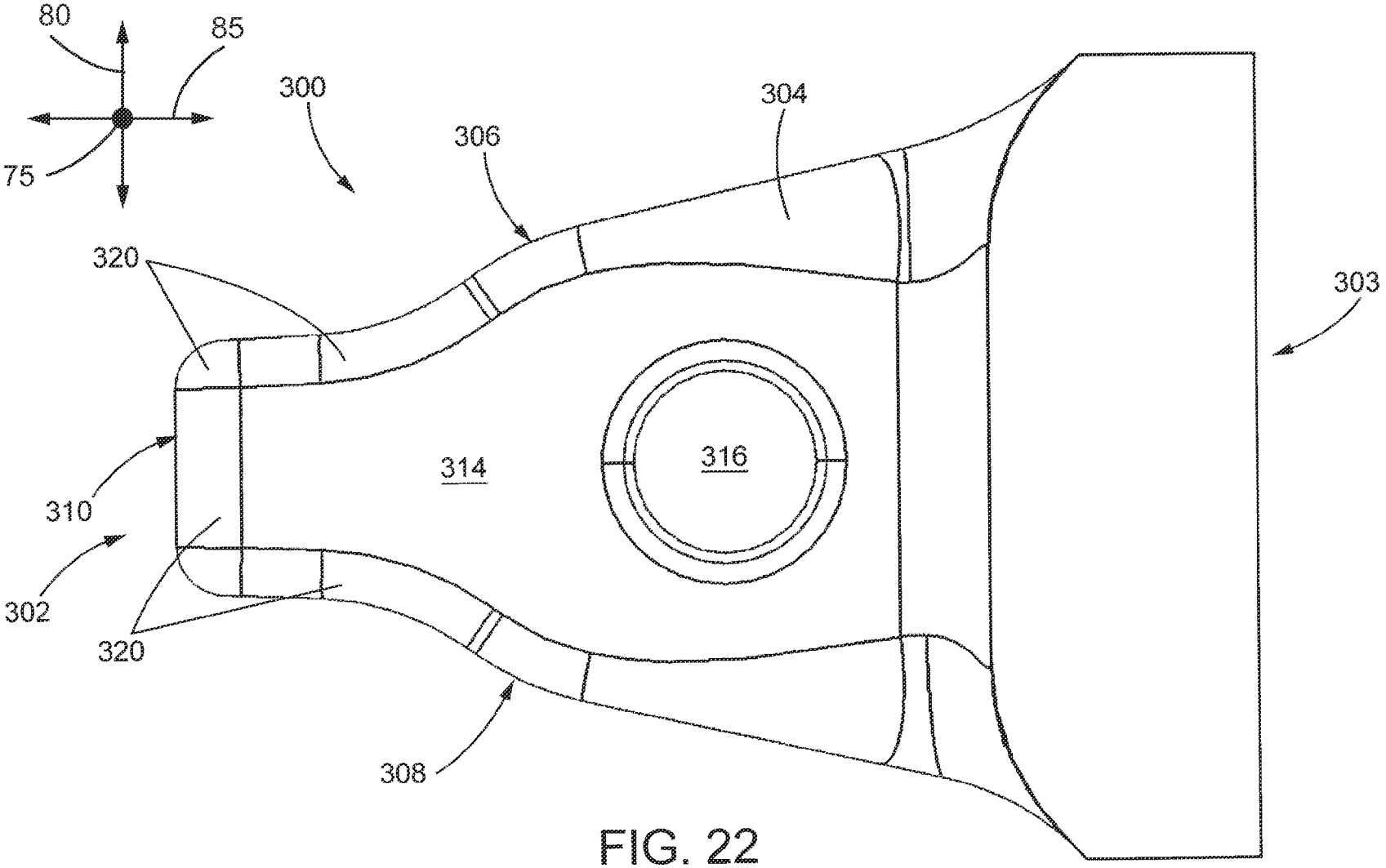
FIG. 22 is a side elevational view of the implement mounting nose of FIG. 21.
Figure 23:
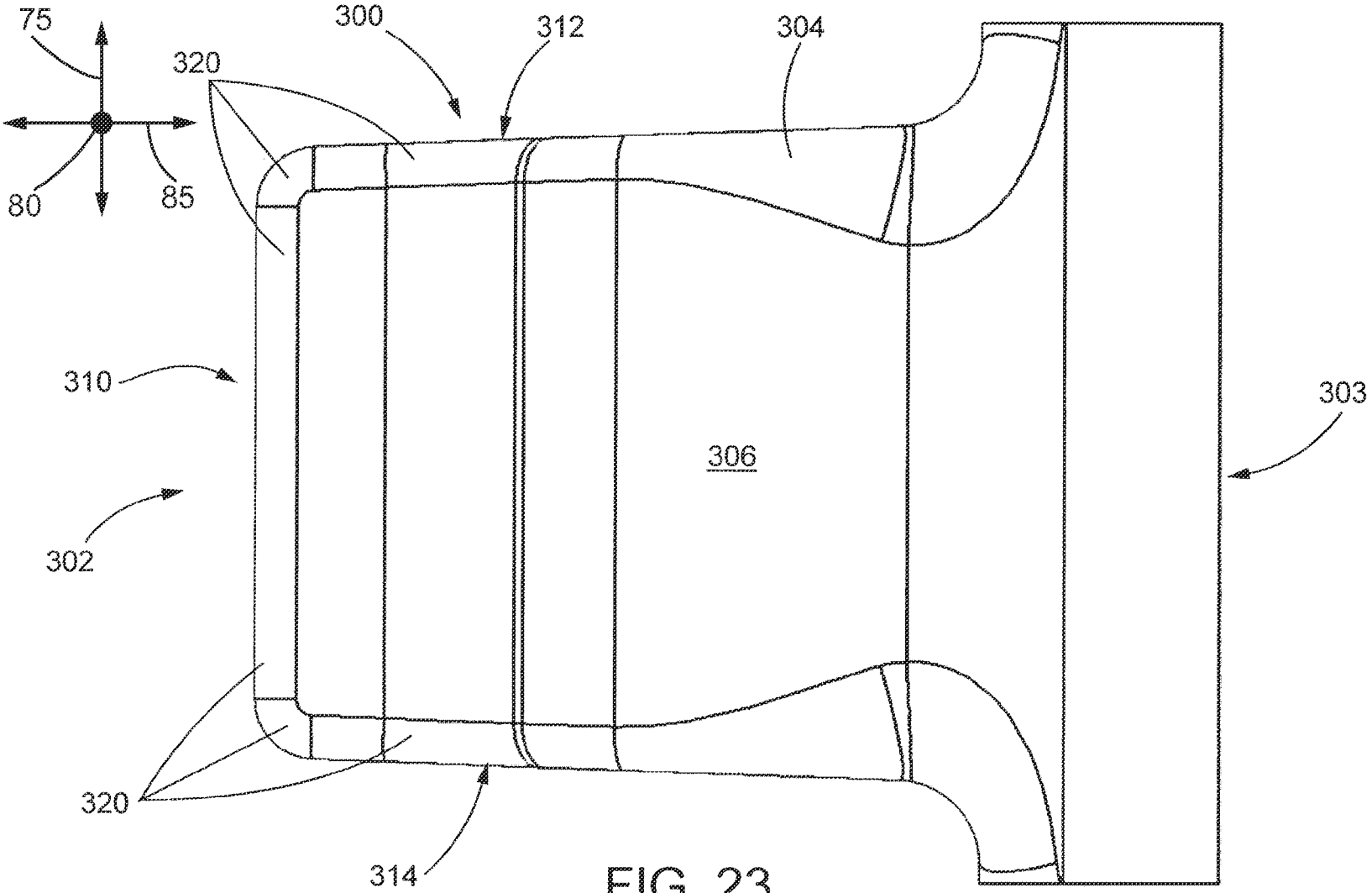
FIG. 23 is a top plan view of the implement mounting nose of FIG. 21.

An embodiment of the implement mounting nose 300 is shown in FIGS. 21-23. Referring to FIG. 21, the implement mounting nose 300 can have a coupler mounting end 302 and an implement end 303. The coupler mounting end 302 can be in opposing relationship to the implement end 303 along the longitudinal axis 85. The implement end 303 can be welded or otherwise connected to the implement 60 of the machine 50 (see FIG. 1). The coupler mounting end 302 can have an exterior nose surface 304 facing generally away from the implement end 303. The exterior nose surface 304 can be made up of a first implement nose surface 306, a second implement nose surface 308, a blunt nose surface 310, and a pair of side nose surfaces 312, 314. The blunt nose surface 310 can be substantially planar and adjacent to both the first and second implement nose surfaces 306, 308, and both side nose surfaces 312, 314. The blunt nose surface 310 can connect to the adjacent surface via curved implement nose edges 320. Referring to FIG. 22, the first and second implement nose surfaces 306, 308 can each have a contoured profile symmetrical to one another about the plane defined by the longitudinal axis 85 and the lateral axis 75 as viewed along the lateral axis. The first and second implement nose surfaces 306, 308 can each be adjacent to the side surfaces 312, 314, and can be connected to the side nose surfaces 312, 314 via curved nose edges 320. The implement mounting nose 300 can also form a retention bore 316 defining an opening between the two side nose surfaces 312, 314 and adapted to receive a retention pin 318.

Figure 24:
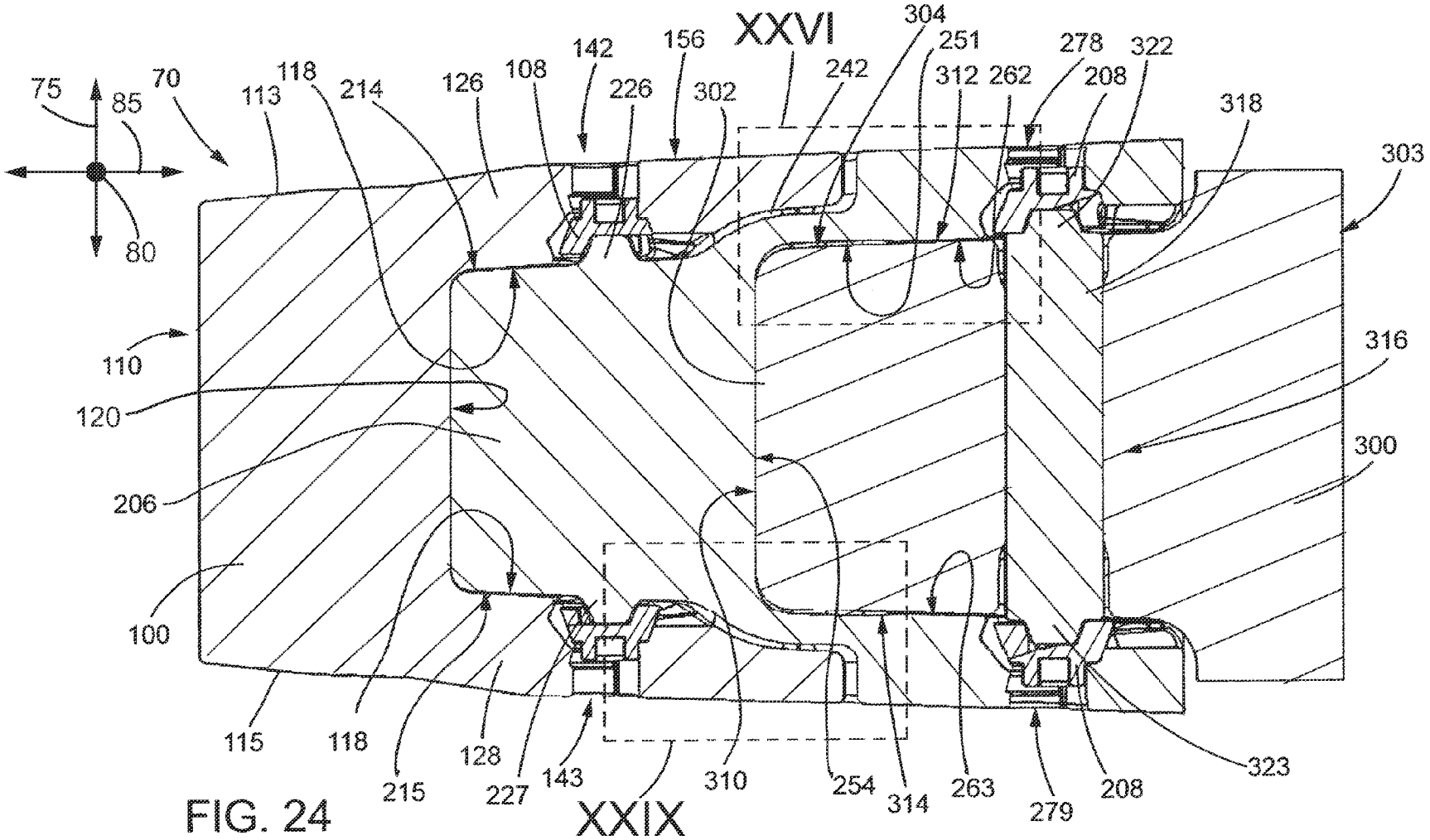
FIG. 24 is a cross-sectional view taken along line XXIV-XXIV in FIG. 31 of the GET assembly of FIG. 5.
Figure 25:
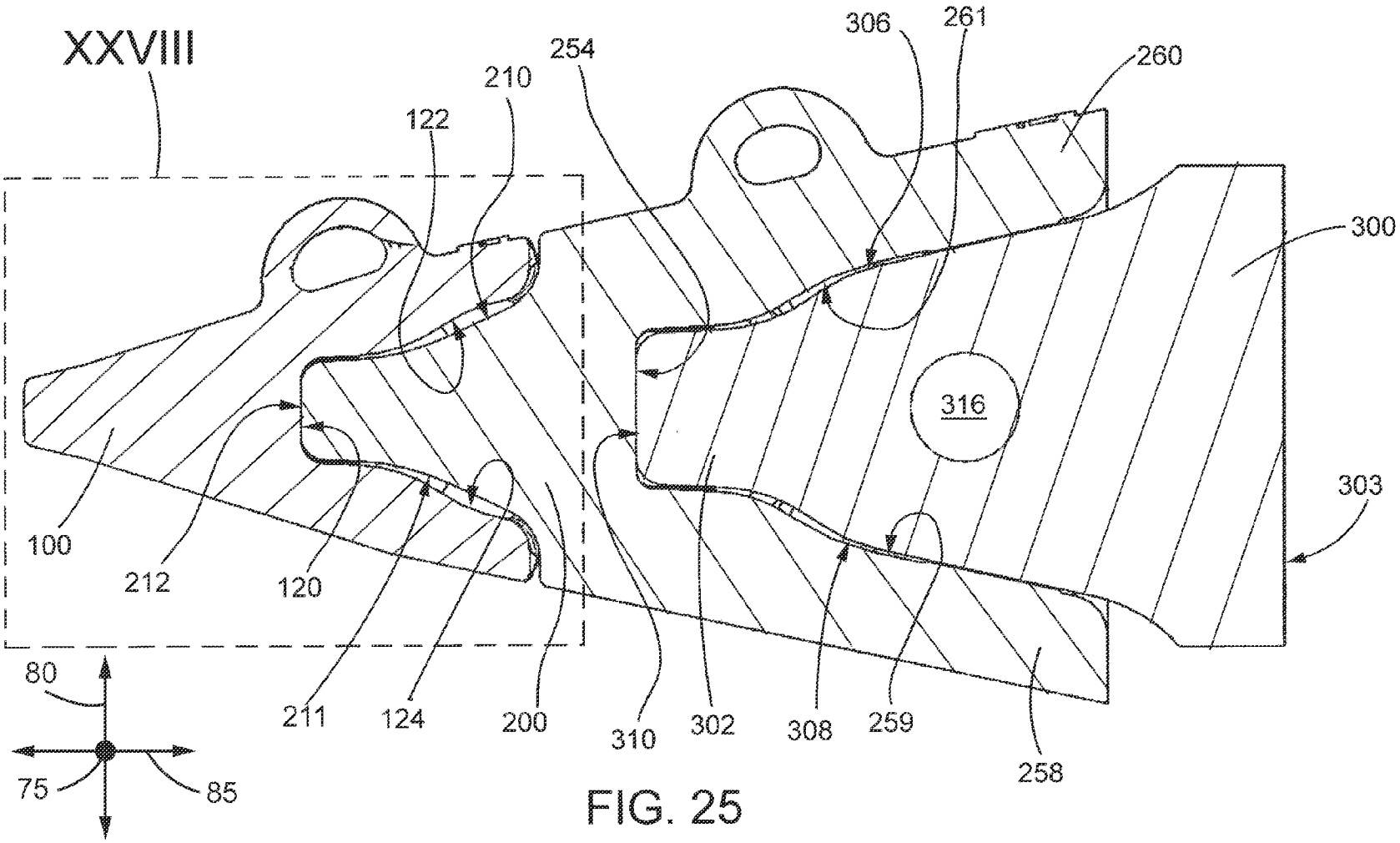
FIG. 25 is a side elevational view, in section, of the GET assembly of FIG. 5.

FIGS. 24-25 show sectional views of the ground engaging tool assembly 70. When mounted to one another, the ground engaging tip 100 and the coupler 200 can extend along the longitudinal axis 85. Referring to FIG. 24, the coupler mounting end 302 of the implement mounting nose 300 can fit into the implement pocket 250 such that the exterior nose surface 304 of the implement mounting nose can be positioned along the internal coupler surface 251. Referring to FIG. 24, in some embodiments, the coupler 200 can be secured to the implement mounting nose 300 using the retention pin 318 and the first pair of retention mechanisms 208. In such embodiments, the implement retention orifices 278, 279 in the side walls 256, 257 of the coupler 200 can align with the retention bore 316 of the implement mounting nose 300 when the coupler mounting end 302 of the implement mounting nose can be positioned within the implement pocket 250. While the retention pin 318 can be positioned within the retention bore 316, tapered retention bosses 322, 323 on either end of the retention pin protrude out from the side nose surfaces 312, 314 and partially into the retention orifices 278, 279. While positioned within the retention orifices 278, 279, the first pair of retention mechanisms 208 can attach to the retention bosses 322, 323. When secured to the retention bosses 322, 323, the first pair of retention mechanisms 208 can retain the retention pin 318 within the retention bore 316, coupling the implement mounting nose 300 to the coupler 200. It is also contemplated that in other embodiments the retention bosses 322 and 323 may be formed integrally with the mounting nose 300, thereby alleviating a need for the retention bore 316 and retention pin 318 and allowing the coupler 200 to be secured directly to the implement mounting nose 300.

Referring to FIG. 24, when the implement mounting nose 300 and the coupler 200 are assembled, the coupler mounting end 302 of the implement mounting nose can be disposed within the implement mounting pocket 250 of the coupler. The exterior nose surface 304 of the implement mounting nose 300 can be disposed adjacent the side interior surface 262, 263 of the coupler 200. The blunt nose surface 310 of the implement mounting nose 300 can be positioned along the abutment surface 254 of the coupler 200 and the side nose surfaces 312, 314 can be positioned along the side interior surfaces 262, 263. Additionally, as shown in FIG. 25, the first implement nose surface 306 can be positioned along the first coupler interior surface 261, and the second implement nose surface 308 can be positioned along the second coupler interior surface 259.

Figure 26:
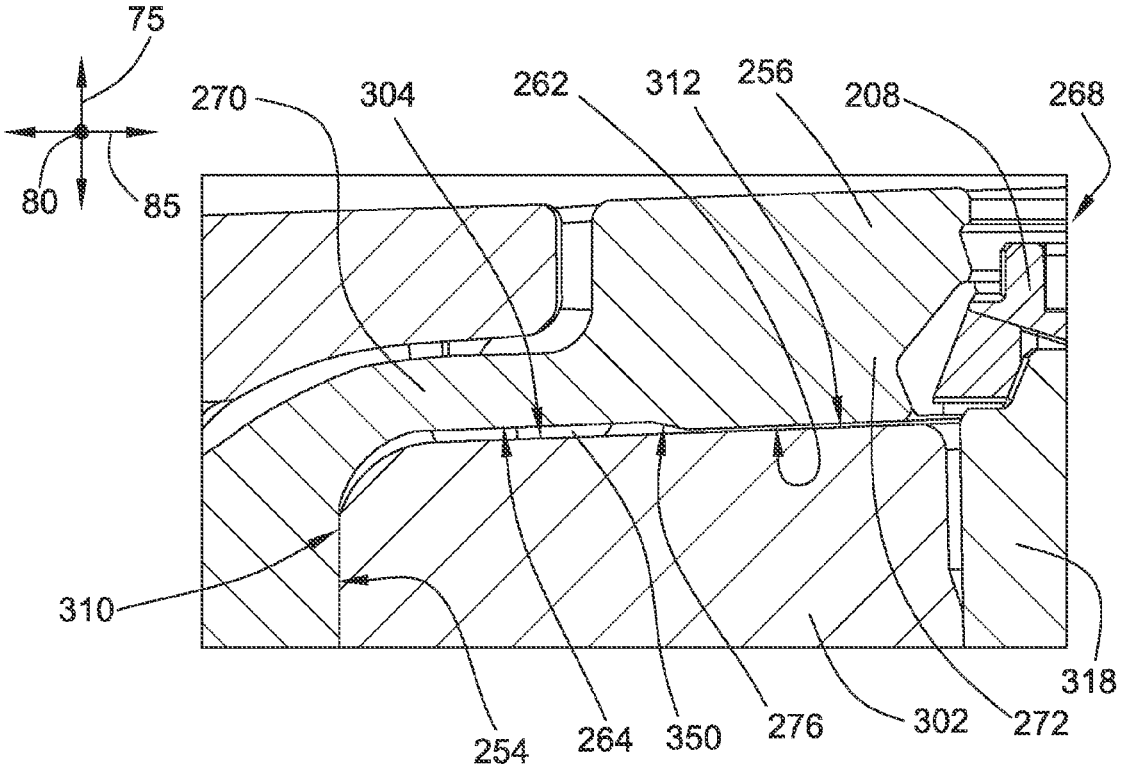
FIG. 26 is an enlarged, detail view taken from FIG. 24 as indicated by rectangle XXVI, illustrating the GET assembly of FIG. 5 in a nominal position.

Referring to FIG. 26, when the implement mounting nose 300 can be positioned within the implement pocket 250, a gap 350 can be defined between the side nose surfaces 312, 314 of the exterior nose surface 304 and the side interior surfaces 262, 263 of the interior coupler surface 251. With reference along the longitudinal axis 85, the gap 350 can span the interface between the side nose surface 312, 314 and the side interior surfaces 262, 263 from the abutment surface 254 along the interlock portion 270, 271 and the base portion 272, 273 of the coupler side wall 256, 267. The gap 350 can be widest between the side nose surface 312, 314 and the recessed portion 264, 265 of the side interior surfaces 262, 263. The gap 350 can become relatively narrower at the transition surface 276, 277 and along the remainder of the base portion 272, 273 of the side walls 256, 257.

In the embodiment shown in FIG. 26, the illustrated gap 350 between the side nose surface 312 and the side interior surface 262 can be present when the GET assembly 70 is in a nominal position. The nominal position can be the range of positions of the components in which no substantial external forces are acting upon the ground engaging tip 100, the coupler 200, or the GET assembly 70 as a whole. In the nominal position, the gap 350 can be present substantially along the entire interface between the side nose surfaces 312, 314 and the side interior surfaces 262, 263.

Figure 27:
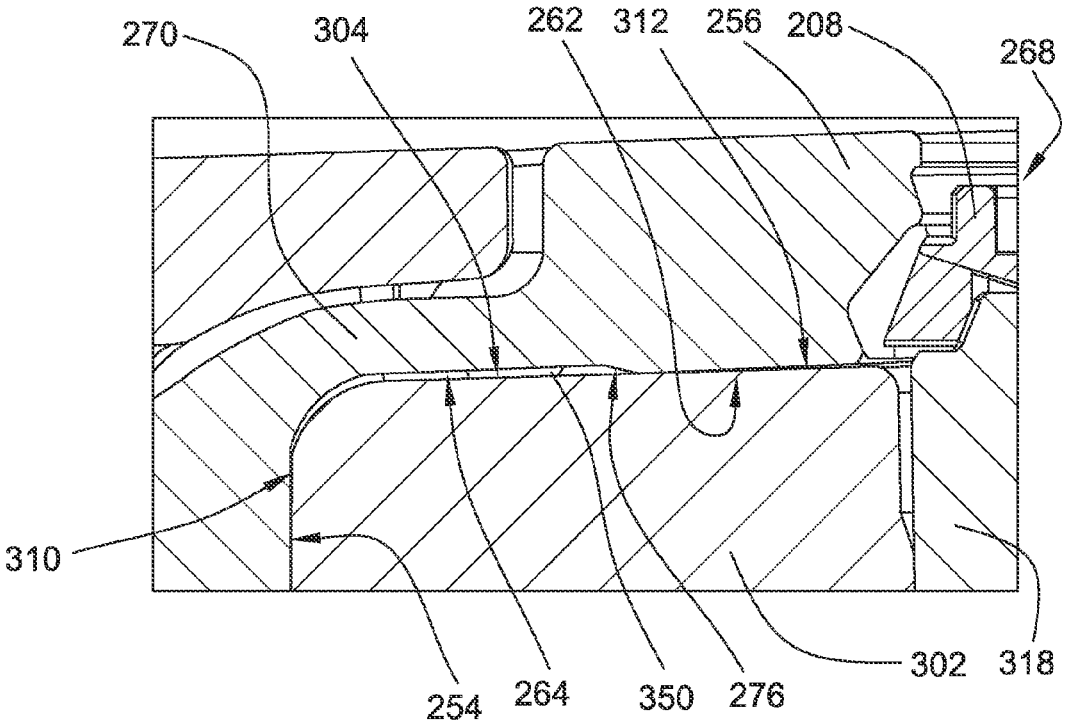
FIG. 27 is a view as in FIG. 26, but illustrating the GET assembly of FIG. 5 in a maximum side rotated position.

When the GET assembly 70 is subjected to forces along the lateral axis 74, such as forces against the tip side walls 113, 115 or the side walls 256, 257 of the coupler 200, the coupler can rotate with respect to the implement mounting nose 300 about a normal axis 75 over a range of travel between a nominal position and a maximum side rotated position. FIG. 27 shows a detailed view of the gap 350 between the side nose surface 312 and the side interior surface 262 in the maximum side rotated position. In the illustrated maximum side rotated position, one of the side interior surfaces 262, 263 of the exterior nose surface 304 can be in contacting relationship with the base portion 272, 273 of the coupler side wall 256, 257 at a location between the transition surface 276, 277 and the proximal end 268, 269 of the side wall. As the coupler 200 rotates with respect to the implement mounting nose 300, the gap 350 between one of the side nose surfaces 312 and the respective side interior surface 262 can become narrower while the gap between the opposing side nose surface 314 and the opposite side interior surface 263 can become wider. In embodiments, when the coupler 200 reaches the maximum side rotated position and the side nose surface 312 contacts the side interior surface 262 between the transition surface 276 and the proximal end 268, the gap 350 remains present between the side nose surface 312 and the recessed portion 264 of the side interior surface 262. In other words, the exterior nose surface 304 and the recessed portion 265 of the side interior surface 263 can be in a spaced, non-contacting relationship over the range of travel between the nominal position and the maximum side rotated position.

In embodiments, such as is shown in FIGS. 26 and 27, the implement pocket 250 can flare laterally outward adjacent the abutment surface 254 so that contact between the implement mounting nose 300 and the coupler 200 can be initiated along the base portion 258, 259 of the side walls 256, 257. Contact can occur at the transition surfaces 276, 277 located at each base portion 272, 273 of the coupler side walls 256, 257 or between the transition surface and the proximal end 268. In this constrained position, the implement mounting nose 300 does not contact the coupler 200 at the interlock portions 270, 271 of the side walls 256, 257. Since the width P of the side walls 256, 257 can be greater at each base portion 272, 273 than the width N at each interlock portion 270, 271, the stresses caused by the contact between the coupler 200 and the implement mounting nose 300 can be distributed to the coupler side walls 256, 257 at a relatively wide portion of the side walls. If, instead, these stresses were distributed to the narrower interlock portions 270, 271, as in some designs, the likelihood of side wall failure can increase.

In some embodiments, the implement pocket 250 can flare laterally outward nearest the tip mounting portion 204 such that the implement pocket has a lateral cavity width at the interior cavity that is greater than a lateral opening width at the opening 253.

The mounting nose 206 of the coupler 200 can be adapted to fit within the coupler pocket 114 of the ground engaging tip 100. In some embodiments, such as the embodiment shown in FIG. 24, the second pair of retention mechanisms 108 can secure the ground engaging tip 100 to the coupler 200. In such embodiments, the retention bosses 226, 227 can be substantially aligned with the retention orifices 142, 143 in the side walls 126, 128 of the ground engaging tip 100 when the mounting nose 206 is positioned within the coupler pocket 114. The second pair of retention mechanisms 108 can be adapted to fit within the retention orifices 142, 143 and connect to the retention bosses 226, 227. The second pair of retention mechanisms 108 can then secure the mounting nose 206 within the coupler pocket 114 and substantially limit the relative movement between the ground engaging tip 100 and the coupler 200.

Figure 28:
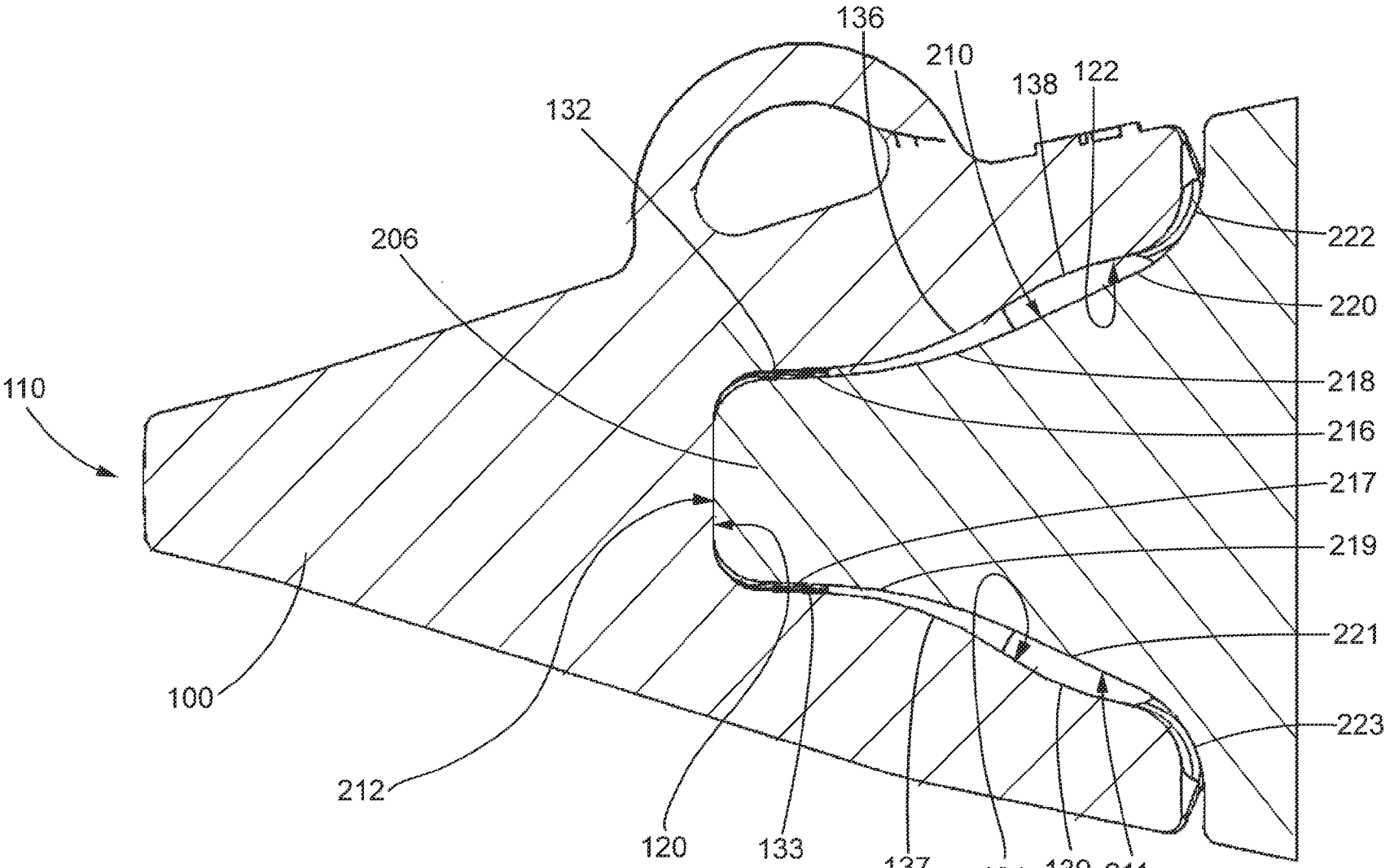
FIG. 28 is an enlarged, detail view taken from FIG. 25 as indicated by rectangle XVIII.

As shown in FIG. 24, when the mounting nose 206 is positioned within the coupler pocket 114, the side surfaces 214, 215 of the mounting nose can be positioned substantially adjacent the interior surface 118 of the side walls 126, 128. As shown in FIGS. 25 and 28, when the mounting nose 206 is positioned within the coupler pocket 114 the distal exterior surface 212 of the mounting nose can be disposed substantially adjacent the base wall 120 of the coupler pocket. Additionally, the first exterior face surface 210 of the mounting nose 206 can be disposed substantially adjacent the first coupler face wall 122 of the coupler pocket 114, and the second exterior face surface 211 of the mounting nose can be disposed substantially adjacent the second coupler face wall 124 of the coupler pocket. Although positioned along one another, the first face contour profile of the first exterior face surface 210 of the mounting nose 206 can be substantially non-complementary to the first wall contour profile of the first coupler face wall 122 of the coupler pocket 114. Likewise, the second face contour profile of the second exterior face surface 211 of the mounting nose 206 can be substantially non-complementary to the second wall contour profile of the second coupler face wall 124 of the coupler pocket 114 (see FIG. 28).

In some embodiments, the coupler pocket 114 can have at least one coupler face wall 122, 124 defining a wall contour profile. The coupler 200 can include at least one exterior face surface 210, 211 defining a face contour profile. The coupler 200 can be disposed within the coupler pocket 114 such that the at least one exterior face surface 210, 211 is adjacent the at least one coupler face wall 122, 124. In such an embodiment, the wall contour profile of the at least one coupler face wall 122, 124 can be non-complementary to the face contour profile of the at least one exterior face surface 210, 211.

The differing contour profiles between the mounting nose 206 and the coupler pocket 114 can enhance the strength of both the ground engaging tip 100 and the coupler 200. Referring to FIG. 28, one difference between the respective contour profiles can be evident between the concave portions 138, 139 of the first and second coupler face walls 122, 124 of the ground engaging tip 100 and the second planar nose portions 220, 221 of the first and second exterior face surfaces 210, 211 of the mounting nose 206. As discussed above, increasing the radii of the concave portions 138, 139 can allow for a larger wall fillet 131 radius, which can reduce stress concentrations in the ground engaging tip 100. Rather than duplicating the contour profile of the first and second coupler face walls 122, 124 at the concave portions 138, 139, the first and second exterior face surfaces 210, 211 can be planar along the second planar nose portion 220, 221. Such a face contour profile can allow for a smooth transition between the first concave nose portions 218, 219, the second planar nose portions 220, 221, and the second concave nose portions 222, 223, thereby resulting in reduced stress concentrations in the mounting nose 206. While increasing the radii of the concave portions 138, 139 of the first and second coupler face walls 122, 124 can result in slightly higher stress concentrations at the concave portions, the resulting lower stress concentrations at the wall fillets 131 can offset this increase. Conversely, if the first and second exterior face surfaces 210, 211 of the mounting nose 206 followed the profile of the concave portions 138, 139, the stress concentration in the mounting nose could increase with no resulting reduction in stresses elsewhere in the mounting nose. Therefore, using substantially different contour profiles between the first and second coupler face walls 122, 124 and the first and second exterior face surfaces 210, 211 of the mounting nose 206 can result in lower stresses in both the ground engaging tip 100 and the coupler 200.

In embodiments, the first concave nose portion 218, 219 of the first and second exterior face surfaces 210, 211 of the mounting nose 206 can have a first radius of nose concave curvature, and the first convex portion 136, 137 of the first and second coupler face walls 122, 124 can have a first radius of pocket convex curvature. In some embodiments, a ratio of the first radius of concave nose curvature to the first radius of pocket convex curvature can be in a range between about 3:2 and about 2:1, and can be a ratio of about 15:9 in a particular embodiment.

Figure 29:
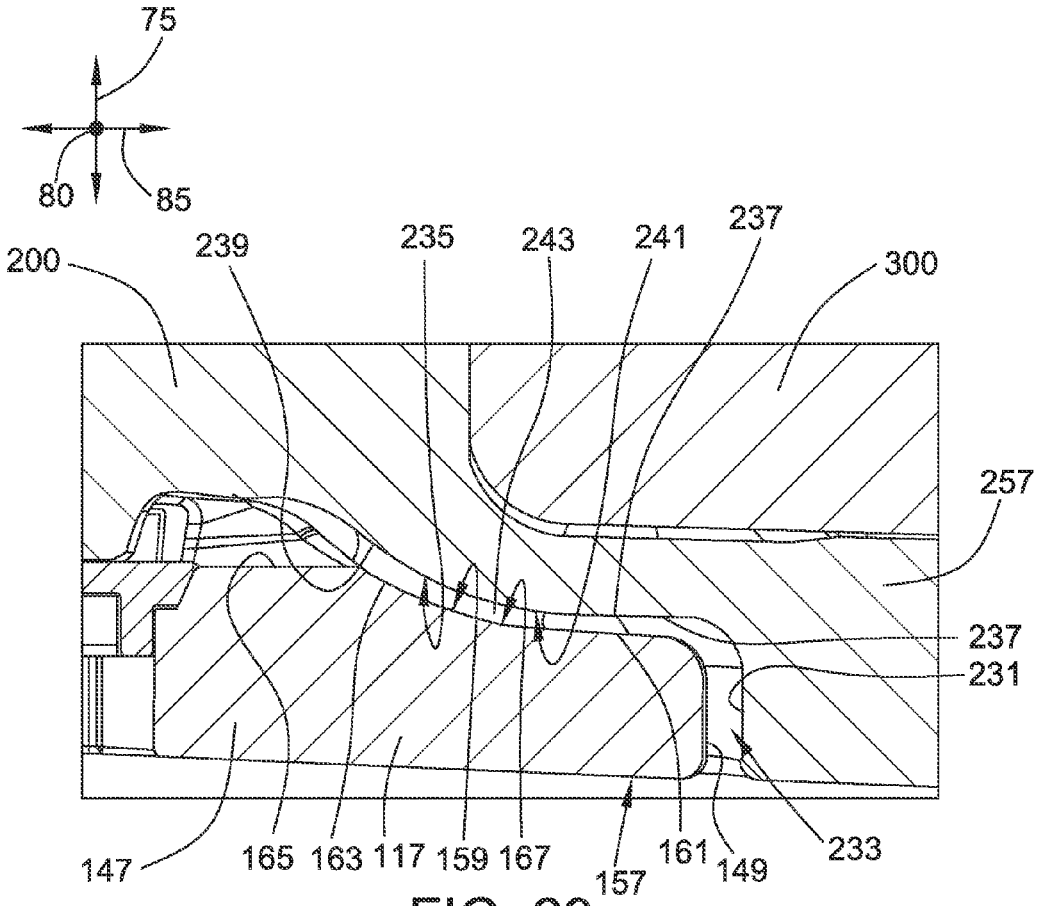
FIG. 29 is an enlarged, detail view taken from FIG. 24 as indicated by rectangle XXIX, illustrating the GET assembly of FIG. 5 in a nominal position in a nominal position.

Referring to FIGS. 24 and 29, when the mounting nose 206 is positioned within the coupler pocket 114, the interlock exterior recess surfaces 234, 235 of the coupler 200 can be in spaced relationship to the inner lateral surface 158, 159 of the interlock tabs 116, 117, respectively. Referring to FIG. 29, an interlock gap 242, 243 can be defined between the inner lateral surfaces 158, 159 and the interlock exterior recess surfaces 234, 235. When the mounting nose 206 is positioned within the coupler pocket 114, the tab transition point 166, 167 can be offset from the recess transition point 240, 241 along the longitudinal axis 85. In some embodiments, the tab transition point 166, 167 of each inner lateral surface 158, 159 can be disposed a first distance from the ground engaging portion 110 of the ground engaging tip 100, and the recess transition point 240, 241 can be disposed at a second distance from the ground engaging portion of the ground engaging tip. In some embodiments, the first distance can be less than the second distance. In other words, in some embodiments, the tab transition point 166, 167 can be nearer the ground engaging portion 110 of the ground engaging tip 100 than the recess transition point 240, 241.

FIG. 29 shows the interface between the inner lateral surface 159 of one of the interlock tabs 117 and the interlock exterior recess surface 235 on one side of the coupler 200 when the GET assembly 70 is in the nominal position. As discussed above, the nominal position can be defined as a position wherein no substantial external forces can act upon the ground engaging tip 100, the coupler 200, or the GET assembly 70 as a whole. The inner lateral surface 159 can have an inner interlock tab contour profile, and the interlock exterior recess surface 235 can have a recess contour profile. In embodiments, the inner interlock tab contour profile can be non-complementary to the recess contour profile. In such embodiments, the inner lateral surface 159 of the interlock tab 117 and the interlock exterior recess surface 235 of the coupler 200 can be in substantially non-parallel relationship with respect to each other when the ground engaging tip 100 is in the nominal position. Therefore, in some embodiments, the interlock gap 243 can have a variable, non-uniform width along the length of the interface between the interlock exterior recess surface 235 and the inner lateral surface 159 of the interlock tab 117. In some embodiments, in the nominal position, the offset angle of the interlock exterior recess surface 235 can be open relative to the inner lateral surface 159. In a particular embodiment, the offset angle of the interlock exterior recess surface 235 can be about 3 degrees open relative to the inner lateral surface 159.

Figure 30:
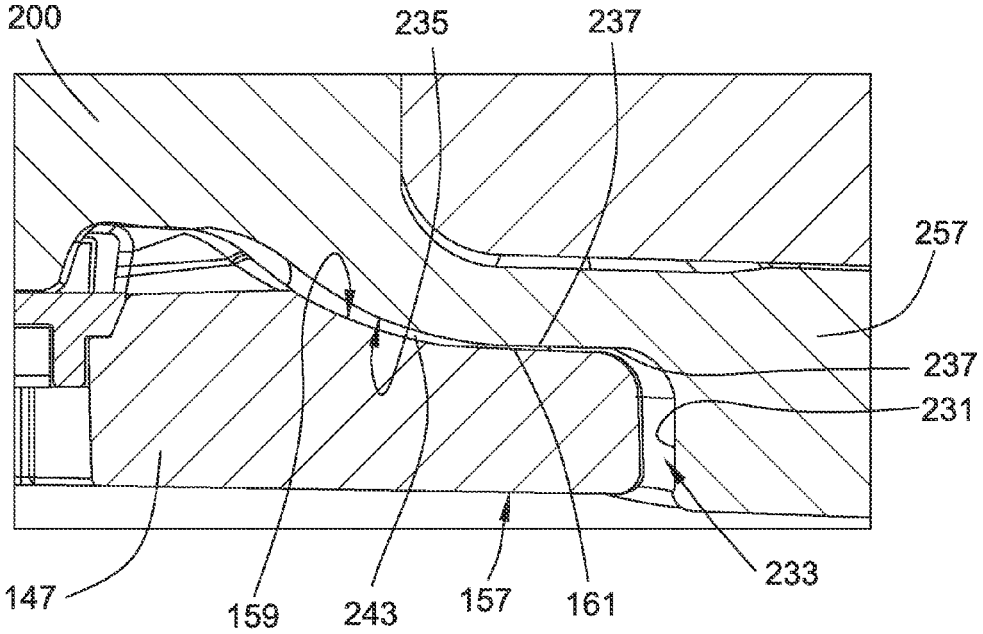
FIG. 30 is a view as in FIG. 29, but illustrating the GET assembly of FIG. 5 in a maximum side rotated position.

The coupler 200 can be pivotally mounted to the ground engaging tip 100 such that the ground engaging tip can be rotatable with respect to the coupler about lateral axis 75. When the ground engaging tip 100 can be subjected to forces along the lateral axis 75, such as forces against the tip side walls 113, 115, the ground engaging tip can rotate with respect to the coupler 200 about the normal axis 80 over a range of travel between the nominal position and a maximum side rotated position. The ground engaging tip 100 can reach the maximum side rotated position when the ground engaging tip rotates to a position in which the interior surface 118 along one of the side walls 126, 128 of the ground engaging tip contacts one of the side surfaces of the mounting nose 206 (not shown). The offset angle and non-parallel relationship between the inner lateral surface 159 and the interlock exterior recess surface 235 can allow the interlock gap 243 to be maintained when the ground engaging tip 100 experiences loads along the lateral axis 75. FIG. 30 shows the interface between the inner lateral surface 159 of one of the interlock tabs 117 and the interlock exterior recess surface 235 on one side of the coupler 200 when the ground engaging tip 100 is under a load along the lateral axis 75 in the maximum side rotated position. As illustrated in FIG. 29 (nominal position) and FIG. 30 (maximum side rotated position), the interlock tab 117 and the interlock exterior recess surface 235 can be in spaced, non-contacting relationship over the entire range of travel between the nominal position and the maximum side rotated position.

As shown in FIG. 30, in some embodiments, the proximal planar portion 161 of the inner lateral surface 159 and recess planar portion 237 of the interlock exterior recess surface 235 can be in substantially parallel relationship with respect to each other when the ground engaging tip 100 is in the maximum side rotated position. The interlock gap 243 can have a nominal width in the nominal position and a lateral rotated width in the maximum side rotated position. In some embodiments, the nominal width of the interlock gap 243 can be greater than the lateral rotated width of the interlock gap. In a particular embodiment, the lateral rotated width of the interlock gap 242, 243 when the ground engaging tip 100 is in the maximum side rotated position can be greater than zero.

In some embodiments, the radius of the concave portion 162, 163 of each of the interlock tabs 116, 117 can be substantially equal to the radius of the recess convex portion 238, 239 of each of the interlock exterior recess surfaces 234, 235. In other embodiments, the radius of the concave portion 162, 163 of each of the interlock tabs 116, 117 can be different than the radius of the recess convex portion 238, 239 of each of the interlock exterior recess surfaces 234, 235. As shown, in some embodiments, even when the ground engaging tip 100 can be rotated no further relative to the coupler 200, the interlock gap 243 can span the entire length of the interface between the inner lateral surface 159 and the interlock exterior recess surface 235. In such embodiments, the inner lateral surface 159 of the interlock tab 117 does not contact the coupler 200 under side loads and, therefore, the interlock tabs 116, 117 are not subjected to lateral stresses under side loads. Instead, the lateral stresses felt by the ground engaging tip 100 under side loads can be distributed to the side walls 126, 128 of the coupler pocket 114.

In some embodiments, as shown in FIG. 24, the side walls 126, 128 or the ground engaging tip 100 can be substantially wider as measured along the lateral axis 75 than the interlock tabs 116, 117. Additionally, the interlock tabs 116, 117 can be cantilevered away from the ground engaging tip 100, while the side walls 126, 128 can distribute stresses to the first and second coupler face walls 122, 124 of the coupler pocket 114. Therefore, distributing stresses from lateral loads into the side walls 126, 128 rather than the interlock tabs 116, 117 can be desirable because the chance of part failure due to the lateral loads can be reduced.

In some embodiments, the ground engaging tip 100 can be pivotally mounted to the coupler 200 such that the ground engaging tip can be rotatable with respect to the coupler over a range of travel between a nominal position and a maximum side rotated position. The ground engaging tip 100 can have an interlock tab 116, 117 that that can be in overlapping relationship with the coupler 200. In such embodiments, the interlock tab 116, 117 and the coupler 200 can be in spaced, non-contacting relationship over the range of travel between the nominal position and the maximum side rotated position.

Figure 33:
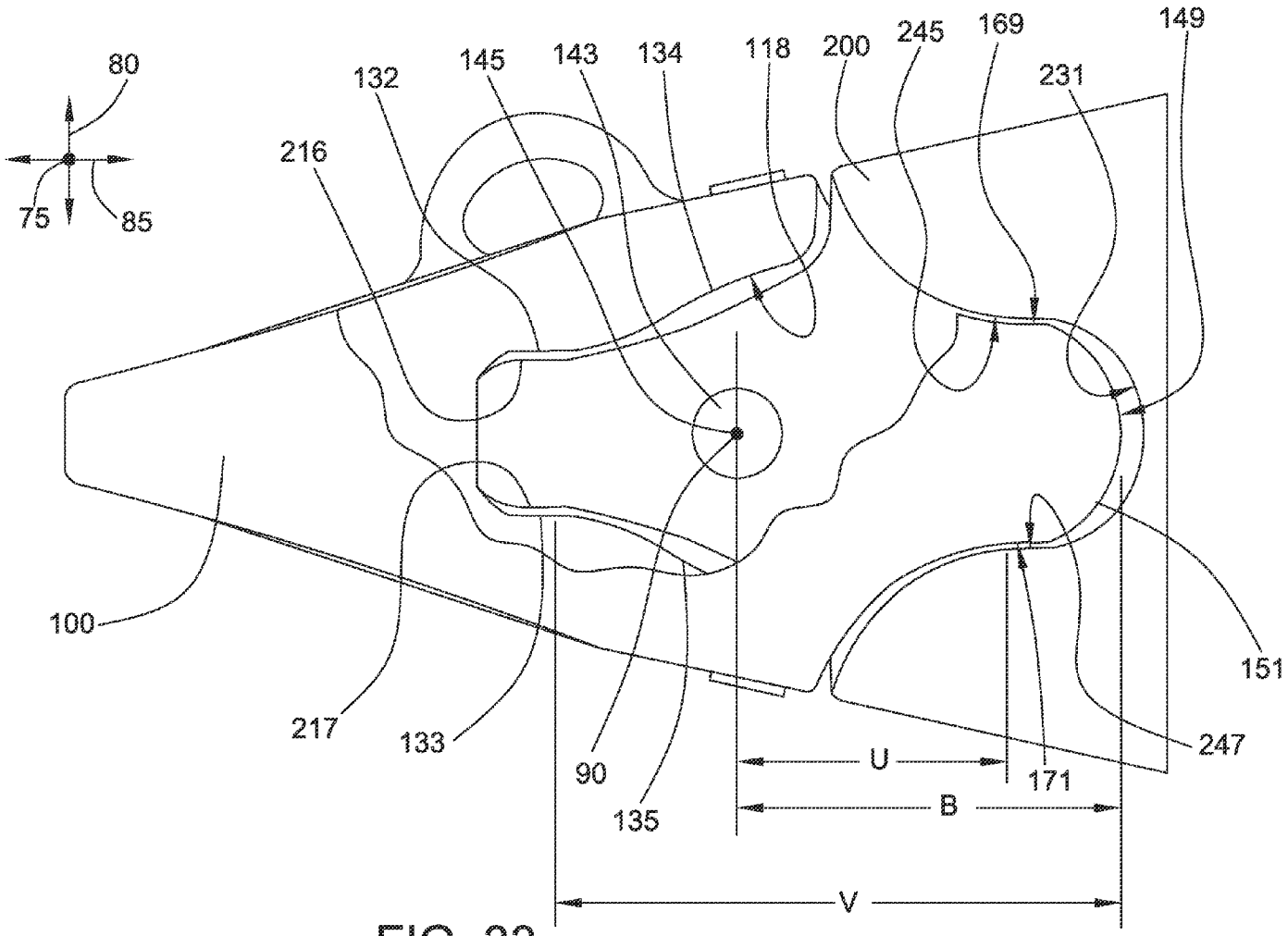
FIG. 33 is a view as in FIG. 32, but partially broken away to illustrate the tip mounting portion of the coupler disposed in a coupler pocket defined by the ground engaging tip in a nominal position.

Referring to FIG. 33, the coupler 200 can be mounted to the ground engaging tip 100 such that the interlock tabs 116, 117 of the ground engaging tip can be disposed within the interlock recesses 232, 233. The interlock collars 230, 231 of the coupler can be positioned along the curved terminal edges 150, 151 of the proximal ends 148, 149 of the interlock tabs 116, 117 such that the interlock recesses 232, 233 receive the interlock tabs. In a nominal position, a collar gap 248 can be defined between the interlock tabs 116, 117 and the interlock collars 230, 231. In some embodiments, the radius of curvature of the curved interlock collars 230, 231 can be substantially equal to the radius of curvature of the curved terminal edges 150, 151 of the interlock tabs 116, 117. Another longitudinal distance V can be measured along the longitudinal axis 85 between the first and second interlock contact surfaces 245, 247 and the planar portion 132, 133 of the coupler pocket 114. In some embodiments, the longitudinal distance B, measured along the longitudinal axis 85 between the center 144, 145 of the retention orifice 142, 143 and the proximal end 148, 149 of the interlock tabs 116, 117, can be greater than the longitudinal distance U. In some embodiments, a ratio between the longitudinal distance B and the longitudinal distance U can be in a range between about 1:1 and about 2:1, or can be in a range between about 1:1 and about 3:2 in other embodiments. In some embodiments, the longitudinal distance B can be less than the longitudinal distance V measured along the longitudinal axis 85. In some embodiments, a ratio between the longitudinal distance B and the longitudinal distance V can be in a range between about 1:4 and about 3:4, with a particular embodiment having a ratio of about 55:117. In a particular embodiment, a ratio of the longitudinal distance B to the longitudinal distance U can be about 17:11.

The ground engaging tip 100 can be pivotally mounted to the coupler 200 such that the ground engaging tip can be rotatable with respect to the coupler about the lateral axis 75 over a range of travel between a nominal position and a maximum rotated pitch position. In the nominal position, such as shown in FIG. 31 or FIG. 33, both the distal planar portion 132, 133 and the curved portion 134, 135 of the interior surface 118 of the coupler pocket 114 can be in non-contacting relationship with the first or second exterior surfaces 210, 211 of the mounting nose 206. When a force from a load acts substantially perpendicular to the lateral axis 75 on the ground engaging tip 100, such as force F shown in FIG. 32, the ground engaging tip can rotate about the retention axis 90 with respect to the coupler 200 from the nominal position into the maximum rotated pitch position. In the maximum rotated pitch position, the distal planar portion 132, 133 of the ground engaging tip 100 can be in contacting relationship with one of the first planar portions 216, 217 of the coupler 200 at a contact point along the distal planar portion. Over the entire range of travel, however, the curved portion 134, 135 of both the first coupler face wall 122 and the second coupler face wall 124 remain in non-contacting, spaced relationship with the coupler 200. In such embodiments, the mounting nose 206 can experience the effect of a force acting upon the ground engaging tip 100 along the normal axis 80 when the ground engaging tip can be rotated into the maximum rotated pitch position.

In some embodiments, the ground engaging tip 100 can be movably connected to the coupler 200. The ground engaging tip 100 can define the coupler pocket 114 that can be adapted to receive the coupler 200 The coupler pocket 114 can be defined by at least one coupler face wall 124, 126 that includes a distal planar portion 132, 133 and a curved portion 134, 135. In such embodiments, the ground engaging tip 100 can be movable with respect to the coupler 200 over a range of travel between the nominal position and the maximum rotated pitch position. Over the range of travel between the nominal position and the maximum rotated pitch position, the curved portion 134, 135 of the at least one coupler face wall 124, 126 can be in non-contacting, spaced relationship with the coupler 200.

In some embodiments, under a load substantially perpendicular to the retention axis 90, the ground engaging tip 100 can contact the mounting nose 206 at a contact point along the distal planar portion 132, and the ground engaging tip can rotate about the contact point about the lateral axis 75 until the first tab contact surface 168, 169 of each interlock tab 116, 117 contacts the respective first interlock contact surface 244, 245 on the coupler 200. When the first tab contact surface 168, 169 contacts the first interlock contact surface 244, 245, the ground engaging tip 100 can stop rotating and can be in a maximum rotated pitch position with respect to the coupler 200. In the maximum rotated pitch position, one of the distal planar portions 132, 133 of the interior surface 118 of the coupler pocket 114 can be in a contacting relationship with one of the first planar nose portions 216, 217. Although not shown, the ground engaging tip 100 can react in a similar, but opposite, manner if a force acts on the ground engaging tip 100 along the normal axis 80 in the opposite direction as force F. In such a case, the ground engaging tip can rotate slightly with respect to the coupler 200 until the distal planar portion 133 of the interior surface 118 of the coupler pocket 114 contacts the first planar nose portion 217 of the mounting nose 206. Although not shown in contact, the interface between the distal planar portion 133 and the first planar nose portion 217 is shown in FIG. 28 and FIG. 33. Once the ground engaging tip 100 contacts the mounting nose 206 at the distal planar portion 133, the ground engaging tip can rotate about the contact point on the first planar nose portion 217 (clockwise as viewed in FIGS. 32-33) until the second tab contact surface 170, 171 of each interlock tab 116, 117 contacts the respective second interlock contact surface 246, 247 on the coupler 200. When the second tab contact surface 170, 171 contacts the second interlock contact surface 246, 247, the ground engaging tip 100 can stop rotating in a maximum rotated pitch position with respect to the coupler 200. Under either force along the normal axis 80, the mounting nose 206 can experience the effect of the force when distal planar portion 132, 133 of the interior surface 118 of the coupler pocket 114 contacts the respective first planar nose portion 216, 217 of the mounting nose 206 at a contact point.

In some embodiments, the ground engaging tip 100 can be rotatable with respect to the coupler 200 over a range of travel about the retention axis 90, and the interlock recess 232, 233 can have a shape complementary to the curved terminal edge 150, 151 of the interlock tab 116, 117 such that the curved terminal edge can be in non-interfering relationship with the interlock collar over the range of travel between the nominal position and a maximum rotated pitch position.

In some embodiments, the ground engaging tip 100 can be rotatable with respect to the coupler 200 over a range of travel about the retention axis. Since the interlock tabs 116, 117 can be disposed within the interlock recess 232, 233 of the respective interlock collar 230, 231 and the interlock recesses can have a shape complementary to the curved terminal edge 150, 151 of the interlock tabs, the curved terminal edge of the interlock tab can be in a non-interfering relationship with the curved interlock collar over the range of travel.

Figure 32:
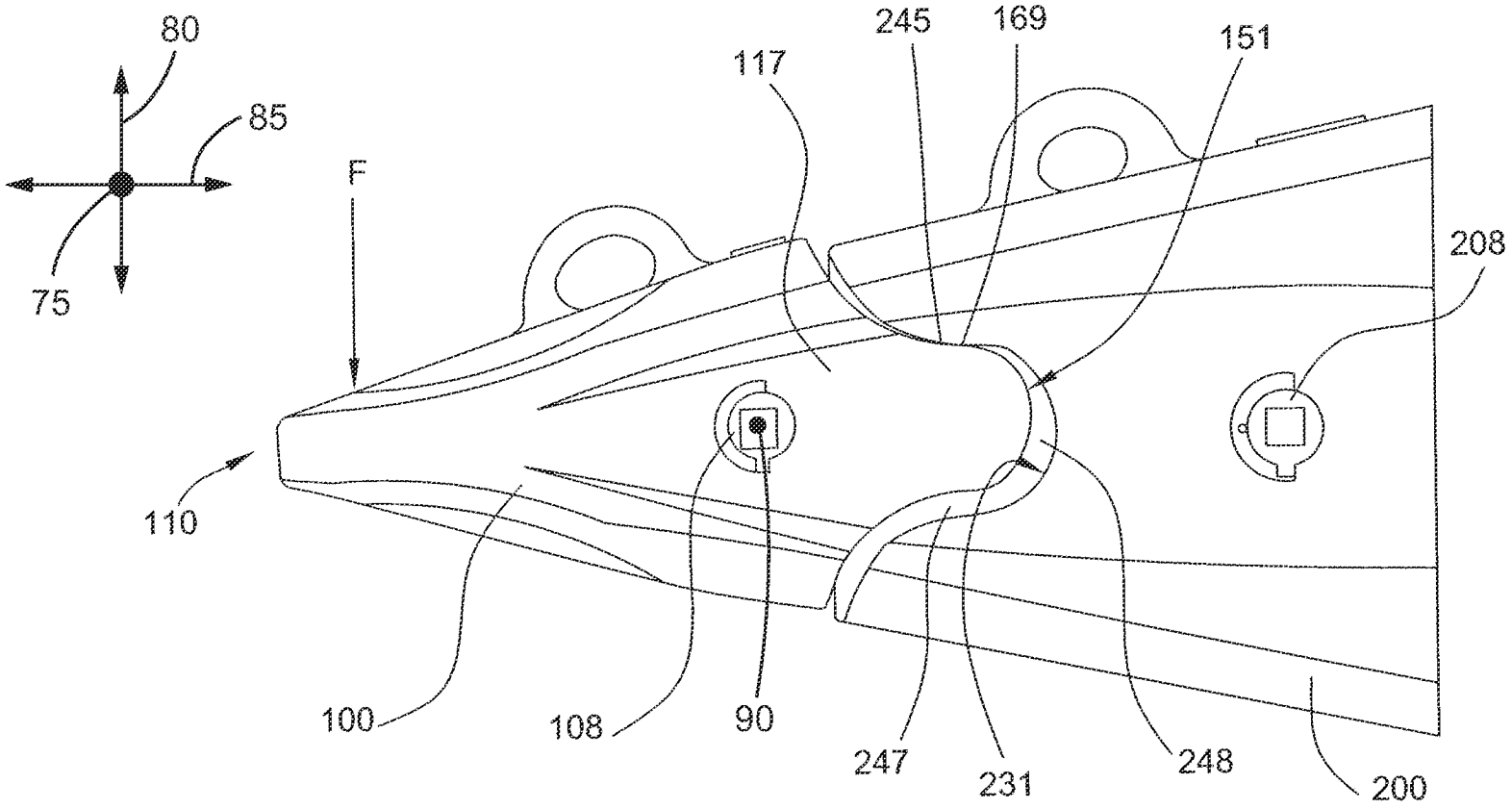
FIG. 32 is an enlarged, fragmentary side elevational view of the GET assembly of FIG. 5, illustrating the ground engaging tip in a maximum rotated pitch position.

In embodiments, the ground engaging tip 100 can have no more than three concurrent points of contact with the coupler 200 when subjected to loads along the normal axis 80. In a load along the normal axis 80, as shown in FIG. 32, the ground engaging tip 100 can contact the coupler 200 at only the distal planar portion 132 of the interior surface 118 of the coupler pocket 114 and one or both of the first tab contact surfaces 168, 169 of the interlock tabs 116, 117. In certain applications and certain embodiments, it is contemplated that only one of the two first tab contact surfaces 168, 169 contacts the coupler 200 under load. In embodiments, under a load along the normal axis 80, the ground engaging tip 100 can contacts the coupler 200 at only the distal planar portion 133 of the interior surface 118 of the coupler pocket 114 and at least one of the second tab contact surfaces 170, 171 of the interlock tabs 116, 117.

Various methods of assembling the ground engaging tool assembly 70 are disclosed herein. One method can include providing a ground engaging tip 100 that can include a ground engaging portion 110 and a coupling portion 112 extending along the longitudinal axis 85. The coupling portion 112 can have an interior surface 118 that defines a coupler pocket 114. The coupler pocket 114 can have an opening 119 in communication with an interior cavity 121. The coupling portion 112 can also have an interlock tab 116, 117 extending along the longitudinal axis 85 in a direction away from the ground engaging portion 110. The interlock tab 116, 117 can also have an inner lateral surface 158, 159. The method also can include inserting a coupler 200 pivotally mounted to the ground engaging tip 100 such that the ground engaging tip can be rotatable with respect to the coupler about the lateral axis 75. The coupler 200 can have a mounting nose 206 adapted to fit within the coupler pocket 114, an interlock collar 230, 231, and an interlock exterior recess surface 234, 235 disposed between the interlock collar and the mounting nose. The interlock collar 230, 231 and the interlock exterior recess surface 234, 235 can define an interlock recess 232, 233. The interlock recess 232, 233 can be adapted to receive the interlock tab 116, 117 such that the inner lateral surface 158, 159 of the interlock tab and the interlock exterior recess surface 234, 235 can be in spaced relationship to each other to define an interlock gap 242, 243 therebetween. The ground engaging tip 100 can be rotatable with respect to the coupler about the normal axis 80 over a range of travel between a nominal position and a maximum side rotated position such that the interlock tab 116, 117 and the interlock exterior recess surface 234, 235 can be in spaced, non-contacting relationship over the range of travel between the nominal position and the maximum side rotated position.

Another method of assembling the ground engaging tool assembly 70 can include providing a ground engaging tip 100 with an interior surface 118 that can have a base wall 120, a first coupler face wall 122 and a second coupler face wall 124 in spaced relationship to the first coupler face wall. The first and second coupler face walls 122, 124 can be substantially symmetrical to each other with respect to a plane defined by the longitudinal axis 85 and the lateral axis 75. The first and second coupler face wall 122, 124 can extend along the longitudinal axis 85 from the base wall 120 to the opening 119 of the coupler pocket 114. The first and second coupler face wall 122, 124 can each include a distal planar portion 132, 133 adjacent the base wall 120, a first convex portion 136, 137 adjacent the distal planar portion, a concave portion 138, 139 adjacent the first convex portion, and a second convex portion 140, 143 adjacent the concave portion. The concave portion 138, 139 can be disposed between the first convex portion 136, 137 and the second convex portion 140, 141. The first and second face walls 122, 124 can define a first wall contour profile and a second wall contour profile, respectively. The method also involves mounting the coupler 200 to the ground engaging tip 100. The mounting nose 206 of the coupler 200 can include a first exterior surface 210 that defines a first face contour profile and a second exterior face surface 211 that defines a second face contour profile. The mounting nose 206 can be disposed within the coupler pocket 114 such that the first exterior face surface 210 can be adjacent the first coupler face wall 122 of the coupler pocket and the second exterior face surface 211 can be adjacent the second coupler face wall 124 of the coupler pocket. The first wall contour profile of the coupler pocket 114 can be non-complementary to the first face contour profile of the mounting nose 206, and the second wall contour profile of the coupler pocket can be non-complementary to the second face contour profile of the mounting nose.

Another method of assembling the ground engaging assembly 70 can include providing a ground engaging tip 100 with a ground engaging portion 110 in opposing relationship to a coupling portion 112. The coupling portion 112 can include a side wall 126, 128 and an interlock tab 116, 117. The side wall 126, 128 can at least partially define a coupler pocket 114. The interlock tab 116, 117 can have a base end 146, 147 and a proximal end 148, 149. The base end 146, 147 can be contiguous with the side wall 126, 128, and the interlock tab 116, 117 can extend from the base end to the proximal end 148, 149 in a direction substantially away from the ground engaging portion 110. The proximal end 148, 149 can include a perimeter with a curved terminal edge 150, 151. This method can include mounting a coupler 200 onto the ground engaging tip 100 such that a mounting nose 206 of the coupler can be disposed within the coupler pocket 114 and the interlock tab 116, 117 of the ground engaging tip can be disposed within an interlock recess 232, 233. The interlock recess 232, 233 can be defined by an interlock collar 230, 231 on a side of the coupler 200. The ground engaging tip 100 can be rotatable with respect to the coupler 200 over a range of travel about a retention axis 90, and the interlock recess 232, 233 can have a shape complementary to the curved terminal edge 150, 151 of the interlock tab 116, 117 such that the curved terminal edge of the interlock tab can be in non-interfering relationship with the interlock collar 230, 231 over the range of travel.

Another method of assembling the ground engaging tool assembly 70 can include providing a ground engaging tip 100 that can have a coupling portion 112 in opposing relationship to a ground engaging portion 110. The coupling portion 112 can include a side wall 126, 128, an interior surface 118, and an interlock tab 116, 117. The interior surface 118 can define a coupler pocket 114 having an opening 119 in communication with an interior cavity 121. The interior surface 118 can include a base wall 120 that, along with the side wall 126, 128, can at least partially define the coupler pocket 114. The interlock tab 116, 117 can have a base end 146, 147 and a proximal end 148, 149. The base end 146, 147 can be contiguous with the side wall 126, 128, and the interlock tab 116, 117 can extend from the base end to the proximal end in a direction substantially away from the ground engaging portion 110. The side wall 126, 128 can define a retention orifice 142, 143 having a center 144, 145. A ratio of a first longitudinal distance, measured along the longitudinal axis 85, from the center 144, 145 of the retention orifice 142, 143 to the base wall 146, 147 of the interior surface 118 and a second longitudinal distance, measured along the longitudinal axis, from the center of the retention orifice to the proximal end 148, 149 of the interlock tab 116 can be about 3:2 or less. This method also can include mounting the coupler 200 onto the ground engaging tip 100 such that a mounting nose 206 of the coupler can be within the coupler pocket 114 and the interlock tab 116, 117 of the ground engaging tip can be within an interlock recess 232, 233 defined by the interlock collar 230, 231 of the coupler. The method also can include securing the ground engaging tip 100 to the coupler 200 with a retention mechanism 108 disposed within the retention orifice 142, 143 of the coupling portion 112 of the ground engaging tip.

Another method of assembling the ground engaging tool assembly 70 can include providing a ground engaging tip 100 having a coupling portion 112 and a ground engaging portion 110 extending along a longitudinal axis 85. The coupling portion 112 can include an interior surface 118 defining a coupler pocket 114 having an opening 119 in communication with an internal cavity 121. The interior surface 118 can have a base wall 120, a first side wall 126 and a second side wall 128 in spaced relationship to each other and extending longitudinally from the base wall 120. The coupling portion 112 can also include a first coupler face wall 122 and a second coupler face wall 124 in spaced relationship to each other and extending longitudinally from the base wall 120 and extending between the first side wall 126 and the second side wall 128. The first and second coupler side walls 124, 126 can each have a planar portion 132, 133 and a curved portion 134, 135. The planar portion 132, 133 can be disposed adjacent the base wall 120 and the curved portion 134, 135 can be disposed adjacent the opening 119 of the coupler pocket 114. The method also can include pivotally connecting the coupler 200 to the ground engaging tip 100 such that the ground engaging tip can be movable with respect to the coupler over a range of travel about a retention axis 90 between a nominal position and a maximum rotated pitch position. A mounting nose 206 of the coupler 200 can have a first exterior face surface 210 and a second exterior face surface 211 in opposing relationship to the first exterior face surface. The mounting nose 206 can be disposed within the coupler pocket 114 such that the first exterior face surface 210 and the second exterior face surface 211 can be respectively adjacent the first coupler face wall 122 and the second coupler face wall 1242 of the ground engaging tip 100. In this method, over the range of travel between the nominal position and the maximum rotated pitch position, the curved portion 134, 135 of both the first coupler face wall 122 and the second coupler face wall 124 can be in non-contacting, spaced relationship with the coupler 200.

In another method of assembling the ground engaging tool assembly 70, the coupler 200 can have a tip mounting portion 202 and an implement mounting portion 204 in opposing relationship to the tip mounting portion along the longitudinal axis 85. The implement mounting portion 204 can define an implement pocket 250 having an opening 253 in communication with an internal cavity 255. The implement pocket 250 can be defined, at least in part, by a central wall 252 having an abutment surface 254, a coupler side wall 256, 257 having a distal end 266, 267 disposed adjacent the central wall and a proximal end 268, 269 in opposing relationship to the distal end along the longitudinal axis 85. The side wall 256, 257 can have a side interior surface 262, 263 facing the implement pocket 250 and adjacent the abutment surface 254. The side interior surface 262, 263 can define a recessed portion 264, 265 adjacent the abutment surface 254. The recessed portion 264, 265 can be offset laterally outward of the side interior surface 262, 263 along the lateral axis 75. The coupler side wall 256, 257 can also have a base portion 272, 273 disposed at the proximal end 268, 269 of the coupler side wall with a base exterior surface 274, 275. The base portion 172, 273 can have a width measured along the lateral axis 75 between the side interior surface 262, 263 and the base exterior surface 274, 275. The coupler side wall 256, 257 can also have an interlock portion 270, 271 at the distal end 266, 267 of the coupler side wall and can have an interlock exterior recess surface 234, 235. The interlock portion 270, 271 can have width measured along the lateral axis 75 between the side interior surface 262, 263 at the recessed portion 264, 265 and the interlock exterior recess surface 234, 235. The base portion 272 can have a width that can be greater than the interlock portion 270, 271 width. The recessed portion 264, 265 of the side interior surface 262, 263 can extend along the longitudinal axis 85 substantially between the abutment surface 254 and a transition surface 276, 277 of the base portion 272, 273, thereby substantially spanning the interlock portion 270, 271 of the coupler side wall 256, 257. The method can also involve mounting an implement mounting nose 300 to the coupler 200 such that the implement mounting nose fits within the implement pocket 250 of the coupler. An exterior nose surface 304 of the implement mounting nose 300 can be disposed adjacent the side interior surface 262, 263 of the coupler 200, defining a gap 350 between the exterior nose surface and the side interior surface. The coupler 200 can be rotatable with respect to the implement mounting nose 300 about the normal axis 80 over a range of travel between a nominal position and a maximum side rotated position. The exterior nose surface 304 can be in contacting relationship with the base portion 272, 273 of the coupler side wall 262, 263 at a location between the transition surface 276, 277 and the proximal end 268, 269 when the coupler 200 is in the maximum side rotated position. Additionally, the exterior nose surface 304 and the recessed portion 264, 265 of the side interior surface 262, 263 can be in spaced, non-contacting relationship over the range of travel between the nominal position and the side maximum rotated position.

One embodiment of the present disclosure includes ground engaging tip can comprise a ground engaging portion and a coupling portion. The coupling portion can be in opposing relationship to the ground engaging portion along a longitudinal axis thereof. The coupling portion can include an interior surface defining a coupler pocket, and an interlock tab extending along the longitudinal axis in a direction substantially away from the ground engaging portion. The interlock tab can terminate at a proximal end and the interlock tab can have an outer lateral surface and an inner lateral surface. The inner lateral surface can have a proximal planar portion and a concave portion. The proximal end of the interlock tab can have a proximal end width measured along a lateral axis, which can be substantially perpendicular to the longitudinal axis, between the outer lateral surface and the proximal planar portion of the inner lateral surface. The concave portion can have a radius of curvature that can be greater than the proximal end width of the proximal end.

Another embodiment of a ground engaging tool system can comprise a ground engaging tip including a ground engaging portion and a coupling portion. The ground engaging portion and the coupling portion can extend along a longitudinal axis. The coupling portion can have an interior surface defining a coupler pocket, and an interlock tab extending along the longitudinal axis in a direction away from the ground engaging portion. The interlock tab can have an inner lateral surface The ground engaging tool system can also have a coupler pivotally mounted to the ground engaging tip such that the ground engaging tip can be rotatable with respect to the coupler about a lateral axis, which is substantially perpendicular to the longitudinal axis. The coupler can have a mounting nose adapted to fit within the coupler pocket, an interlock collar, and an interlock exterior recess surface disposed between the interlock collar and the mounting nose. The interlock collar and the interlock exterior recess surface can define an interlock recess. The interlock recess can be adapted to receive the interlock tab such that the inner lateral surface of the interlock tab and the interlock exterior recess surface of the coupler can be disposed in spaced relationship to each other to define an interlock gap therebetween. The ground engaging tip can be rotatable with respect to the coupler about a normal axis, which is substantially perpendicular to the longitudinal axis and the lateral axis, over a range of travel between a nominal position and a maximum side rotated position such that the interlock tab and the interlock exterior recess surface can be in a spaced, non-contacting relationship over the range of travel between the nominal position and the maximum side rotated position.

In another embodiment, the ground engaging tool system can comprise a coupler and a ground engaging tip pivotally mounted to the coupler such that the ground engaging tip is rotatable with respect to the coupler over a range of travel between a nominal position and a maximum side rotated position. The ground engaging tip can have an interlock tab that can be in overlapping relationship with the coupler. The interlock tab and the coupler can be in spaced, non-contacting relationship over the range of travel between the nominal position and the maximum side rotated position.

In another embodiment, a coupler can comprise a tip mounting portion and an implement mounting portion in opposing relationship to the tip mounting portion along a longitudinal axis. The implement mounting portion can define an implement pocket, and the implement pocket can be defined, at least in part, by a central wall having an abutment surface, and a coupler side wall having a distal end disposed adjacent the central wall and a proximal end in opposing relationship to the distal end along the longitudinal axis. The side wall can have a side interior surface facing the implement pocket and adjacent the abutment surface. The side interior surface can define a recessed portion adjacent the abutment surface. The recessed portion can be offset laterally outward of the side interior surface along a lateral axis, which is substantially perpendicular to the longitudinal axis. The side wall can also have a base portion disposed at the proximal end of the coupler side wall that can have a base exterior surface and a base portion width that can be measured along the lateral axis between the side interior surface and the base exterior surface. The side wall can also have an interlock portion disposed at a distal end of the coupler side wall that can have an interlock exterior recess surface and an interlock portion width that can be measured along the lateral axis between the side interior surface at the recessed portion and the interlock exterior recess surface. The base portion width can be greater than the interlock portion width. The recessed portion of the side interior surface can extend along the longitudinal axis substantially between the abutment surface and a transition surface of the base portion of the coupler side wall, thereby substantially spanning the interlock portion of the coupler side wall.

In another embodiment, the ground engaging tool coupling system can comprise a coupler that can have a tip mounting portion and an implement mounting portion in opposing relationship to the tip mounting portion along a longitudinal axis. The implement mounting portion can define an implement pocket. The implement pocket can be defined, at least in part, by a central wall having an abutment surface, and a coupler side wall that can have a distal end disposed adjacent the central wall and a proximal end in opposing relationship to the distal end along the longitudinal axis. The side wall can have a side interior surface that can face the implement pocket and be adjacent the abutment surface. The side interior surface can define a recessed portion adjacent the abutment surface, and the recessed portion can be offset laterally outward of the side interior surface along a lateral axis, which is substantially perpendicular to the longitudinal axis. The side wall can also have a base portion can be disposed at the proximal end of the coupler side wall and can have a base exterior surface and a base portion width measured along the lateral axis between the side interior surface and the base exterior surface. The side wall can also have an interlock portion disposed at the distal end of the coupler side wall. The interlock portion can have an interlock exterior recess surface and an interlock portion width that can be measured along the lateral axis between the side interior surface at the recessed portion and the interlock exterior recess surface. The base portion width can be greater than the interlock portion width, and the recessed portion of the side interior surface can extend along the longitudinal axis substantially from the abutment surface and a transition surface of the base portion of the coupler side wall, thereby substantially spanning the interlock portion of the coupler side wall. The ground engaging tool coupling system can also comprise an implement mounting nose mounted to the coupler such that the implement mounting nose can be disposed within the implement pocket of the coupler. The implement mounting nose can have an exterior nose surface that can be disposed adjacent the side interior surface of the coupler and can define a gap therebetween. The coupler can be rotatable with respect to the implement mounting nose about a normal axis, the normal axis being substantially perpendicular to the longitudinal axis and the lateral axis, over a range of travel between a nominal position and a maximum side rotated position. The exterior nose surface can be in contacting relationship with the base portion of the coupler side wall at a location between the transition surface and the proximal end when the coupler is in the maximum side rotated position. The exterior nose surface and the recessed portion of the side interior surface can be in spaced, non-contacting relationship over the range of travel between the nominal position and the side maximum rotated position.

In another embodiment, the coupler can comprise a tip mounting portion and an implement mounting portion in opposing relationship to the tip mounting portion. The implement mounting portion can define an implement pocket that can have an opening in communication with an interior cavity. The implement pocket can flare laterally outward nearest the tip mounting portion such that the implement pocket can have a lateral cavity width at the interior cavity that is greater than a lateral opening width at the opening.

In another embodiment, the ground engaging tip can comprise a ground engaging portion and a coupling portion in opposing relationship to the ground engaging portion along a longitudinal axis thereof. The coupling portion can include an interior surface that can include a coupler pocket having an opening in communication with an interior cavity. The interior surface can have a base wall, a first coupler face wall, and a second coupler face wall. The first coupler face wall can be in spaced relationship to the second coupler face wall. The first coupler face wall and the second coupler face wall can each extend along the longitudinal axis from the base wall to the opening of the coupler pocket. The first coupler face wall and the second coupler face wall can each include a distal planar portion respectively adjacent the base wall. The first coupler face wall and the second coupler face wall can each include a first convex portion respectively adjacent the distal planar portion, a concave portion respectively adjacent the first convex portion, and a second convex portion respectively adjacent the first concave portion such that the concave portion can be disposed between the first convex portion and the second convex portion.

In another embodiment, the ground engaging tool system can comprise a ground engaging tip that can include a ground engaging portion and a coupling portion in opposing relationship to the ground engaging portion along a longitudinal axis thereof. The coupling portion can include an interior surface that can define a coupler pocket that can have an opening in communication with an interior cavity. The interior surface can have a base wall, a first coupler face wall, and a second coupler face wall. The first coupler face wall can be in spaced relationship to the second coupler face wall. The first coupler face wall and the second coupler face wall can each extend along the longitudinal axis from the base wall to the opening of the coupler pocket. The first coupler face wall and the second coupler face wall can each include a distal planar portion respectively adjacent the base wall. The first coupler face wall can define a first wall contour profile and the second coupler face wall can define a second wall contour profile. The ground engaging tool system can also include a coupler that can be mounted to the ground engaging tip. The coupler can have a mounting nose adapted to fit within the coupler pocket. The mounting nose can include a first exterior face surface that can define a first face contour profile and a second exterior face surface can define a second face contour profile. The mounting nose can be disposed within the coupler pocket such that the first exterior face surface can be adjacent the first coupler face wall of the coupler pocket and the second exterior face surface can be adjacent the second coupler face wall of the coupler pocket. The first wall contour profile of the coupler pocket can be non-complementary to the first face contour profile of the mounting nose, and the second wall contour profile of the coupler pocket can be non-complementary to the second face contour profile of the mounting nose.

In another embodiment, the ground engaging tool system can include a ground engaging tip that can define a coupler pocket that can have at least one coupler face wall that can define a wall contour profile. The ground engaging tool system can also include a coupler mounted to the ground engaging tip. The coupler can include at least one exterior face surface that can define a face contour profile. The coupler can be disposed within the coupler pocket such that the at least one exterior face surface can be adjacent the at least one coupler face wall. The wall contour profile can be non-complementary to the face contour profile.

In another embodiment, the ground engaging tool system can include a ground engaging tip that can have a ground engaging portion and a coupling portion in opposing relationship to the ground engaging portion. The coupling portion can include a side wall and an interlock tab. The side wall can at least partially define a coupler pocket. The interlock tab can have a base end and a proximal end. The base end of the interlock tab can be contiguous with the side wall, and the interlock tab can extend from the base end to the proximal end in a direction substantially away from the ground engaging portion, wherein the proximal end can include a perimeter with a curved terminal edge.

In some embodiments, the ground engaging tool system can comprise a ground engaging tip including a ground engaging portion and a coupling portion in opposing relationship to the ground engaging portion. The coupling portion can include a side wall and an interlock tab. The side wall can at least partially define a coupler pocket. The interlock tab can have a base end and a proximal end. The base end of the interlock tab can be contiguous with the side wall, and the interlock tab can extend from the base end to the proximal end in a direction substantially away from the ground engaging portion, wherein the proximal end includes a perimeter with a curved terminal edge. The ground engaging tool system can also have a coupler that can have a mounting nose and an interlock collar defining an interlock recess. The coupler can be mounted to the ground engaging tip such that the mounting nose of the coupler can be disposed within the coupler pocket of the ground engaging tip and the interlock tab of the ground engaging tip can be disposed within the interlock recess. The ground engaging tip can be rotatable with respect to the coupler over a range of travel about a retention axis, and the interlock recess having a shape complementary to the curved terminal edge of the interlock tab such that the curved terminal edge of the interlock tab can be in non-interfering relationship with the interlock collar over the range of travel.

In another embodiment, the ground engaging tip can comprise a ground engaging portion and a coupling portion. The coupling portion can be in opposing relationship to the ground engaging portion. The ground engaging portion can include an interlock tab that can extend in a direction substantially away from the ground engaging portion to a proximal end, wherein the proximal end can include a perimeter with a curved terminal edge.

In some embodiments, the ground engaging tip can comprise a ground engaging portion and a coupling portion in opposing relationship to the ground engaging portion along a longitudinal axis thereof. The coupling portion can include an interior surface, a side wall, and an interlock tab. The interior surface can define a coupler pocket and have a base wall. The side wall and the base wall can at least partially define the coupler pocket. The interlock tab can have a base end and a proximal end. The base end of the interlock tab can be contiguous with the side wall, and the interlock tab can extend from the base end to the proximal end in a direction substantially away from the ground engaging portion. The sidewall can define a retention orifice having a center. A ratio of a first longitudinal distance, that can be measured along the longitudinal axis, from the center of the retention orifice to the base wall of the interior surface and a second longitudinal distance, that can be measured along the longitudinal axis, from the center of the retention orifice to the proximal end of the interlock tab can be about 3:2 or less.

In other embodiments, the ground engaging tool system can comprise a ground engaging tip that can include a ground engaging portion and a coupling portion in opposing relationship to the ground engaging portion along a longitudinal axis thereof. The coupling portion can include an interior surface, a side wall, and an interlock tab. The interior surface can define a coupler pocket that can have an opening in communication with an interior cavity. The interior surface can have a base wall. The side wall and the base wall can at least partially define the coupler pocket, and the interlock tab can have a base end and a proximal end. The base end of the interlock tab can be contiguous with the side wall, the interlock tab extending from the base end to the proximal end in a direction substantially away from the ground engaging portion. The sidewall can define a retention orifice having a center. A ratio of a first longitudinal distance, that can be measured along the longitudinal axis, from the center of the retention orifice to the base wall and a second longitudinal distance, that can be measured along the longitudinal axis, from the center of the retention orifice to the proximal end of the interlock tab can be about 3:2 or less. The ground engaging tool system can have a coupler that can have a mounting nose and an interlock collar defining an interlock recess. The coupler can be mounted to the ground engaging tip such that the mounting nose of the coupler can be disposed within the coupler pocket and the interlock tab of the ground engaging tip can be disposed within the interlock recess. A retention mechanism can be disposed within the retention orifice and can be adapted to secure the ground engaging tip to the coupler.

In another embodiment, the ground engaging tip can comprise a base wall and a side wall that can at least partially defining a coupler pocket. An interlock tab can extend from the side wall to a proximal end in a direction substantially away from the base wall. The side wall can define a retention orifice disposed substantially longitudinally midway between the proximal end of the interlock tab and the base wall.

In another embodiment, the ground engaging tool system can comprise a ground engaging tip that can have a coupling portion and a ground engaging portion, the ground engaging portion and the coupling portion extending along a longitudinal axis. The coupling portion can include an interior surface that can define a coupler pocket having an opening. The interior surface can have a base wall, a first side wall and a second side wall in spaced relationship to each other and extending longitudinally from the base wall. The coupling portion can also define a first coupler face wall and a second coupler face wall in spaced relationship to each other and can extend longitudinally from the base wall and can extend between the first side wall and the second side wall. The first coupler face wall and the second coupler face wall can each have a planar portion and a curved portion. The planar portion can be disposed adjacent to the base wall, and the curved portion adjacent the opening of the coupler pocket. The ground engaging tool system can also include a coupler pivotally that can be pivotally connected to the ground engaging tip such that the ground engaging tip is movable with respect to the coupler over a range of travel about a retention axis between a nominal position and a maximum rotated pitch position. The coupler can include a mounting nose that can include a first exterior face surface and a second exterior face surface in opposing relationship to the first exterior face surface. The mounting nose can be disposed within the coupler pocket such that the first exterior face surface and the second exterior face surface can be respectively adjacent the first coupler face wall and the second coupler face wall of the ground engaging tip. Over the range of travel between the nominal position and the maximum rotated pitch position, the curved portion of both the first coupler face wall and the second coupler face wall can be in non-contacting, spaced relationship with the coupler.

In another embodiment, the ground engaging tool system can comprise a coupler and a ground engaging tip movably connected to the coupler. The ground engaging tip can define a coupler pocket adapted to receive the coupler. The coupler pocket can be defined by at least one coupler face wall that includes a distal portion and a curved portion. The ground engaging tip can be movable with respect to the coupler over a range of travel between a nominal position and a maximum rotated pitch position. Over the range of travel between the nominal position and the maximum rotated pitch position, the curved portion of the at least one coupler face wall can be in non-contacting, spaced relationship with the coupler.

In another embodiment, the ground engaging tool system can comprise a ground engaging tip having a coupling portion and a ground engaging portion. The ground engaging portion and the coupling portion can extend along a longitudinal axis. The coupling portion can include an interior surface and an interlock tab. The interior surface can define a coupler pocket that can have an opening in communication with an interior cavity. The interior surface can have a base wall, a first side wall and a second side wall in spaced relationship to each other and extending longitudinally from the base wall. The interior surface can also have a first coupler face wall and a second coupler face wall in spaced relationship to each other and can extend longitudinally from the base wall and can extend between the first side wall and the second side wall. The first coupler face wall and the second coupler face wall can each have a planar portion and a curved portion. The planar portion can be disposed adjacent to the base wall, and the curved portion can be adjacent the opening of the coupler pocket. The interlock tab can have a base end and a proximal end. The base end can be contiguous with one of the first side wall and the second side wall. The interlock tab can extend from the base end to the proximal end in a direction substantially away from the ground engaging portion, and the one of the first side wall and the second side wall which is contiguous with the interlock tab can define a retention orifice. The ground engaging tool system can also include a coupler pivotally connected to the ground engaging tip such that the ground engaging tip can be movable with respect to the coupler over a range of travel about a retention axis between a nominal position and a maximum rotated pitch position. The coupler can include a mounting nose that can include a first exterior face surface and a second exterior face surface in opposing relationship to the first exterior face surface. The mounting nose can be disposed within the coupler pocket such that the first exterior face surface and the second exterior face surface can be respectively adjacent the first coupler face wall and the second coupler face wall of the ground engaging tip. The ground engaging tool system can also include a retention mechanism disposed within the retention orifice and can be adapted to pivotally secure the ground engaging tip to the coupler. The retention mechanism can define the retention axis. Over the range of travel between the nominal position and the maximum rotated pitch position, the curved portion of both the first coupler face wall and the second coupler face wall can be in non-contacting, spaced relationship with the coupler. Under a load substantially perpendicular to the retention axis, the ground engaging tip can be adapted to contact the coupler at a contact point on at least the planar portion of one of the first coupler face wall and the second coupler face wall and to rotate about the contact point until the interlock tab contacts the coupler in the maximum rotated pitch position.

INDUSTRIAL APPLICABILITY

The industrial application of the GET assembly as described herein should be readily appreciated from the foregoing discussion. The present disclosure can be applicable to any machine utilizing an implement for digging, scraping, leveling, or any other suitable application involving engaging the ground or other work material. In machines used for such applications, ground engaging tools and tips can wear out quickly and require replacement.

The present disclosure, therefore, can be applicable to many different machines and environments. One exemplary use of the GET assembly of this disclosure can be in mining applications in which machine implements can be commonly used to scrape or dig various work materials including rock, gravel, sand, dirt, and others for protracted time periods and with little downtime. In such applications, replacement of ground engaging tools and tips can be expected, but it can be desirable to extend the life of such tools for as long as possible to limit machine downtime and replacement costs. The present disclosure has features, as discussed, which can reduce the probability of part failure and increase usable life of the ground engaging tools. Reducing part failure can increase machine uptime and save on costs of replacement parts.

Restricting points of contact to those discussed herein has been shown to have advantages over existing designs that use additional or alternative points of contact between the ground engaging tip and coupler. One example of an existing ground engaging tip contacts a coupler at two points within an interior surface of a coupler pocket, but does not contact the coupler at the interlock tabs. Finite element analyses have shown that a ground engaging tip 100 following principles of the present disclosure can reduce stress in the ground engaging tip under vertical load up to 50-60% as compared to the existing design having two points of contact within a coupler pocket. Thus, the reduced stress experienced by the disclosed ground engaging tip 100 provides advantages over existing designs as the frequency and probability of part failure can be reduced.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

What is claimed is:

1. A ground engaging tip comprising:

a ground engaging portion; and a coupling portion in opposing relationship to the ground engaging portion along a longitudinal axis thereof, the coupling portion including an interior surface, a side wall, and an interlock tab, the interior surface defining a coupler pocket, the interior surface having a base wall, the side wall and the base wall at least partially defining the coupler pocket, and the interlock tab having a base end and a proximal end, the base end of the interlock tab contiguous with the side wall, and the interlock tab extending from the base end to the proximal end in a direction substantially away from the ground engaging portion;

wherein the sidewall defines a retention orifice having a center, and a first longitudinal distance, measured along the longitudinal axis, from the center of the retention orifice to the base wall of the interior surface and a second longitudinal distance, measured along the longitudinal axis, from the center of the retention orifice to the proximal end of the interlock tab, wherein the first longitudinal distance is less than the second longitudinal distance; and wherein the interior surface further includes a coupler face wall extending along a normal axis away from the side wall, the normal axis being perpendicular to the longitudinal axis, the coupler face wall extends from the base wall away from the ground engaging portion and includes;

a distal planar portion respectively adjacent the base wall, a first convex portion respectively adjacent the distal planar portion, a concave portion respectively adjacent the first convex portion, and a second convex portion respectively adjacent the concave portion such that the concave portion is between the first and second convex portions.

2. The ground engaging tip of claim 1, wherein a ratio of the first longitudinal distance and the second longitudinal distance is in a range between about 1:3 about 1:2 and about 1:1.

3. The ground engaging tip of claim 1, wherein the retention orifice is disposed substantially longitudinally midway between the proximal end of the interlock tab and the base wall of the interior surface.

4. The ground engaging tip of claim 1, wherein the side wall and the interlock tab of the coupling portion comprise a first side wall and a first interlock tab, respectively, the coupling portion includes a second sidewall in spaced relationship to the first side wall, with the face wall therebetween, the second sidewall having a second interlock tab having a base end and a proximal end, the base end of the second interlock tab contiguous with the second side wall, the second side wall defining a second retention orifice with a center, and a ratio of a third longitudinal distance, measured along the longitudinal axis, from the center of the second retention orifice to the base wall and a fourth longitudinal distance, measured along the longitudinal axis, from the center of the second retention orifice to the proximal end of the second interlock tab being about 1:1 or less.

5. The ground engaging tip of claim 4, wherein a ratio of the second longitudinal distance between the center of the retention orifice of the first side wall and the proximal end of the first interlock tab to a fifth longitudinal distance, measured along the longitudinal axis, between the center of the retention orifice of the first side wall and the interlock ends of the first coupler face wall and the second coupler face wall and a ratio of the fourth longitudinal distance between the center of the retention orifice of the second side wall and the proximal end of the second interlock tab to the fifth longitudinal distance are both in a range between about 3:1 and about 5:1.

6. The ground engaging tip of claim 4, wherein a ratio of the second longitudinal distance between the center of the retention orifice of the first side wall and the proximal end of the first interlock tab to a fifth longitudinal distance, measured along the longitudinal axis, between the center of the retention orifice of the first side wall and the interlock ends of the first coupler face wall and the second coupler face wall and a ratio of the fourth longitudinal distance between the center of the retention orifice of the second side wall and the proximal end of the second interlock tab to the fifth longitudinal distance are both in a range between about 4:1 and about 5:1.

7. A ground engaging tool system comprising:

a ground engaging tip including:

a ground engaging portion and a coupling portion in opposing relationship to the ground engaging portion along a longitudinal axis thereof, the coupling portion including an interior surface, a side wall, and an interlock tab, the interior surface defining a coupler pocket having an opening in communication with an interior cavity, the interior surface having a base wall, the side wall and the base wall at least partially defining the coupler pocket, and the interlock tab having a base end and a proximal end, the base end of the interlock tab contiguous with the side wall, the interlock tab extending from the base end to the proximal end in a direction substantially away from the ground engaging portion, wherein the sidewall defines a retention orifice having a center, and a ratio of a first longitudinal distance, measured along the longitudinal axis, from the center of the retention orifice to the base wall and a second longitudinal distance, measured along the longitudinal axis, from the center of the retention orifice to the proximal end of the interlock tab is in a range between about 1:3 and about 1:1 or less, wherein the interior surface further includes a coupler face wall extending along a normal axis away from the side wall, the normal axis being perpendicular to the longitudinal axis, the coupler face wall extends from the base wall away from the ground engaging portion and includes;

a distal planar portion respectively adjacent the base wall, a first convex portion respectively adjacent the distal planar portion, a concave portion respectively adjacent the first convex portion, and a second convex portion respectively adjacent the concave portion such that the concave portion is between the first and second convex portions a coupler having a mounting nose and an interlock collar defining an interlock recess, the coupler mounted to the ground engaging tip such that the mounting nose of the coupler is disposed within the coupler pocket and the interlock tab of the ground engaging tip is disposed within the interlock recess; and a retention mechanism disposed within the retention orifice and adapted to secure the ground engaging tip to the coupler.

8. The ground engaging tool system of claim 7, wherein the ratio of the first longitudinal distance and the second longitudinal distance is in a range between about 1:3 about 1:2 and about 1:1.

9. The ground engaging tool system of claim 7, wherein the retention orifice is disposed substantially longitudinally midway between the proximal end of the interlock tab and the base wall of the interior surface.

10. The ground engaging tip of claim 7, wherein the side wall and the interlock tab of the coupling portion comprise a first side wall and a first interlock tab, respectively, the coupling portion includes a second sidewall in spaced relationship to the first side wall and a second interlock tab having a base end and a proximal end, the base end of the second interlock tab contiguous with the second side wall, and the interior surface includes a first coupler face wall and a second coupler face wall, the first coupler face wall and the second coupler face wall extending between the first side wall and the second side wall and extending from the base wall toward the proximal end of the interlock tab, the second sidewall defining a second retention orifice with a center, and a ratio of a third longitudinal distance, measured along the longitudinal axis, from the center of the second retention orifice to the base wall and a fourth longitudinal distance, measured along the longitudinal axis, from the center of the second retention orifice to the proximal end of the second interlock tab being about 1:1 or less.

11. The ground engaging tool system of claim 7, wherein the first coupler face wall and the second coupler face wall each have an interlock end disposed in opposing relationship to the base wall along the longitudinal axis.

12. The ground engaging tool system of claim 11, wherein a ratio of the second longitudinal distance between the center of the retention orifice of the first side wall and the proximal end of the first interlock tab to a fifth longitudinal distance, measured along the longitudinal axis, between the center of the retention orifice of the first side wall and the interlock ends of the first coupler face wall and the second coupler face wall and a ratio of the fourth longitudinal distance between the center of the retention orifice of the second side wall and the proximal end of the second interlock tab to the fifth longitudinal distance are both in a range between about 3:1 and about 5:1.

* * * * *